US005112728A

United States Patent [19]

Tanji et al.

[11] Patent Number: 5,112,728

[45] Date of Patent: May 12, 1992

[54] SILVER HALIDE PHOTOGRAPHIC LIGHT-SENSITIVE MATERIAL

[75] Inventors: Masaki Tanji, Fujisawa; Toyoki Nishijima; Takahiro Ogawa, both of Odawara; Shun Takada, Odawara; Kazuhiro Murai, Odawara, all of Japan

[73] Assignee: Konica Corporation, Tokyo, Japan

[21] Appl. No.: 587,736

[22] Filed: Sep. 25, 1990

[30] Foreign Application Priority Data

Oct. 5, 1989 [JP] Japan ..... 1-260627
Oct. 6, 1989 [JP] Japan ..... 1-211738

[51] Int. Cl.[5] ..... G03C 1/815

[52] U.S. Cl. ..... 430/507; 430/512; 430/558; 430/642; 430/905; 430/931

[58] Field of Search ..... 430/507, 558, 642, 905, 430/931, 552, 553, 556, 512

[56] References Cited

U.S. PATENT DOCUMENTS

| | | | |
|---|---|---|---|
| 4,518,686 | 5/1985 | Sasaki et al. | 430/512 |
| 4,607,002 | 8/1986 | Nakayama et al. | 430/505 |
| 4,622,287 | 11/1986 | Umemoto et al. | 430/507 |
| 4,675,280 | 6/1987 | Kaneko et al. | 430/558 |
| 4,692,399 | 9/1987 | Sasaki et al. | 430/507 |
| 4,707,434 | 11/1987 | Koboshi et al. | 430/393 |
| 4,783,394 | 11/1988 | Hirose et al. | 430/380 |
| 4,795,696 | 1/1989 | Sasaki et al. | 430/512 |
| 4,830,948 | 5/1989 | Ishikawa et al. | 430/372 |
| 4,975,360 | 12/1990 | Sasaki et al. | 430/512 |

FOREIGN PATENT DOCUMENTS 89845 4/1988 Japan ..... 430/642

*Primary Examiner*—Charles L. Bowers, Jr.
*Assistant Examiner*—Janet C. Baxter
*Attorney, Agent, or Firm*—Finnegan, Henderson, Farabow, Garrett and Dunner

[57] ABSTRACT

A silver halide photographic light-sensitive material comprising a support having thereon a photographic silver halide emulsion layer containing a magenta coupler, a photographic silver halide emulsion layer containing a yellow coupler, a photographic silver halide emulsion layer containing a cyan coupler and an non-light-sensitive layer containing a binder and a UV absorbent, wherein said silver halide photographic light-sensitive material has not more than 7.6 g/m$^2$ of gelatin, said UV absorbent is liquid at an ordinary temperature, and said magenta coupler is a compound represented by Formula I;

Formula I wherein Z represents a non-metallic group necessary to form a nitrogen-containing heterocyclic ring, X represents a hydrogen atom or a group capable of being split upon reaction with an oxidation product of a color developing agent, and R represents a hydrogen atom or a substituent.

20 Claims, No Drawings

SILVER HALIDE PHOTOGRAPHIC LIGHT-SENSITIVE MATERIAL

FIELD OF THE INVENTION

This invention relates to a silver halide photographic light-sensitive material and, more particularly, to a silver halide photographic light-sensitive material improved in image quality and physical properties.

BACKGROUND OF THE INVENTION

Generally, a silver halide photographic light-sensitive material is coated thereon with silver halide emulsion layers so spectrally sensitized as to have desired light sensitivities, respectively, so that a dye image can be formed upon reaction of a color developing agent with each of the yellow, magenta and cyan dye-forming couplers contained in the silver halide emulsion layers, respectively.

Among these couplers, the 5-pyrazolone type couplers having so far been used as magenta dye-forming couplers have a serious problem of a yellow stain causing a non-color-developed portion a yellowish color change when applying heat or temperature to them, that is so-called Y-stain, because the formed dyes have a side- absorption around 430 nm that is undesirable for color reproduction.

There are magenta couplers such as those of pyrazolobenzimidazole described in, for example, British Patent No. 1,047,612, those of indazoles described in, for example, U.S. Pat. No. 3,770,447, and those of pyrazoloazoles described in, for example, U.S. Pat. No. 3,725,067, British Patent Nos. 1,252,418 and 1,334,515, Japanese Patent Publication Open to Public Inspection -hereinafter referred to as Japanese Patent O.P.I. Publication- Nos. 59-162548/1984 and 59-171956/1984. The dyes formed of the above-given magenta couplers have an extremely small side-absorption around 430 nm and extremely few Y-stains produced by heat or temperatures.

However, the dyes formed of the above-mentioned pyrazoloazole type couplers are low in light-fastness and, particularly, the commercial values thereof are seriously spoiled when they are used for color papers for direct appreciation. Therefore, various improvements thereof have been studied to solve the problems.

As for one of the improvements, there are some proposals for using various kinds of antifading agents and UV absorbents in combination. To obtain a satisfactory effect, a large amount thereof should be used. Resultingly, oil drops are increased to very often produce a sweating phenomenon, that is a phenomenon that the oil drops contained in a light-sensitive material are diffused and flocculated to produce liquid drops on the surface of the light-sensitive material or to make the liquid drops adhere to the surface thereof when the light-sensitive material is stored under the high temperature and high humidity conditions.

To inhibit the light-sensitive material from producing a sweating phenomenon, it is effective to increase an amount of binders to be added. However, it is found that only a simple increase of a gelatin content is not any decisive means at all for solving the problem, but a cause of the deteriorations of the white-background property and color reproducibility of the processed light-sensitive material. The simple increase thereof also produces, particularly, Y-stains, though the sweating phenomenon may be reduced to some extent.

On the other hand, silver halide emulsions having a high silver chloride content have preferably been used to meet the recent rapid-processing requirements. It is, however, found that some kind of highly silver chloride containing grains produce a desensitization caused by a physical pressure, and that the deteriorations are amplified in an emulsion containing the above-mentioned magenta couplers, though a rapid processing speed may be provided.

As for the means for improving the above-described pressure- desensitization and pressure-fog production, some methods have been known, in which any pressure does not affect silver halide grains, that is to say, the methods in which various gelatin, polymers and organic compounds are used in protective layers, interlayers or silver halide-containing layers.

There may be, for example, the combination use of the heterocyclic compounds given in British Patent No. 738,618, alkyl phthalates given in British Patent No. 738,637, alkyl esters given in British Patent No. 738,639, hydrophilic compounds including, particularly, polyhydric alcohol given in U.S. Pat. No. 2,960,404, carboxyalkyl cellulose given in U.S. Pat. No. 3,121,060, paraffin and carboxylates given in Japanese Patent 0.P.I. Publication No. 49-5017/1974, glycerol derivatives and ether or thioether compounds given in Japanese Patent 0.P.I. Publication No. 51-141623/1976, organic high boiling compounds not miscible with any hydrophilic binders given in Japanese Patent 0.P.I. Publication No. 53-85421/1978, alkyl acrylates and organic acids given in Japanese Patent Examined Publication No. 53-28086/1978, and liquid type UV absorbents and vinyl sulfon type hardeners given in Japanese Patent O.P.I. Publication No. 63-46439/1988.

In the above-described methods, the improvement effects of pressure-desensitization are not yet satisfactory, so that there are demands for a light-sensitive material high in resistance against pressure-sensitization and pressure-desensitization which may be derived from the increase in the transport speed of an automatic processor introduced to meet the wide application of rapid processes.

SUMMARY OF THE INVENTION

It is an object of the invention to provide a silver halide photographic light-sensitive material capable of solving the above-described problems.

Another object of the invention is to provide a silver halide photographic light-sensitive material capable of giving an excellent image quality and showing excellent physical properties even under various conditions.

DETAILED DESCRIPTION OF THE INVENTION

The above-mentioned objects of the invention can be achieved with a silver halide photographic light-sensitive material comprising a support having thereon a photographic silver halide emulsion layer containing a magenta coupler, a photographic silver halide emulsion layer containing a yellow coupler, a photographic silver halide emulsion layer containing a cyan coupler and an non-light-sensitive layer containing a binder and a UV absorbent, wherein said silver halide photographic light sensitive material has not more than 7.6 g/m$^2$ of gelatin, said UV absorbent is liquid at an ordinary temperature, and said magenta coupler is a compound represented by Formula I;

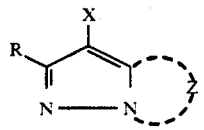

Formula I wherein Z represents a non-metalic group necessary to form a nitrogen-containing heterocyclic ring, provided, the rings formed by Z may each have a substituent;

X represents a hydrogen atom or a group capable of being split upon reaction with an oxidation product of a color developing agent; and R represents a hydrogen atom or a substituent.

Now, the invention will be further detailed.

In the magenta couplers represented by Formula I, there is no special limitation to the substituents represented by R. However, they include, typically, each of the groups of alkyl, aryl, anilino, acylamino, sulfonamido, alkylthio, arylthio, alkenyl, cycloalkyl and, besides, halogen atoms and each of the groups of cycloalkenyl, alkinyl, heterocyclic, sulfonyl, sulfinyl, phosphonyl, acyl, carbamoyl, sulfamoyl, cyano, alkoxy, aryloxy, heterocyclic-oxy, siloxy, acyloxy, carbamoyloxy, amino, alkylamino, imido, ureido, sulfamoylamino, alkoxycarbonylamino, aryloxycarbonylamino, alkoxycarbonyl, aryloxycarbonyl and heterocyclic-thio; spiro-compound residual groups; and cross-linking hydrocarbon compound residual groups.

As for the alkyl groups represented by R, those having 1 to 32 carbon atoms are preferably used and they may be either straight-chained or branched.

As for the aryl groups represented by R, a phenyl group is preferably used.

The acylamino groups represented by R include, for example, an alkylcarbonylamino group and an arylcarbonylamino group.

The sulfonamido groups represented by R include, for example, an alkylsulfonylamino group and an arylsulfonylamino group.

In the alkylthio and arylthio groups each represented by r, the alkyl and aryl components thereof include, for example, the foregoing alkyl and aryl groups each represented by R.

As for the alkenyl groups represented by R, those having 2 to 32 carbon atoms are preferably used and, as for the cycloalkyl groups represented by R, those having 3 to 12 carbon atoms and, particularly, 5 to 7 carbon atoms are preferably used; provided, the alkenyl groups may be either straight-chained or branched.

As for the cycloalkenyl groups represented by R, those having 3 to 12 carbon atoms and, particularly, 5 to 7 carbon atoms are preferably used.

The sulfonyl groups represented by R include, for example, an alkylsulfonyl group and an arylsulfonyl group;

The sulfinyl groups include, for example, an alkylsulfinyl group and an arylsulfinyl group;

The phosphonyl groups include, for example, an alkylphosphonyl group, an alkoxyphosphonyl group, an aryloxyphosphonyl group, and an arylphosphonyl group;

The acyl groups include, for example, an alkylcarbonyl group and an arylcarbonyl group;

The carbamoyl groups include, for example, an alkylcarbamoyl group and an arylcarbamoyl group;

The sulfamoyl groups include, for example, an alkylsulfamoyl group and arylsulfamoyl group;

The acyloxy groups include, for example, an alkylcarbonyloxy group and an arylcarbonyloxy group;

The carbamoyloxy groups include, for example, an alkylcarbamoyloxy group and an arylcarbamoyloxy group;

The ureido groups include, for example, an alkylureido group and an arylureido group;

The sulfamoylamino groups include, for example, an alkylsulfamoylamino group and an arylsulfamoylamino group;

As for the heterocyclic groups, those having 5 to 7 carbon atoms are preferably used. They include, typically, a 2-furyl group, a 2-thienyl group, a 2-pyrimidinyl group and a 2-benzothiazolyl group;

As for the heterocyclic-oxy groups, those having a 5- to 7-membered ring are preferably used. They include, for example, a 3,4,5,6-tetrahydropyranyl-2-oxy group and a 1-phenyltetrazole-5-oxy group;

As for the heterocyclic-thio groups, those having a 5- to 7-membered ring are preferably used. They include, for example, a 2-pyridylthio group, a 2-benzothiazolylthio group and a 2,4-diphenoxy-1,3,5-triazole-6-thio group;

The siloxy groups include, for example, a trimethylsiloxy group, a triethylsiloxy group and a dimethylbutylsiloxy group;

The imido groups include, for example, a succinimido group, a 3-heptadecylsuccinimido group, a phthalimido group and a glutarimido group;

The spiro-compound residual groups include, for example, a spiro [3.3]heptane-1-yl group;

The cross-linking hydrocarbon compound residual groups include, for example, a bicyclo [2.2.1] heptane-1-yl, tricyclo [3.3.1.1$^{3,7}$] decane-1-yl, and 7,7-dimethylbicyclo [2.2.1] heptane-1-yl;

The groups capable of being split off upon reaction with the oxidized products of a color developing agent include, for example, halogen atoms such as a chlorine, bromine and fluorine atom, and each group of alkoxy, aryloxy, heterocyclic-oxy, acyloxy, sulfonyloxy, alkoxycarbonyloxy, aryloxycarbonyl, alkyloxalyloxy, alkoxyoxalyloxy, alkylthio, arylthio, heterocyclic-thio, alkyloxythiocarbonylthio, acylamino, sulfonamido, nitrogen-containing heterocyclic ring bonded with an N atom, alkyloxycarbonylamino, aryloxycarbonylamino, carboxyl, and

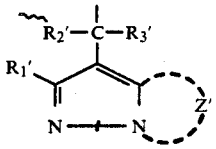

wherein $R_{1'}$ is synonymous with the foregoing R; Z' is synonymous with the foregoing Z; and $R_{2'}$ and $R_{3'}$ represent each a hydrogen atom, an aryl group, an alkyl group, or a heterocyclic group. Among them, a halogen atom and, particularly, chlorine atom may preferably be used.

The nitrogen-containing heterocyclic rings each formed with Z or Z' include, for example, a pyrazole ring, an imidazole ring, a triazole ring and a tetrazole ring, and the substituents of the foregoing rings include those given by the foregoing R.

Those represented by Formula I can further be represented typically by the following formulas II through VII:

Formula II

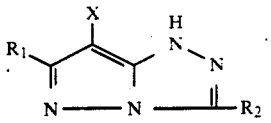

Formula III

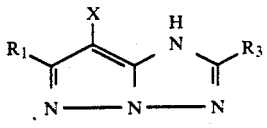

Formula IV

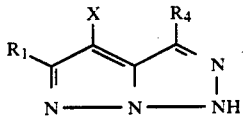

Formula V

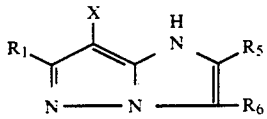

Formula VI

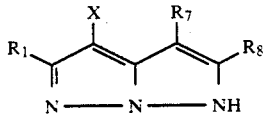

Formula VII

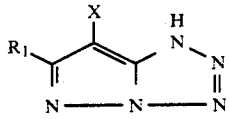

In Formulas II through VII, $R_1$ through $R_8$ and X are each synonymous with the foregoing R and X, respectively.

The preferable among those represented by Formula I are represented by Formula VIII given below:

Formula VIII

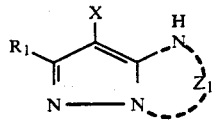

wherein $R_1$, X and $Z_1$ are each synonymous with R, X and Z each denoted in Formula I.

Among the magenta couplers represented by Formulas II through VII, the particularly preferable are those represented by Formula II.

The most preferable substituents represented by R and $R_1$ on the foregoing heterocyclic rings are those represented by Formula IX given below:

Formula IX

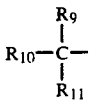

wherein $R_9$, $R_{10}$ and $R_{11}$ are synonymous with those represented by the foregoing R.

Any two of the above-denoted $R_9$, $R_{10}$ and $R_{11}$, for example, $R_9$ and $R_{10}$, are allowed to form a saturated or unsaturated ring such as cycloalkane, cycloalkene and heterocyclic rings, upon coupling of $R_9$ to $R_{10}$. It is also allowed to constitute a cross-linking hydrocarbon compound residual group upon coupling of $R_{11}$ to the ring.

In Formula IX, it is preferable that (i) at least two of $R_9$ through $R_{11}$ are alkyl groups and (ii) One of $R_9$ through $R_{11}$, $R_{11}$ for example, is a hydrogen atom and the other two, $R_9$ and $R_{10}$ for example, are coupled together to form a cycloalkyl group with a root carbon atom.

It is further preferable for the above-given case (i) that two of $R_9$ through $R_{11}$ are alkyl groups and one of the rest is a hydrogen atom or an alkyl group. In the rings formed with Z denoted in Formula I and the rings formed with $Z_1$ denoted in Formula VIII. The substituents which the rings may have, and $R_2$ through $R_8$ denoted in Formulas II through VI, are preferably represented by the following Formula X:

$$-R^1-SO_2-R^2 \qquad \text{Formula X}$$

wherein $R^1$ represents an alkylene group, and $R^2$ represents an alkyl, cycloalkyl or aryl group.

The alkylene groups represented by $R^1$ are preferable to have not less than two carbon atoms and, more preferably, 3 to 6 carbon atoms in the straight-chained portion thereof, and they are regardless of the straight-chained and the branched.

The cycloalkyl groups represented by $R^2$ include preferably those each having 5- or 6-membered ring.

The typical examples of the compounds relating to the invention will be given below:

I-1

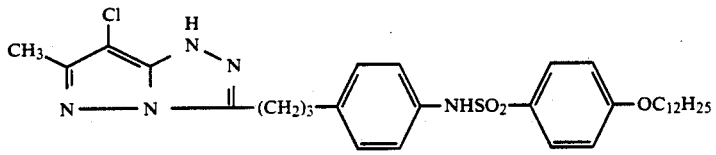

I-2

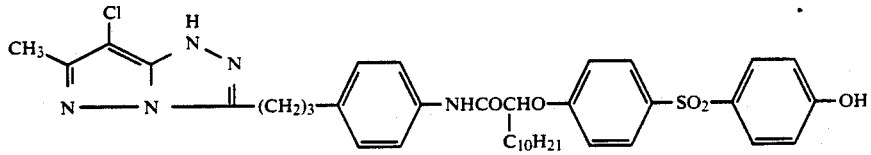

-continued
I-3
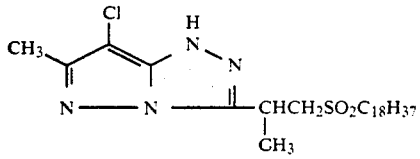
I-4
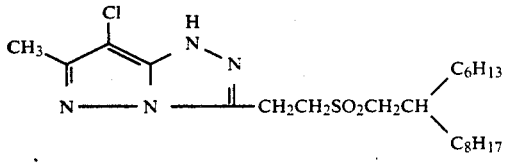
I-5
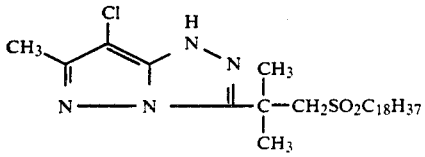
I-6
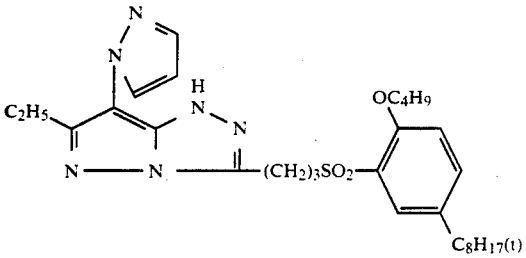
I-7
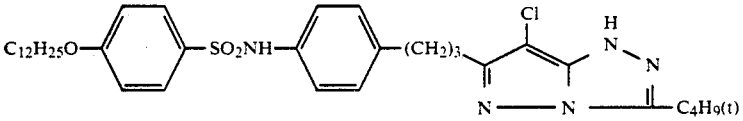
I-8
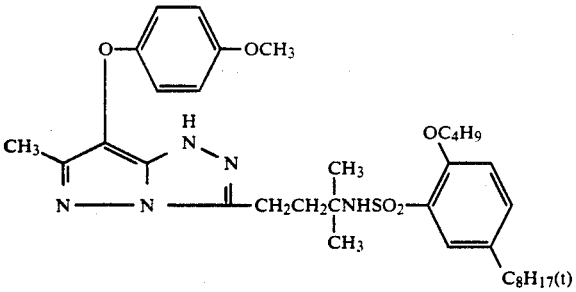
I-9
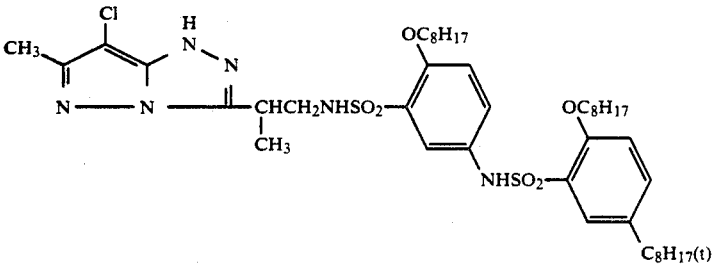

-continued
I-10
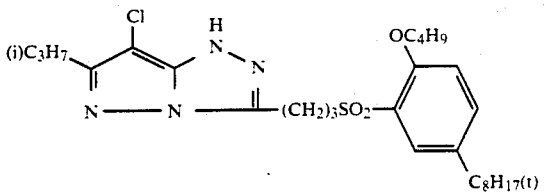
I-11
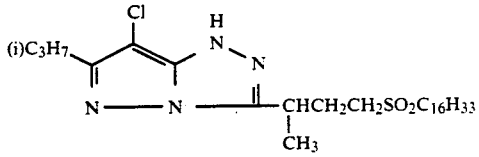
I-12
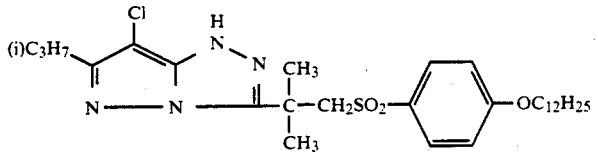
I-13
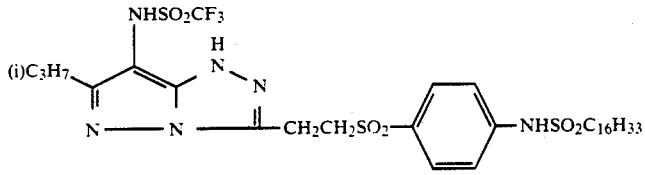
I-14
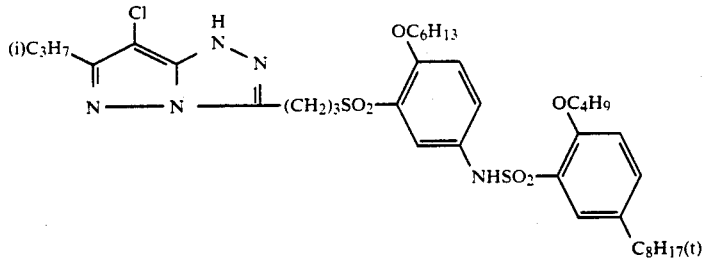
I-15
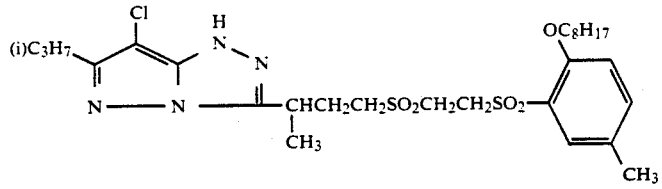
I-16
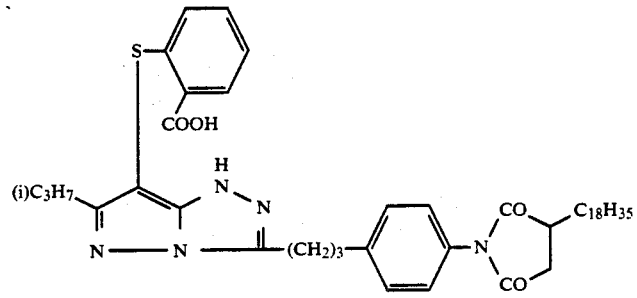
I-17
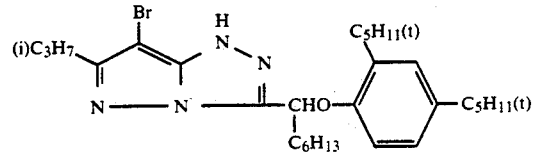

-continued
I-18
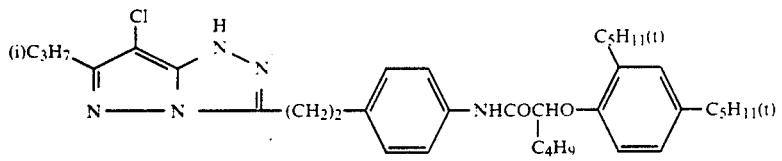
I-19
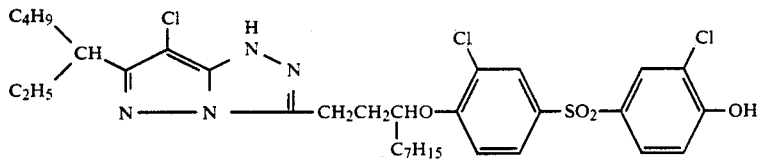
I-20
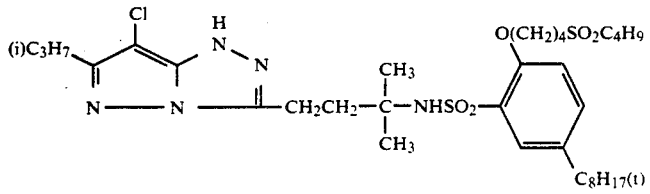
I-21
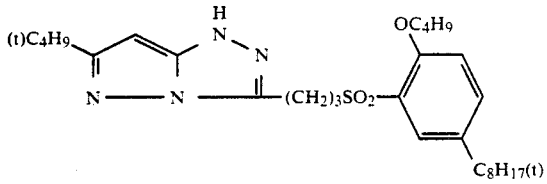
I-22
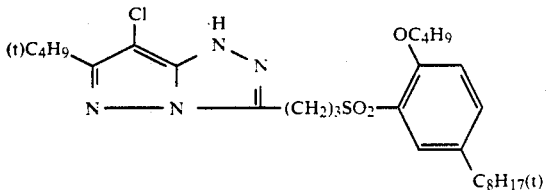
I-23
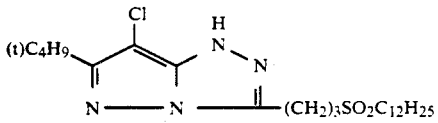
I-24
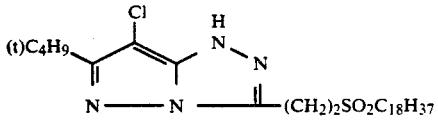
I-25
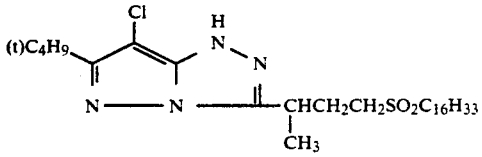
I-26
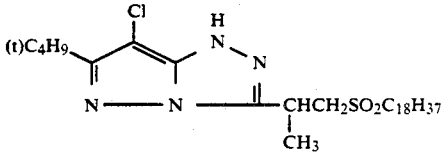

-continued
I-27
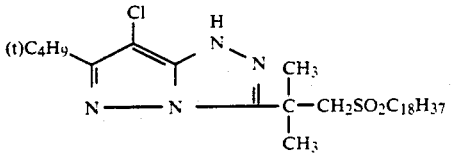
I-28
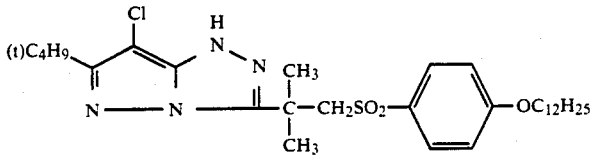
I-29
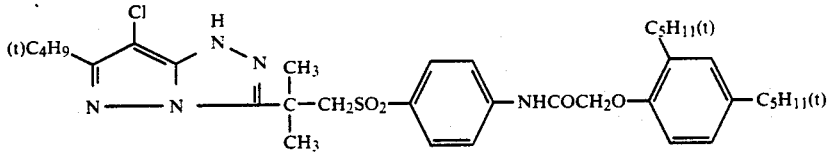
I-30
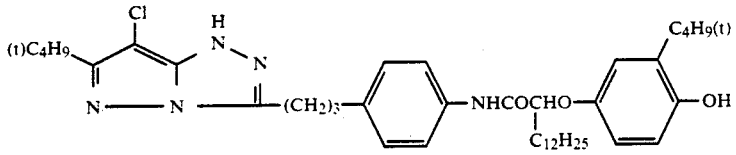
I-31
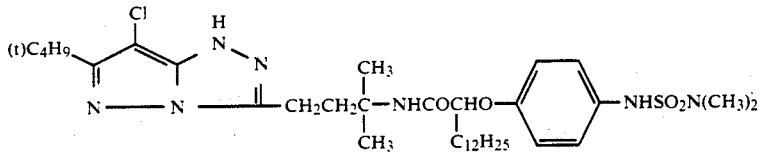
I-32
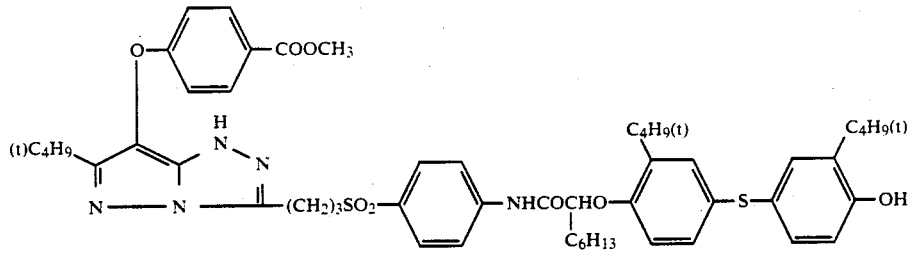
I-33
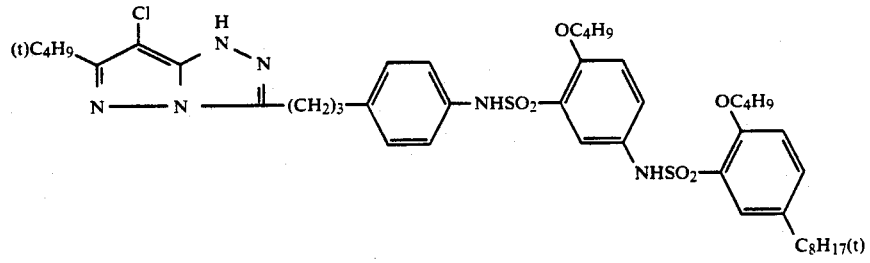
I-34
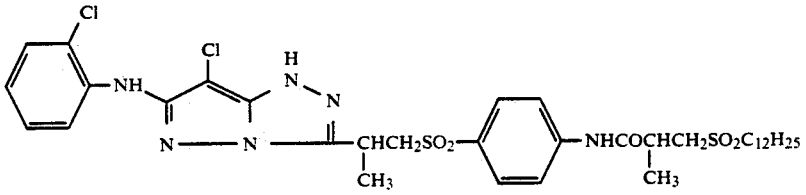

-continued
I-35
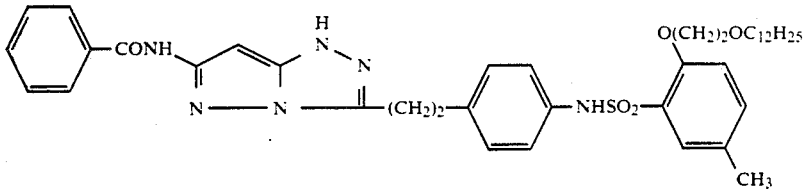
I-36
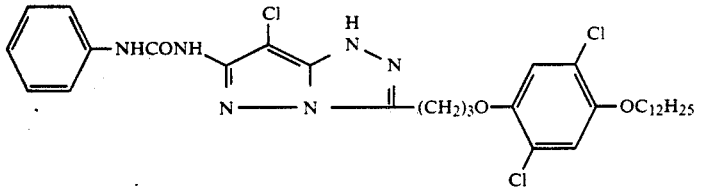
I-37
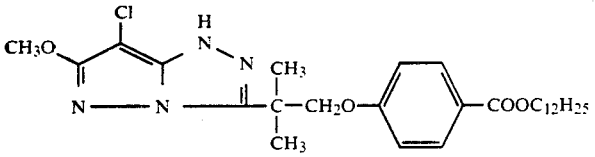
I-38
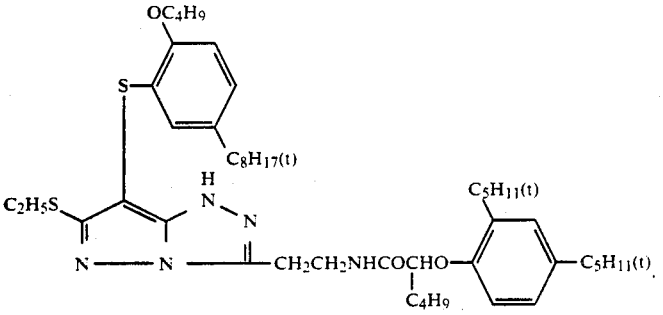
I-39
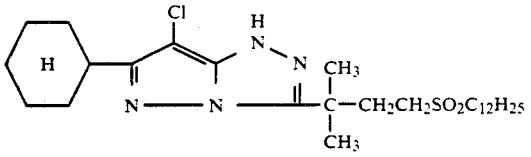
I-40
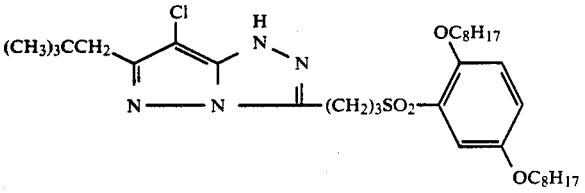
I-41
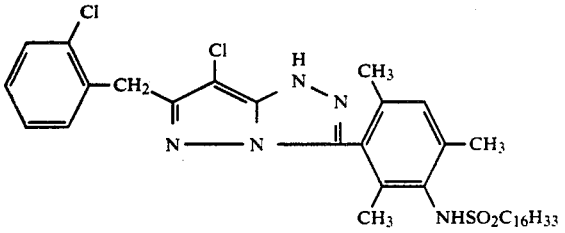

-continued
I-42
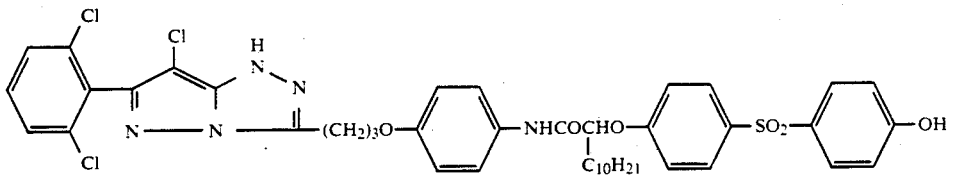
I-43
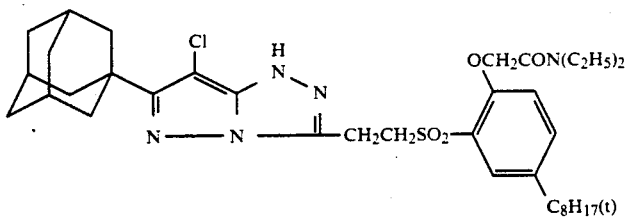
I-44
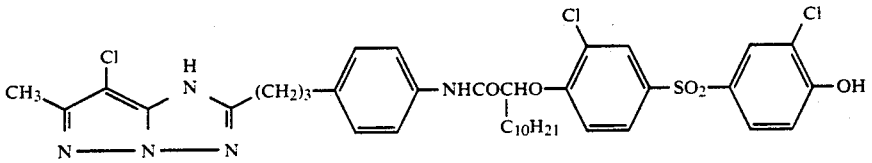
I-45
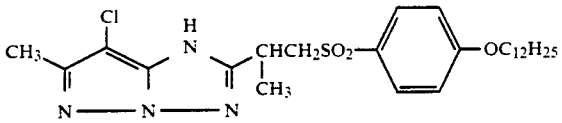
I-46
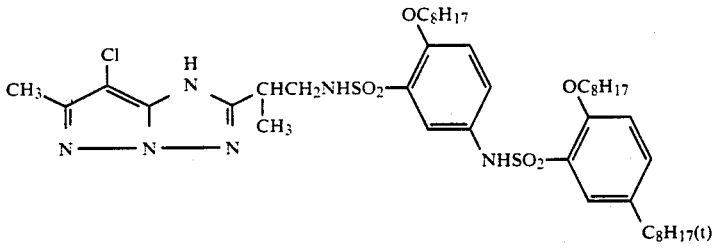
I-47
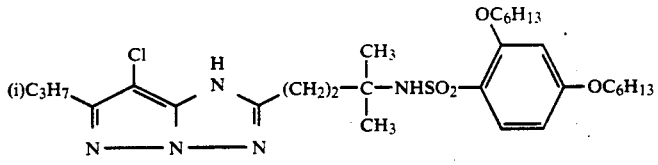
I-48
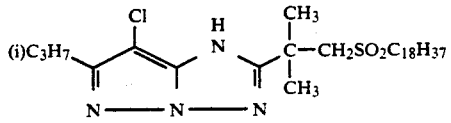
I-49
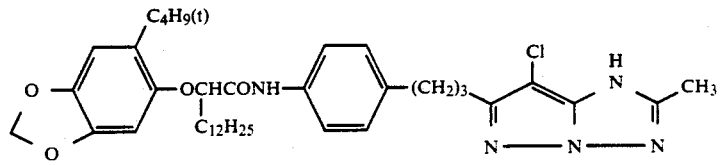

-continued
I-50
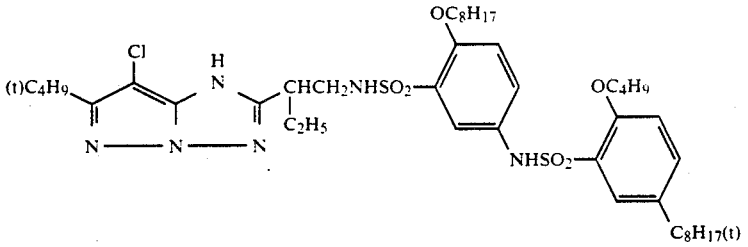
I-51
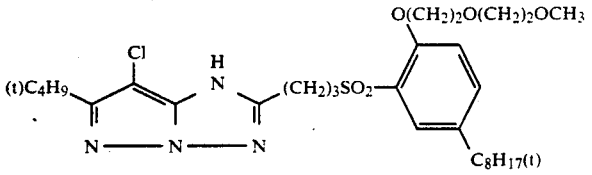
I-52
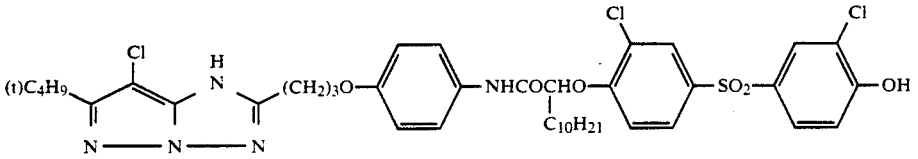
I-53
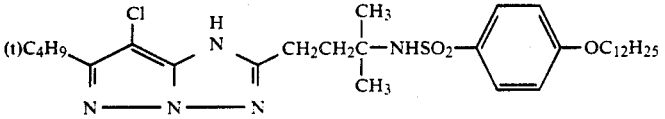
I-54
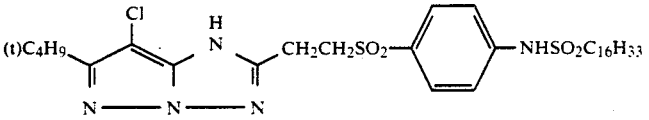
I-55
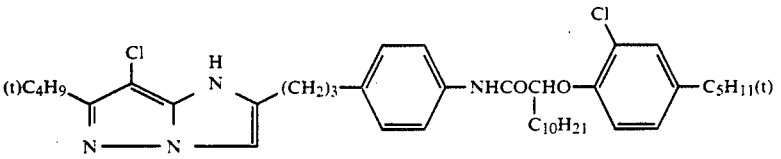
I-56
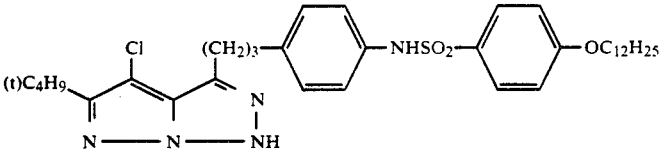
I-57
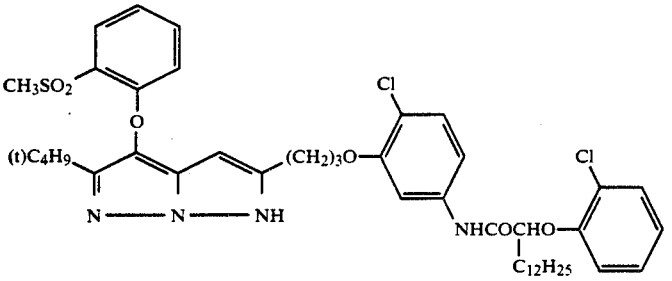
I-58
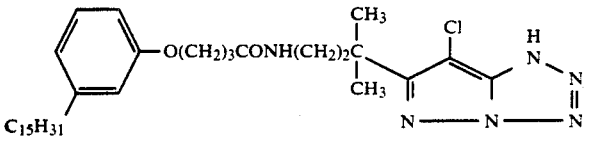

-continued

I-59

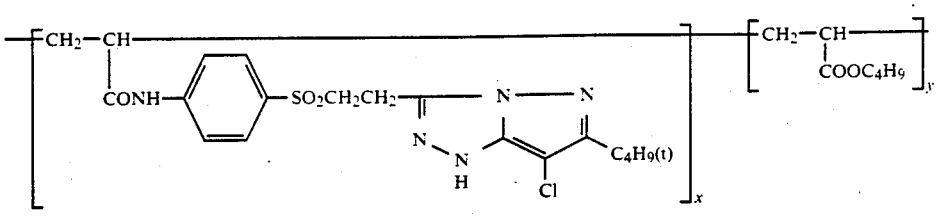

x:y = 50:50

I-60

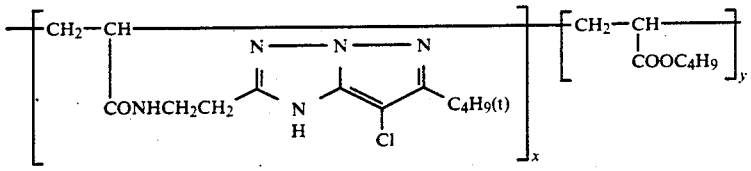

x:y = 50:50

I-61

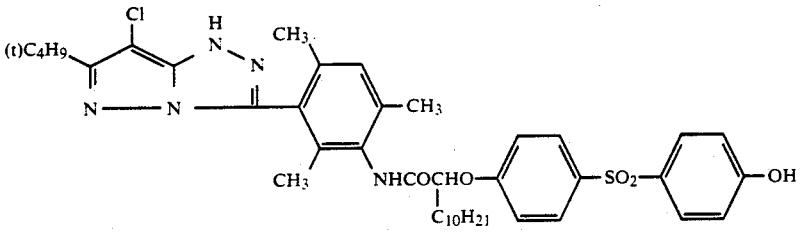

I-62

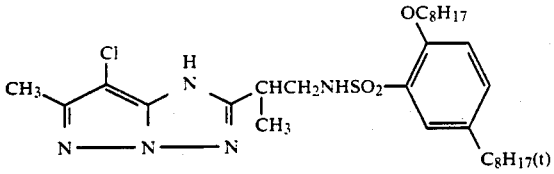

Besides the above-given typical examples of the compounds relating to the invention, the additional examples of the compounds relating to the invention include the compounds denoted by Nos. 1~4, 6, 8~17, 19~24, 26~43, 45~59, 61~104, 106~121, 123~162 and 164~223 out of the compounds given in the right upper column on page 18 to the right upper column on page 32 of Japanese Patent O.P.I. Publication No. 62-166339/1987.

The above-mentioned couplers can be synthesized with reference to the descriptions in Journal of the Chemical Society, Perkin I, 2047~2052, 1977,; U.S. Pat. No. 3,725,067; and japanese Patent O.P.I. Publication Nos. 59-99437/1984, 58-42045/1983, 59-162548/1984, 59-171956/1984, 60-33552/1985, 60-43659/1985, 60-172982/1985 and 60-190779/1985.

The magenta couplers of the invention may be used in an amount within the range of, normally, $1\times10^{-3}$ to 1 mol per mol of silver halide and, preferably, $1\times10^{-2}$ to $8\times10^{-1}$ mol.

The magenta couplers of the invention can be used with the other kinds of magenta couplers in combination.

Next, Uv absorbents applicable to the invention which is liquid at an ordinary temperature -hereinafter referred to the liquid UV absorbents of the invention- will be detailed.

In the invention, the expression, "liquid at an ordinary temperature", means that, as defined in 'Dictionary of Chemistry' Kyoritsu Press, 1963 Ed., a UV absorbent is so amorphous as to be fluidized at 25.C and has an approximately constant volume. Therefore, the melting point thereof shall not be limitative, as far as the UV absorbents have the above-mentioned characteristics. Such compounds are, however, to have a melting point of −100° to 30° C. and, preferably, 100° to 15° C.

The liquid UV absorbents of the invention may be each either a single compound or the mixtures thereof. As for the mixtures thereof, those comprising the group consisting of structural isomers may preferably be used. Such structural isomers are detailed in, for example, U.S. Pat. No. 4,587,346.

The liquid UV absorbents of the invention can take any structures, provided, they can satisfy the above-described requirements. However, from the viewpoint of the light fastness of their own, a 2-(2'-hydroxyphenyl) benzotriazole type compound represented by Formula a may preferably be used.

Formula a

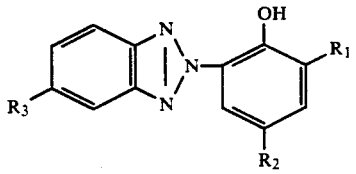

wherein $R_1$, $R_2$ and $R_3$ represent each a hydrogen atom, a halogen atom, an alkyl group, an aryl group, an alkoxy group, an aryloxy group, an alkenyl group, a nitro group or a hydroxyl group.

The halogen atoms represented by $R_1$, $R_2$ and $R_3$ include, for example, a fluorine atom, a Chlorine atom, or a bromine atom.

As for the alkyl and alkoxy groups represented each by $R_1$, $R_2$ and $R_3$, those having 1 ~ 30 carbon atoms may preferably be used and, as the alkenyl groups, those having 2 ~ 30 carbon atoms may preferably be used. These groups may be either straight-chained or branched.

The above-given alkyl, alkenyl and alkoxy groups may further have substituents.

groups should preferably be an alkyl group and, more preferably, at least two of the groups should be alkyl groups.

The alkyl groups represented by $R_1$, $R_2$ and $R_3$ may be any ones of the alkyl groups. However, at least one of them may preferably be either a tertiary or secondary alkyl group.

It is particularly preferable that the groups represented by $R_1$ and $R_2$ are alkyl groups and at least one of the alkyl groups is either a tertiary or secondary alkyl group.

The typical examples of the liquid UV absorbents of the invention will be given below:

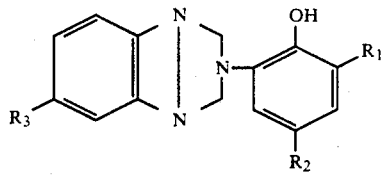

| Exemplified compound No. | $R_1$ | $R_2$ | $R_3$ |
|---|---|---|---|
| UV-1L | $-CH_3$ | $-C_4H_9$(sec) | $-H$ |
| UV-2L | $-C_4H_9$(sec) | $-C_4H_9$(t) | $-C_4H_9$(t) |
| UV-3L | $-C_4H_9$(sec) | $-C_4H_9$(t) | $-C_4H_9$ |
| UV-4L | $-C_4H_9$(sec) | $-C_4H_9$(t) | $-C_5H_{11}$(t) |
| UV-5L | $-C_4H_9$(sec) | $-C_4H_9$(t) | $-C_5H_{11}$ |
| UV-6L | $-C_4H_9$(sec) | $-C_5H_{11}$(t) | $-C_4H_9$(t) |
| UV-7L | $-C_4H_9$(sec) | $-C_5H_{11}$(t) | $-C_4H_9$ |
| UV-8L | $-C_4H_9$(t) | $-C_4H_9$(t) | $-C_4H_9$(sec) |
| UV-9L | $-C_5H_{11}$(t) | $-C_5H_{11}$(t) | $-C_4H_9$(sec) |
| UV-10L | $-C_4H_9$(t) | $-C_5H_{11}$(t) | $-C_4H_9$(sec) |
| UV-11L | $-C_4H_9$(sec) | $-C_4H_9$(sec) | $-C_4H_9$(t) |
| UV-12L | $-C_4H_9$(sec) | $-C_4H_9$(sec) | $-C_4H_9$ |
| UV-13L | $-C_4H_9$(t) | $-C_2H_4COOC_8H_{17}$ | $-H$ |
| UV-14L | $-C_4H_9$(t) | $-C_2H_4COOCH_2CHC_4H_9$ (with $C_2H_5$) | $-H$ |
| UV-15L | $-C_4H_9$(t) | $-(CH_2)_2COO(CH_2)_2OC_4H_9$ | $-H$ |
| UV-16L | $-C_8H_{17}$ | $-CH_3$ | $-H$ |
| UV-17L | $-C_{10}H_{21}$ | $-CH_3$ | $-H$ |
| UV-18L | $-C_{12}H_{25}$ | $-CH_3$ | $-H$ |
| UV-19L | $-C_{16}H_{33}$ | $-CH_3$ | $-H$ |
| UV-20L | $-C_{20}H_{41}$ | $-CH_3$ | $-H$ |
| UV-21L | $-C_{22}H_{45}$ | $-CH_3$ | $-H$ |
| UV-22L | $-C_{24}H_{49}$ | $-CH_3$ | $-H$ |

The typical examples of the alkyl, alkenyl and alkoxy groups include a methyl group, an ethyl group, an isopropyl group, a t-butyl group, a sec-butyl group, a butyl group, an amyl group, a sec-amyl group, a t-amyl group, an $\alpha,\alpha$-dimethylbenzyl group, an octyloxycarbonylethyl group, a methoxy group, an ethoxy group, an octyloxy group and an aryl group.

As for the aryl and aryloxy groups represented by $R_1$, $R_2$ and $R_3$, phenyl and phenyloxy groups may preferably be used, and they may have substituents. Among them, a phenyl group, a 4-t-butylphenyl group and a 2,4-di-t-amylphenyl group may be exemplified.

Among the groups represented by $R_1$ and $R_2$, a hydrogen atom, an alkyl group, an alkoxy group, an aryl group and, particularly, a hydrogen atom, an alkyl group and an alkoxy group may preferably be used.

Among the groups represented by $R_3$, a hydrogen atom, a halogen atom, an alkyl group and an alkoxy group may preferably be used and, inter alia, a hydrogen atom, an alkyl group and an alkoxy group may more preferably be used.

In order to liquidify the groups represented by $R_1$, $R_2$ and $R_3$ at an ordinary temperature, at least one of the The liquid UV absorbents relating to the invention can be used, at an ordinary temperature, with a solid Uv absorbent in combination. In this case, the solid UV absorbent may be mixed therein in any mixing proportion, however, an amount of the liquid UV absorbent to be mixed in at an ordinary temperature is, preferably, not less than 10% by weight to the whole UV absorbent used and, more preferably, not less than 30% by weight thereto.

Such solid UV absorbents applicable to the invention at an ordinary temperature are allowed to take any preferable structures, provided, they are in the solid form at an ordinary temperature of 25° C.

However, from the viewpoint of the light fastness of the solid UV absorbent of its own, the solid 2-(2'-hydroxyphenyl) benzotriazole type UV absorbents represented by the foregoing formula a should particularly be preferable to be used.

The typical examples of the solid UV absorbents will be given below:

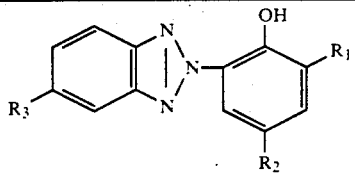

| Exemplified compound No. | $R_1$ | $R_2$ | $R_3$ |
|---|---|---|---|
| UV-1S | —H | —H | —H |
| UV-2S | —H | —$CH_3$ | —H |
| UV-3S | —H | —$C_4H_9$(t) | —H |
| UV-4S | —$C_4H_9$(t) | —$C_4H_9$(t) | —H |
| | —$C_4H_9$(t) | —$CH_3$ | —Cl |
| UV-6S' | —$C_4H_9$(t) | —$C_4H_9$(t) | —Cl |
| UV-7S | —$C_5H_{11}$(t) | —$C_5H_{11}$(t) | —H |
| UV-8S | —$C_4H_9$(t) | —$C_4H_9$(t) | —$C_4H_9$(t) |
| UV-9S | —$C_4H_9$(sec) | —$C_4H_9$(t) | —Cl |
| UV-10S | —$C_5H_{11}$(t) | —$C_5H_{11}$(t) | —$C_5H_{11}$(t) |
| UV-11S | —H | —$C_8H_{17}$(t) | —H |
| UV-12S | —$C_4H_9$(sec) | —$C_4H_9$(t) | —H |
| UV-13S | —$CH_3$ | —$C_4H_9$(t) | —H |
| UV-14S | —$C_5H_{11}$(t) | —$C_5H_{11}$(t) | —$OCH_3$ |
| UV-15S | —$C_5H_{11}$(t) | —O— 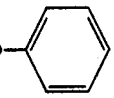 | —$CH_3$ |
| UV-16S | —H | —$C_{12}H_{25}$ | —H |
| UV-17S | —H | —$OC_8H_{17}$(sec) | —$OCH_3$ |
| UV-18S | —$C_4H_9$(t) | —$C_4H_9$(t) | 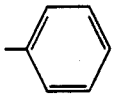 |
| UV-19S | —$C_5H_{11}$(t) | 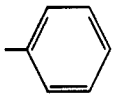 | —$OCH_3$ |

The total amount of the UV absorbents relating to the invention can be used in any amount. They may be used, for example, in a proportion within the range of 0.1 ~ 300%, preferably, 1 ~ 200% and, more preferably, 5 ~ 100%, each by weight to the weight of the binders of a photographic component layer containing the UV absorbent.

Each of the UV absorbents may be added into any photographic component layers. In the case of adding it into a non-light-sensitive layer, it is preferable to add it into a layer arranged farther from a support than a silver halide emulsion layer arranged nearest from the support and it is particularly preferable to add it into a layer arranged farther from the support than a silver halide emulsion layer arranged farthest from the support. Also in the case of adding it into a silver halide emulsion layer, it is preferable to add it into a silver halide emulsion layer arranged farthest from the support.

A total amount of gelatin to be contained in a silver halide photographic light-sensitive material of the invention is not more than 7.6 g/m$^2$ and, preferably, within the range of 5.0 g/m$^2$ to 7.6 g/m$^2$.

The silver halide grains of the invention are, preferably, to have a silver chloride content of not less than 90 mol %, a silver bromide content of not more than 10 mol % and a silver iodide content of not more than 0.5 mol %. More preferably, the silver halide grains of the invention are to comprise silver chlorobromide having a silver bromide content within the range of 0.1 to 2 mol %.

The silver halide grains of the invention may be used independently or in the mixture thereof with the other silver halide grains having the different compositions. It is also allowed to use them in the mixture thereof with silver halide grains having a silver chloride content of not more than 10 mol %.

In a silver halide emulsion layer containing silver halide grains of the invention having a silver chloride content of not less than 90 mol %, the silver halide grains, which have a silver chloride content of not less than 90 mol % to the whole silver halide grain contained in the emulsion layer, are to be in a proportion of not less than 60% by weight and, preferably, not less than 80% by weight, each to the weight of the emulsion layer.

The composition of the silver halide grains of the invention may be either uniform all through from the inside of the grains to the outside thereof or different in the compositions between the inside and the outside of the individual grains. In the latter case, the compositions thereof may be varied either continuously or discontinuously from the inside to the outside of the grains.

There is no special limitation to the grain-sizes of the silver halide grains of the invention. However, taking other photographic characteristics such as rapid processability and sensitivity into consideration, the grain-sizes thereof are within the range of, preferably, 0.2 ~ 1.6 μm and, more preferably, 0.25 ~ 1.2 μm. The grain-sizes can be measured in a variety of methods generally applicable to the technical fields of the art. The typical methods thereof are detailed in, for example, Loveland, 'Particle Size Analyses', A.S.T.M. Symposium on Light Microscopy, 1955, pp. 94–122, and Mees and James, 'A Theory of Photographic Process', 3rd ed., MacMillan Publishing Company, 1966, Chapter 2.

The above-mentioned grain-sizes may be measured by using the projective areas or approximate values of grain-sizes. When the grains are substantially uniform in shape, the considerably precise grain-size distribution may be expressed in terms of the grain-sizes or projective areas thereof.

The grain-size distribution of the silver halide grains of the invention may be either in a polydisperse type or in a monodisperse type. For the grain-size distribution of the silver halide grains, monodisperse type silver halide grains having a variation coefficient of not more than 0.22 and, particularly, not more than 0.15 are preferred. Herein, the variation coefficient is a coefficient expressing a range of grain-size distribution, and it can be defined by the following equations:

$$\text{Variation coefficient } (S/r) = \frac{\text{Standard deviation of grain-size distribution}}{\text{Average grain-size}}$$

$$\text{Standard deviation of grain-size distribution } (S) = \sqrt{\frac{\Sigma(r - ri)^2 ni}{\Sigma ni}}$$

$$\text{Average grain-size } (r) = \frac{\Sigma niri}{\Sigma ni}$$

wherein ri represents the grain-size of an individual grain; and ni represents the number of the individual grain. The term, 'grain-size', used herein means a diameter of a silver halide grain when it is in the globular form, and a diameter of a circular image converted from the projective image of a silver halide grain when it is in the cubic form or any other forms than the globular form.

The silver halide grains applicable to the emulsions of the invention may be those prepared in any one of an acidic method, a neutral method and an ammoniacal method. The grains may be grown either at a time or after preparing seed grains. The method of preparing the seed grains and the method of growing the grains may be either the same with or the different from each other.

A soluble silver salt may be reacted with a soluble halogen salt in any one of a normal precipitation method, a reverse precipitation method, a simultaneous precipitation method and the combinations thereof. Among the methods, the simultaneous precipitation method is preferably used. As one of the simultaneous precipitation methods, a pAg-controlled double-jet method as detailed in Japanese Patent O.P.I. Publication No. 54-48521/1979 may also be used.

Silver halide solvents such as thioether may also be used, if required. Further, a mercapto group-containing compound, a nitrogen-containing heterocyclic compound or compounds such as a sensitizing dye may also added either when or after producing silver halide grains.

Silver halide grains relating to the invention may have any configurations. One of the preferable examples of the grains is a cubic grain having a {100} plane as the crystal face thereof.

Further, octahedral, tetradecahedral or dodecahedral grains may also be used. These grains may be produced in the methods detailed in, for example, U.S. Pat. Nos. 4,183,756 and 4,225,666, Japanese Patent O.P.I. Publication No. 55-26589/1980, Japanese Patent Examined Publication No. 55-42737/1980, and The Journal of Photographic Science, 21, 39, 1973.

Still further, the grains having twin-crystal faces may also be used. As for the silver halide grains relating to the invention, grains having a single configuration and grains having a mixture of various configurations may also be used.

In a process of forming and/or growing the silver halide grains applicable to the emulsions of the invention, metal ions are added into the grains by making use of a cadmium salt, a zinc salt, a lead salt, a thallium salt, an iridium salt or the complex salts thereof, a rhodium salt or the complex salts thereof, or an iron salt or the complex salts thereof, so that the metal ions may be contained in the grains and/or on the surfaces of the grains. Further, reduction-sensitizing nuclei may be provided to the inside of the grains and/or onto the surfaces of the grains by putting the grains in a suitable reducible atmosphere.

From the emulsions of the invention containing silver halide grains -hereinafter referred to as the emulsion of the invention-, any needless soluble salts may be removed after growing the silver halide grains. Or, the needless soluble salts may remain contained in the emulsions of the invention. In the case of removing the needless soluble salts, they may be removed in the method detailed in, for example, Research Disclosure, No. 17643.

The silver halide grains applicable to the emulsions of the invention may be those mainly forming a latent image either on the surfaces thereof or to the inside of the grains. Among these grains, those mainly forming an latent image on the surface thereof are preferably used.

The emulsions of the invention may be sensitized in any ordinary methods.

The silver halide emulsions of the invention may be optically sensitized to a desired wavelength region with a sensitizing dye. Such sensitizing dyes may be used independently or in combination. It is allowed that the emulsions may contain not only the sensitizing dye, but also a dye having no spectral sensitizing function in its own or a compound substantially incapable of absorbing any visible rays of light, that is, a so-called supersensitizer capable of enhancing the sensitizing function of the foregoing sensitizing dye.

Further, the above-mentioned sensitizing dyes may be used not only for their own intrinsic spectral-sensitization but also for the adjustments of gradations and developments.

The sensitizing dyes applicable thereto include, for example, a cyanine dye, a melocyanine dye, a compound cyanine dye, a compound melocyanine dye, a holopolar cyanine dye, a hemicyanine dye, a styryl dye and a hemioxanol dye.

For the purposes of preventing a light-sensitive material from being fogged in the course of preparing, storing or photographically processing a light-sensitive material and keeping the photographic characteristics of the light-sensitive material stable, an antifoggant or a stabilizer may be added into the emulsions of the invention, during a chemical ripening process, when completing the chemical ripening process, and/or in the course between the time of completing the chemical ripening process and the time of coating the silver halide emulsion.

As for the binders for the silver halide emulsions of the invention, gelatin is advantageously used. It is also allowed to use hydrophilic colloids including, for example, a gelatin derivative, a graft polymer of gelatin and other high molecular compounds, and, besides, a protein, a sugar derivative, a cellulose derivative, and a synthetic hydrophilic high molecular substance such as a monomer or copolymer.

In the invention, the yellow dye forming couplers represented by the following formula XI may preferably be used.

Formula XI

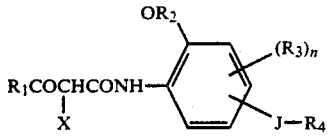

wherein $R_1$ represents an alkyl group, a cycloalkyl group or an aryl group; and $R_2$ represents an alkyl group, a cycloalkyl group, an acyl group or an aryl group;

$R_3$ represents an atom or a group capable of being substituted for a benzene ring; n is an integer of 0 or 1; $R_4$ represents an organic group containing one coupling group having a carbonyl or silfonyl unit; J represents $$-\underset{\underset{R_5}{|}}{N}CO- \text{ or } -C\underset{\underset{R_5}{|}}{N}-.$$

in which $R_5$ represents a hydrogen atom, an alkyl group, an aryl group or a heterocyclic group; and X represents a group capable of being split off upon reaction with the oxidized products of a color developing agent.

The yellow couplers represented by Formula XI will further be detailed.

The alkyl groups represented by $R_1$ include, for example, a methyl group, an ethyl group, an isopropyl group, a t-butyl group and a dodecyl group. The alkyl groups represented by $R_1$ further include those having substituents such as a halogen atom, an aryl group, an alkoxy group, an aryloxy group, an alkylsulfonyl group, an acylamino group, and a hydroxyl group.

The cycloalkyl groups represented by $R_1$ include, for example, a cyclopropyl group, a cyclohexyl group, and an adamantyl group.

The aryl groups represented by $R_1$ include, for example, a phenyl group.

The preferable groups represented by $R_1$ include, for example, a branched alkyl group.

The alkyl and cycloalkyl groups each represented by $R_2$ include, for example, the same groups as represented by $R_1$. The aryl groups represented by $R_2$ include, for example, a phenyl group.

The alkyl, cycloalkyl and aryl groups each represented by $R_2$ include those having the same substituents as in $R_1$.

The acyl groups include, for example, an acetyl group, a propionyl group, a butyryl group, a hexanoyl group and a benzoyl group.

Among the groups represented by $R_2$, alkyl groups and aryl groups are preferable and, inter alia, alkyl groups are particularly preferable.

There is no special limitation to the groups capable of being substituted for a benzene ring, however, they include, for example: halogen atoms such as a chlorine atom; alkyl groups such as an ethyl group, an i-propyl group and a t-butyl group; alkoxy groups such as a methoxy group; aryloxy groups such as a phenoxy group; acyloxy groups such as a methylcarbonyloxy group and a benzoyloxy group; acylamino groups such as an acetamido group and a benzamido group; carbamoyl groups such as an N-methylcarbamoyl group and an N-phenylcarbamoyl group; alkylsulfonamido groups such as an ethylsulfonamido group; arylsulfonamido groups such as a phenylsulfonamido group; sulfamoyl groups such as an N-propylsulfamoyl group and an N-phenylsulfamoyl group; and imido groups such as a succinimido group and a glutarimido group.

In Formula XI, $R_4$ represents an organic group containing one coupling group having a carbonyl or sulfonyl unit. The groups each having a carbonyl unit include, for example, an ester group, an amido group, a carbamoyl group, a ureido group and a urethane group. The groups each having a sulfonyl unit include, for example, a sulfon group, a sulfonamido group, a sulfamoyl group and an aminosulfonamido group.

In $-\underset{\underset{R_5}{|}}{N}CO-$ or $-C\underset{\underset{R_5}{|}}{N}-$, represented by J, the alkyl groups represented by $R_5$ include, for example, a methyl group, an ethyl group, an isopropyl group, a t-butyl group and a dodecyl group. The aryl groups represented by $R_5$ include, for example, a phenyl group and a naphthyl group.

The alkyl and aryl groups each represented by $R_5$ also include those having substituents. Such substituents shall not be limitative, but include, typically; halogen atoms such as a chlorine atom; alkyl groups such as an ethyl group and a t-butyl group; aryl groups such as a phenyl group, a p-methoxyphenyl group and a naphthyl group; alkoxy groups such as an ethoxy group and a benzyloxy group; aryloxy groups such as a phenoxy group; alkylthio groups such as an ethylthio group; arylthio groups such as a phenylthio group; alkylsulfonyl groups such as a $\beta$-hydroxyethylsulfonyl group; arylsulfonyl groups such as a phenylsulfonyl group;-.and, besides, acylamino groups such as an acetoamido group and a benzamido group; carbamoyl groups such as a carbamoyl group, an N-methylcarbamoyl group and an N-phenylcarbamoyl group; acyl groups; sulfonamido groups; sulfamoyl groups such as a sulfamoyl group, an N-methylsulfamoyl group and an N-phenylsulfamoyl group; and, further, a hydroxyl group and a nitrile group.

X represents a group capable of being split off upon reaction with the oxidized products of a color developing agent. The groups include, for example, those represented by Formula XII or XIII given below:

$$-OR_6 \qquad \text{Formula XII}$$

wherein $R_6$ represents an aryl or heterocyclic group including those having substituents.

Formula XIII

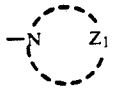

wherein $Z_1$ represents the group consisting of non-metal atoms necessary to form a 5- or 6-membered ring in association with a nitrogen atom. Such atomic groups necessary to form the non-metal atom group include, for example, methylene, methine, substituted methine,

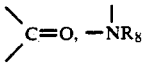

in which $R_8$ is synonymous with the foregoing $R_5$, —N=, —O—, —S— and $-SO_2-$.

The 2-equivalent yellow couplers represented by the foregoing Formula I are allowed to form a bis-substance upon coupling to the position of $R_1$, $R_3$ or $R_4$.

The preferable yellow couplers of the invention are represented each by Formula XIV given below:

Formula XIV

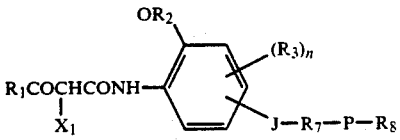

wherein $R_1$, $R_2$, $R_3$ and J represent each the same groups represented by $R_1$, $R_2$, $R_3$ and J denoted each in Formula XI; n is an integer of 0 or 1; $R_7$ represents an alkylene group, an arylene group, an alkylenearylene group, an arylenealkylene group or —A—$V_1$—B— in which A and B represent each an alkylene group, an arylene group, an alkylenearylene group or an arylenealkylene group, and $V_1$ represents a divalent coupling group; $R_8$ represents an alkyl group, a cycloalkyl group, an aryl group or a heterocyclic group; P represents a coupling group having a carbonyl or sulfonyl unit; and $X_1$ is synonymous with X denoted in Formula XI.

The alkylene groups represented by $R_7$ include, for example, a methylene group, an ethylene group, a propylene group, a butylene group and a hexylene group, and they also include those having substituents. Those substituted with alkyl groups include, for example, each group of methylmethylene, ethyl-ethylene, 1-methyl-ethylene, 1-methyl-2-ethyl-ethylene, 2-decyl-ethylene and 3-hexyl-propylene, and 1-benzyl-ethylene. Those substituted with aryl groups include, for example, each group of 2-phenyl-ethylene and 3-naphthylpropylene.

The arylene groups include, for example, a phenylene group and a naphthylene group.

The alkylenearylene groups include, for example, a methylenephenylene group, and the arylenealkylene groups include, for example, a phenylenemethylene group.

The alkylene, arylene, alkylenearylene or arylenealkylene groups each represented by A or B are the same groups as the alkylene, arylene, alkylenearylene or arylenealkylene groups each represented by $R_7$ denoted in the foregoing Formula XIV. The divalent coupling groups represented by $V_1$ include, for example, the groups of —O— and —S—. Among the alkylene, arylene, alkylenearylene, arylenealkylene and —A—$V_1$—B— groups each represented by $R_7$, alkylene groups are particularly preferred.

The alkyl groups each represented by $R_8$ include, for example, an ethyl group, a butyl group, a hexyl group, an octyl group, a dodecyl group, a hexadecyl group and an octadecyl group, and these alkyl groups may be straight-chained or branched. The cycloalkyl groups include, for example, a cyclohexyl group. The aryl groups include, for example, a phenyl group and a naphthyl group. The heterocyclic groups include, for example, a pyridyl group.

The alkyl, cycloalkyl, aryl and heterocyclic groups each represented by $R_8$ also include those having substituents.

There is no special limitation to such substituents, and they include the same groups as the substituents given in the foregoing $R_5$, provided, however, it is not preferred for a substituent of $R_5$ to use an organic group having a dissociative hydrogen atom such as a phenolic hydrogen atom having a pKa value of not higher than 9.5.

In the foregoing Formula XIv, P represents a coupling group having a carbonyl or sulfonyl unit or, preferably, a group represented by the following group XV:

Group XV

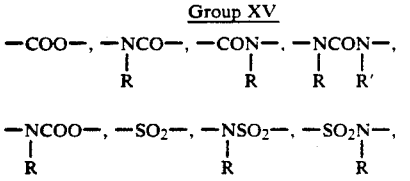

-continued

Group XV'

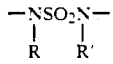

wherein R and R' represent each a hydrogen atom, an alkyl group, an aryl group or a heterocyclic group, provided, R and R' may be the same with or the different from each other.

The groups represented by R and R' include, for example, the same groups as given by the foregoing $R_5$, and they also include those having substituents. Among them, one of the preferable groups represented by R and R' is a hydrogen atom.

In Formula XIV, X represents a coupling split-off group, and the groups preferably represented by X include, for example, those represented by Formulas XVI through XXII each given below:

Formula XVI

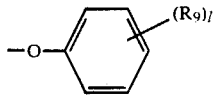

wherein $R_9$ represents a carboxyl group, an ester group, an acyl group, an alkylsulfonyl group, an arylsulfonyl group, a hydroxyl group or the same substituents as the groups given by the foregoing $R_3$; and l is an integer of 1 to 5, provided, when l is not less than 2, $R_9$s may be the same with or the different from each other.

Formula XVII

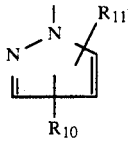

Formula XVIII

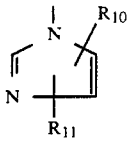

Formula XIX

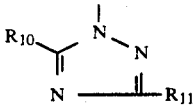

wherein $R_{10}$ and $R_{11}$ represent each a hydrogen atom, a halogen atom, an alkyl group, an alkoxy group, an aryl group, a heterocyclic group, an alkoxycarbonyl group, an aryloxycarbonyl group, an amino group, an acylamino group, an alkylsulfonyl group, an arylsulfonyl group, an alkylsulfinyl group, an arylsulfinyl group, an alkylsulfonamido group, an arylsulfonamido group, a carboxyl group, and the above-given groups each having substituents.

$R_{10}$ and $R_{11}$ may form a ring.

Formula XX

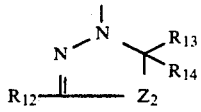

-continued

Formula XXI

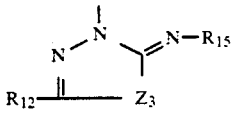

wherein $Z_2$ and $Z_3$ represent each a hetero atom such as an oxygen atom, and $R_{12}$, $R_{13}$ and $R_{14}$ represent each the same groups as represented by the foregoing $R_{10}$ and $R_{11}$.

$R_{15}$ represents an alkyl group, an aryl group, an alkylcarbonyl group, an arylcarbonyl group, an alkylsulfonyl group, and an arylsulfonyl group.

Formula XXII

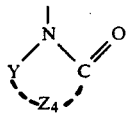

wherein Y represents a hetero atom such as —NH—, —N=, —O— and —S—, a sulfonyl group, a carbonyl group, or a carbon atom represented by

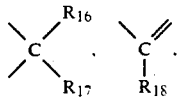

and $Z_4$ represents the group consisting of non-metal atoms necessary to form a 5- or 6-membered ring in association with

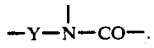

The atomic group necessary to form the group consisting of non-metal atoms may be given by the same groups as in the foregoing $Z_1$.

$R_{16}$, $R_{17}$ and $R_{18}$ represent each the same groups as represented by $R_{10}$ and $R_{11}$. $R_{16}$, $R_{17}$ and $R_{18}$ may also form a ring in association with a part of $Z_4$.

The 2-equivalent yellow couplers represented by the foregoing Formula XIV are allowed to form a bis-substance by coupling them to $R_1$, $R_3$ or a ballast group.

Next, the typical examples of the yellow couplers applicable to the invention, which are represented by Formula XI, will be given below. It is, however, to be understood that the invention shall not be limited thereto.

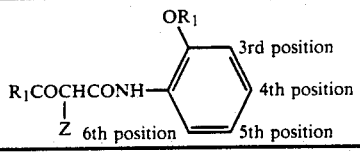

| No. | $R_1$ | $R_2$ | Z |
|---|---|---|---|
| XI-1 | (t)$C_4H_9$— | —$CH_3$ | 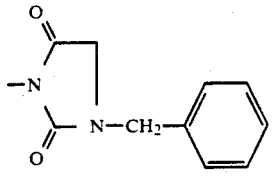 |
| XI-2 | (t)$C_4H_9$— | —$CH_3$ | 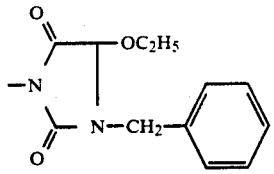 |
| XI-3 | (t)$C_4H_9$— | —$CH_3$ | 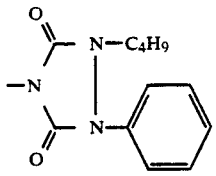 |
| XI-4 | (t)$C_4H_9$— | —$CH_3$ | 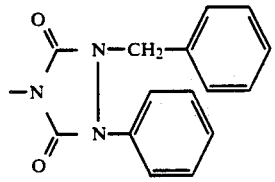 |

-continued
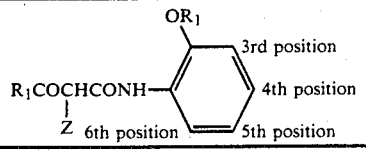
| | | | |
|---|---|---|---|
| XI-5 | (t)$C_4H_9$— | —$CH_3$ | 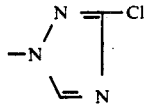 |
| XI-6 | (t)$C_4H_9$— | —$CH_3$ | 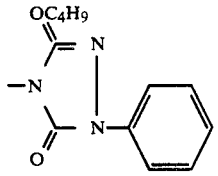 |
| XI-7 | (t)$C_4H_9$— | —$C_3H_7$(iso) | 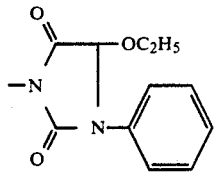 |
| XI-8 | (t)$C_4H_9$— | —$CH_3$ | 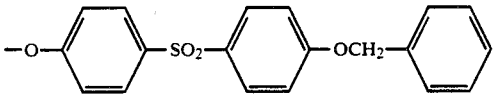 |
| XI-9 | (t)$C_4H_9$— | —$C_{12}H_{25}$ | 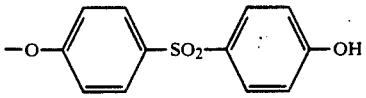 |
| XI-10 | (t)$C_4H_9$— | —$C_{18}H_{37}$ | 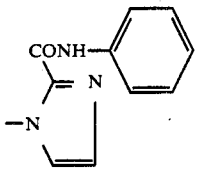 |
| XI-11 | (t)$C_4H_9$— | —$CH_3$ | 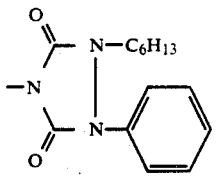 |
| XI-12 | (t)$C_4H_9$— | —$C_4H_9$ | 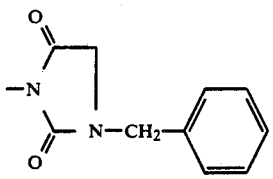 |
| XI-13 | (t)$C_4H_9$— | —$CH_3$ | 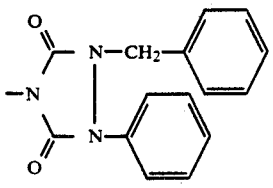 |

-continued
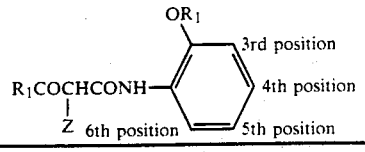
| | | | |
|---|---|---|---|
| XI-14 | (t)$C_4H_9$— | —$CH_3$ | 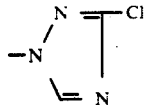 |
| XI-15 | (t)$C_4H_9$— | —$CH_3$ | 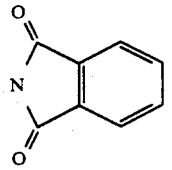 |
| XI-16 | (t)$C_4H_9$— | —$CH_3$ | 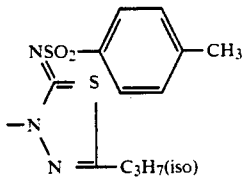 |
| XI-17 | 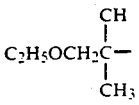 | —$CH_3$ | 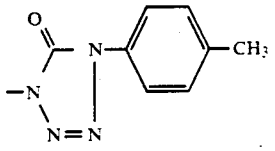 |
| XI-18 | (t)$C_4H_9$— | —$CH_3$ | 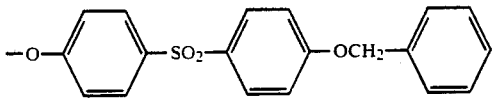 |
| XI-19 | (t)$C_4H_9$— | —$CH_3$ | 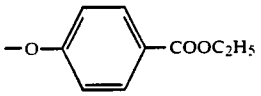 |
| XI-20 | (t)$C_4H_9$— | —$C_{12}H_{25}$ | 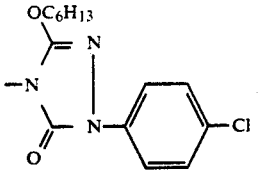 |
| XI-21 | (t)$C_4H_9$— | —$C_2H_5$ | 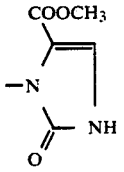 |
| XI-22 | 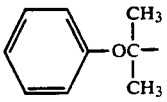 | —$C_4H_9$ | 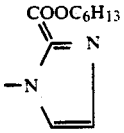 |
| XI-23 | (t)$C_5H_{11}$ | —$C_2H_5$ | H |

-continued
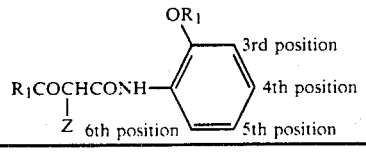
| | | | |
|---|---|---|---|
| XI-24 | (t)$C_4H_9$— | —$CH_3$ | 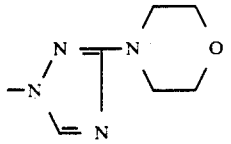 |
| XI-25 | (t)$C_4H_9$— | —$C_{16}H_{37}$ | 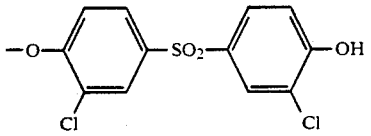 |
| XI-26 | (t)$C_4H_9$— | —$CH_3$ | 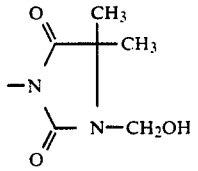 |
| XI-27 | (t)$C_4H_9$— | —$CH_3$ | 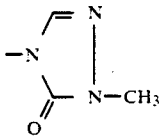 |
| XI-28 | (t)$C_4H_9$— | —$CH_3$ | 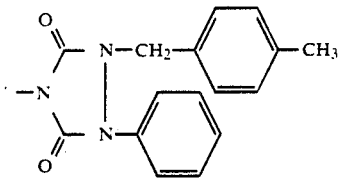 |
| XI-29 | 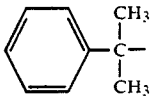 | —$C_{12}H_{25}$ | 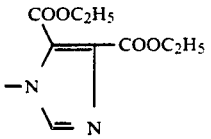 |
| XI-30 | (t)$C_5H_{11}$— | —$CH_3$ | 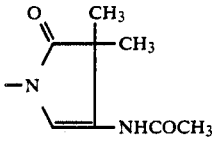 |
| XI-31 | (t)$C_4H_9$— | —$CH_3$ | 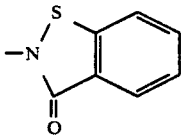 |
| XI-32 | (t)$C_4H_9$— | —$CH_3$ | 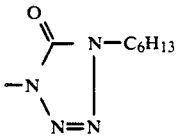 |

-continued
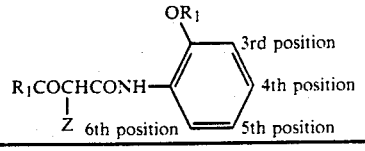
| | | | |
|---|---|---|---|
| XI-33 | (t)$C_4H_9$— | —$CH_3$ | 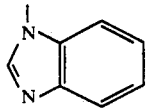 |
| XI-34 | (t)$C_4H_9$— | 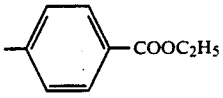 | 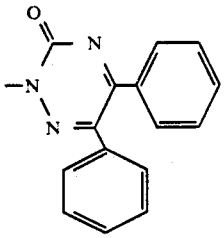 |
| XI-35 | (t)$C_4H_9$— | —$C_4H_9$ | 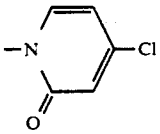 |
| XI-36 | (t)$C_4H_9$— | —$CH_3$ | 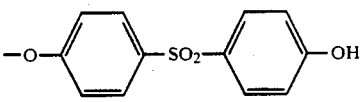 |
| XI-37 | (t)$C_4H_9$— | 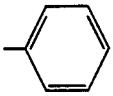 | 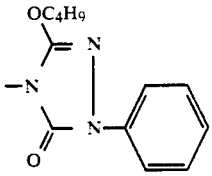 |
| XI-38 | (t)$C_5H_{11}$— | —$CCCH_3$ | 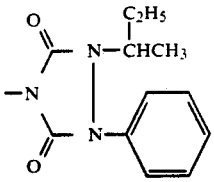 |
| XI-39 | (t)$C_4H_9$— | —$CCC_2H_5$ | 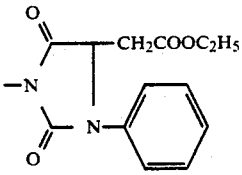 |
| XI-40 | (t)$C_4H_9$— | —$CH_3$ | 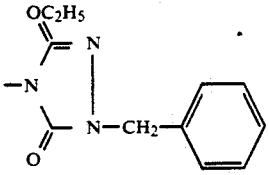 |

-continued
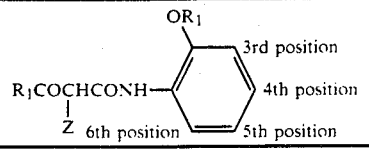
| | | | |
|---|---|---|---|
| XI-41 | (t)$C_4H_9$— | —$CH_3$ | 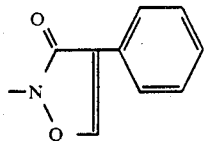 |
| XI-42 | (t)$C_4H_9$— | —$CH_3$ | 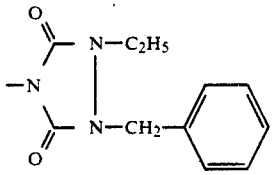 |
| XI-43 | (t)$C_4H_9$— | —$CH_3$ | 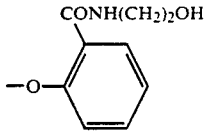 |
| XI-44 | 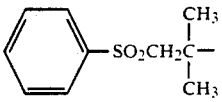 | —$C_2H_5$ | 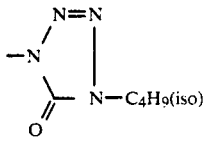 |
| XI-45 | (t)$C_4H_9$— | 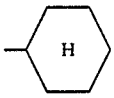 | 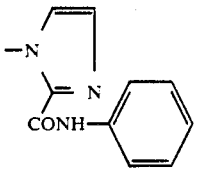 |
| XI-46 | 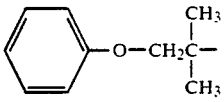 | —$CH_3$ | 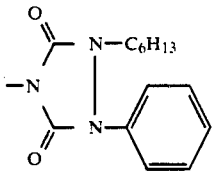 |
| XI-47 | (iso)$C_3H_7$— | —$C_4H_9$ | 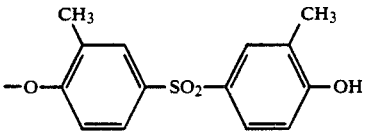 |
| XI-48 | 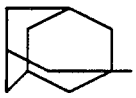 | —$CH_3$ | 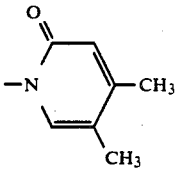 |
| XI-49 | 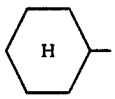 | —$CH_3$ | 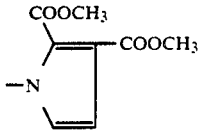 |

-continued
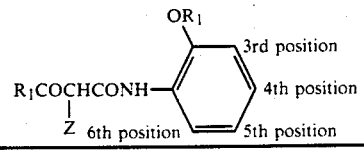
| | | | |
|---|---|---|---|
| XI-50 | (t)$C_4H_9$— | —$CH_3$ | 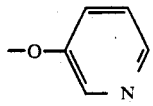 |
| XI-51 | 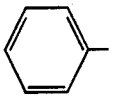 | —$CH_3$ | 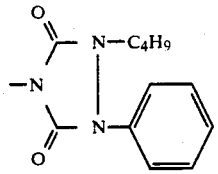 |
| XI-52 | 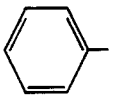 | —$C_2H_5$ | 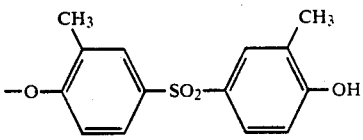 |
| XI-53 | 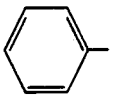 | —$C_{16}H_{33}$ | 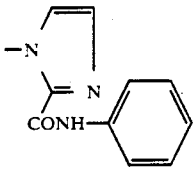 |
| No. | 3rd position | 4th position | 5th position | 6th position |
|---|---|---|---|---|
| XI-1 | —H | —H | 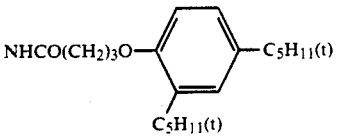 | —H |
| XI-2 | —H | —H | 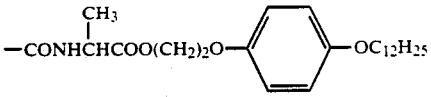 | —H |
| XI-3 | —H | —H | 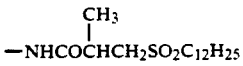 | —H |
| XI-4 | —H | —H | 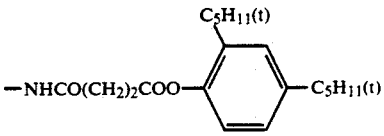 | —H |
| XI-5 | —H | —H | 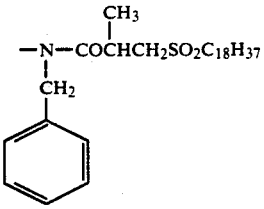 | —H |
| XI-6 | —H | —H | —$NHCO(CH_2)_2CONH_{12}H_{26}$ \| $C_2H_6$ | —H |

-continued
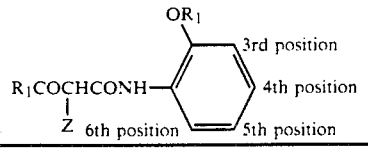
| | | | | |
|---|---|---|---|---|
| XI-7 | —H | —H | —CONH(CH2)3CONH— 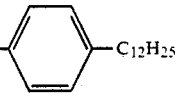 —C12H25 | —H |
| XI-8 | —H | —H | —CONH— 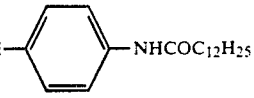 —NHCOC12H25 | —H |
| XI-9 | —H | —H | —CONHCH(CH3)CH2SO2C2H5 | —H |
| XI-10 | —H | —H | —NHCOC(CH3)2CH2SO2C4H9 | —H |
| XI-11 | —H | —H | —NHCOCH(CH3)NHCO— 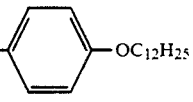 —OC12H25 | —H |
| XI-12 | —H | —H | —NHCOCH(C12H25)O— 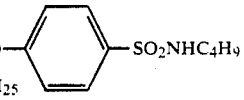 —SO2NHC4H9 | —H |
| XI-13 | —H | —H | —CONH(CH2)2NHSO2C12H25 | —H |
| XI-14 | —H | —H | —CONHCH(CH3)CH2SO2CH2CH(C6H13)C8H17 | —H |
| XI-15 | —H | —H | —SO2NH(CH2)3O— 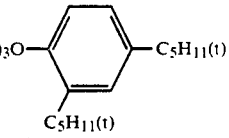 —C5H11(t) C5H11(t) | —H |
| XI-16 | —H | —H | —NHCOCH(CH3)(CH2)2NHCO— 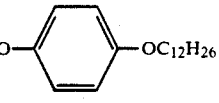 —OC12H26 | —H |
| XI-17 | —H | —H | —NHCO(CH2)10COOC2H5 | —H |
| XI-18 | —H | —H | —CONH— 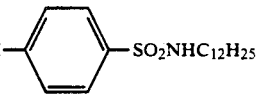 —SO2NHC12H25 | —H |
| XI-19 | —H | —H | —NHCOCH(C12H25)O— 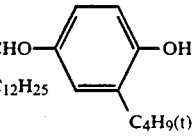 —OH C4H9(t) | —H |
| XI-20 | —H | —H | —NHCO(CH2)2SO2NHCH2CH(C2H5)C4H9 | —H |

-continued
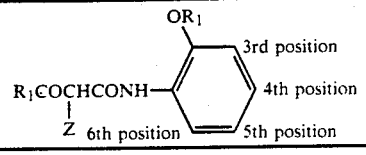
| | | | | |
|---|---|---|---|---|
| XI-21 | —H | —Cl | 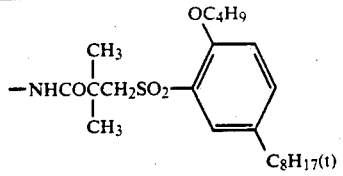 | —H |
| XI-22 | —H | —H | $-NHSO_2C_{16}H_{33}$ | —H |
| XI-23 | —H | —H | 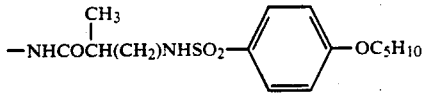 | —H |
| XI-24 | —H | —H | 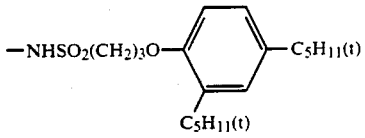 | —H |
| XI-25 | —H | —H | 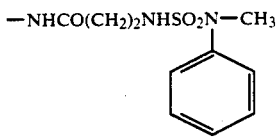 | —H |
| XI-26 | —H | —H | 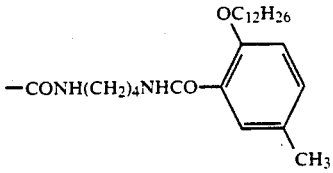 | —H |
| XI-27 | —H | —H | $-CONHCH(C_6H_{13})CH_2SO_2NHC_{12}H_{26}$ | —H |
| XI-28 | —H | —H | $-COOC_{12}H_{25}$ | —H |
| XI-29 | —H | —H | $-NHCO(CH_2)_3NHCONHCH_2CH(C_2H_5)C_4H_9$ | —H |
| XI-30 | —H | —H | 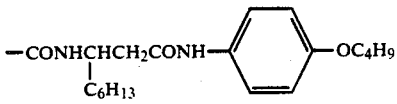 | —H |
| XI-31 | —H | —H | $-COOC_{18}H_{35}$ | —H |
| XI-32 | —H | —H | $-NHCO(CH_2)_3NHCOCH_2CH(C_8H_{17})C_6H_{13}$ | —H |
| XI-33 | —H | —Cl | 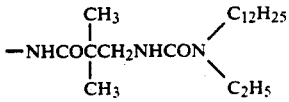 | —H |
| XI-34 | —H | —H | 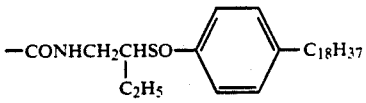 | —H |

-continued
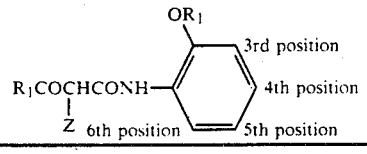
| | | | | |
|---|---|---|---|---|
| XI-35 | — | $-NHCOCH(C_{16}H_{33})SO_2NHC_{12}H_{25}$ | —Cl | —H |
| XI-36 | —H | —Cl | $-NHCO(CH_2)_2NHCO-C_6H_4-C_{12}H_{26}$ | —H |
| XI-37 | —H | —H | $-CONHC(CH_2)_2CONH-C_6H_4-OC_{12}H_{25}$ | —H |
| XI-38 | —H | $-OCH_3$ | $-NHCOCH(C_6H_5)(CH_2)_2NHSO_2-C_6H_3(OC_{12}H_{26})-CH_3$ | —H |
| XI-39 | —H | —H | $-COOCH(CH_3)COOC_{12}H_{25}$ | —H |
| XI-40 | —H | —H | $-CONHC(CH_3)_2(CH_2)_2COO-C_6H_4-CH_3$ | —H |
| XI-41 | —H | $-CONH(CH_2)_4NHSO_2CH(CH_3)C_4H_9$ | $-OCH_3$ | —H |
| XI-42 | —H | —H | $-CONH-C_6H_4-SO_2NHC_{12}H_{25}$ | —H |
| XI-43 | —H | —H | $-COOCH(C_4H_9)COOC_{12}H_{25}$ | —H |
| XI-44 | —H | —H | $-NHCO(CH_2)_3CON(CH_2C_6H_5)-C_6H_{13}$ | —H |
| XI-45 | —H | —H | $-CONHCH(C_2H_5)CH_2SO_2-C_6H_3(OCH_3)-C_8H_{17}(t)$ | —H |
| XI-46 | —H | —H | $-CONHCH(C_2H_5)COOC_{12}H_{25}$ | —H |

-continued

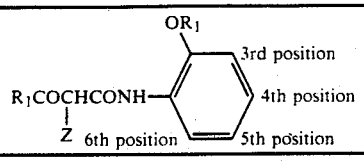

| | | | | |
|---|---|---|---|---|
| XI-47 | —H | —H | 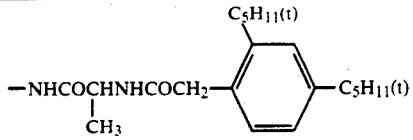 | —H |
| XI-48 | —H | —H | —NHCO(CH2)10COOC2H5 | —H |
| XI-49 | —H | —H | 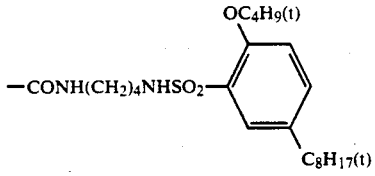 | —H |
| XI-50 | —H | —H | 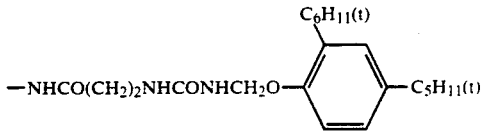 | —H |
| XI-51 | —H | —H | —NHCOCHCH2SO2C12H25 (CH3) | —H |
| XI-52 | —H | —H | 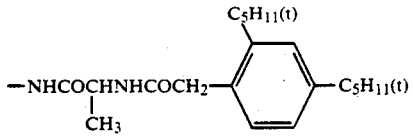 | —H |
| XI-53 | —H | —H | —SO2NHCOC2H5 | —H |

The yellow couplers of the invention can be synthesized in any conventionally known methods. The typical synthesizing examples thereof are described in, for example, Japanese Patent O.P.I. Publication No. 63-123047/1988.

The couplers of the invention may be used in an amount within the range of, normally, $1\times10^{-3}\sim1$ mol and, preferably, $1\times10^{-3}\sim8\times10^{-1}$ mols, each per mol of silver halide used. They may be used with any other couplers than the couplers of the invention.

The cyan dye-forming couplers preferably applicable to the invention are represented by Formula XXXI given below:

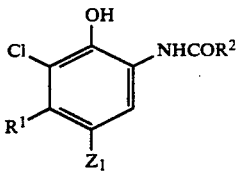

Formula XXXI wherein $R^1$ represents an alkyl group having 2 to 6 carbon atoms; $R^2$ represents a ballast group; and $Z_1$ represents a hydrogen atom, or an atom or a group capable of being split off upon reaction with the oxidized products of a color developing agent.

In the cyan couplers represented by Formula XXXI, the alkyl groups each having 2 to 6 carbon atoms, represented by $R^1$, may be straight-chained or branched and they include those having substituents. The groups represented by $R^1$ include preferably an ethyl group.

The ballast groups represented by $R^2$ are organic groups each having the sizes and shapes necessary to give the molecules of a coupler a sufficient volume so as not to substantially diffuse the coupler from the layer containing the coupler into any other layers.

The preferable ballast groups are represented by the following formula:

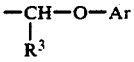

wherein $R^3$ represents an alkyl group having 1 to 12 carbon atoms; and Ar represents an aryl group such as a phenyl group, and such aryl groups include those having substituents.

In Formula XXXI, the atoms or groups capable of being split off upon reaction with the oxidized products of a color developing agent, which are represented by $Z_1$, include, for example, a halogen atom, an alkoxy group, an aryloxy group, an acyloxy group, a sulfonyloxy group, an acylamino group, a sulfonylamino group, an alkoxycarbonyloxy group, an aryloxycarbonyloxy group, an amido group, and those having substituents. Among them, the preferable are a halogen atom, an aryloxy group and an alkoxy group.

Next, the typical examples of the couplers represented by Formula XXXI will be given below. It is, however, to be understood that the invention shall not be limited thereto.

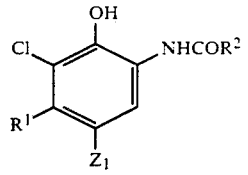

| Coupler No. | $R^1$ | $Z_1$ | $R^2$ |
|---|---|---|---|
| XXXI-1 | $-C_2H_5$ | $-Cl$ | 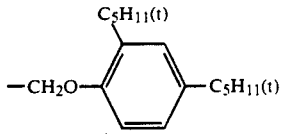 |
| XXXI-2 | $-C_2H_5$ | 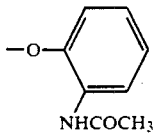 | 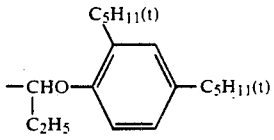 |
| XXXI-3 | $-C_3H_7(i)$ | $-Cl$ | 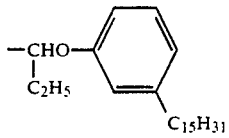 |
| XXXI-4 | $-C_2H_5$ | $-Cl$ | 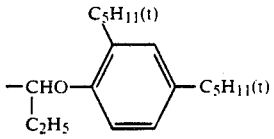 |
| XXXI-5 | $-C_4H_9$ | $-F$ | 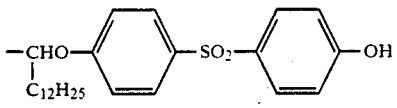 |
| XXXI-6 | $-C_2H_5$ | $-F$ | 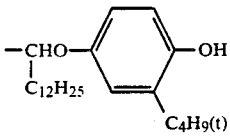 |
| XXXI-7 | $-C_2H_5$ | $-Cl$ | 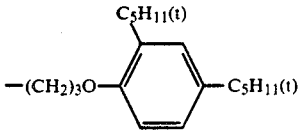 |
| XXXI-8 | $-C_2H_5$ | $-Cl$ | 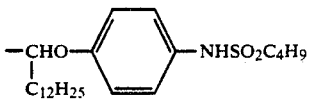 |
| XXXI-9 | $-C_2H_5$ | $-Cl$ | 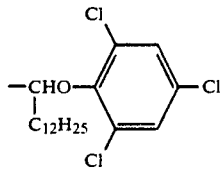 |

-continued
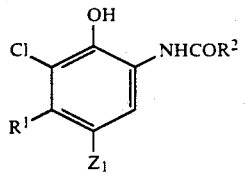
| Coupler No. | $R^1$ | $Z_1$ | $R^2$ |
|---|---|---|---|
| XXXI-10 | $-C_3H_7(i)$ | $-Cl$ | $-C_{18}H_{37}$ |
| XXXI-11 | $-C_6H_{13}$ | $-Cl$ | 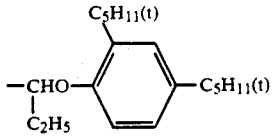 |
| XXXI-12 | $-C_3H_7$ | $-Cl$ | 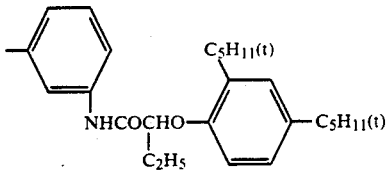 |
| XXXI-13 | $-(CH_2)_2NHCOCH_3$ | $-Cl$ | 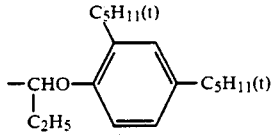 |
| XXXI-14 | $-(CH_2)_2OCH_3$ | $-Cl$ | 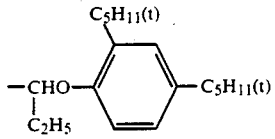 |
| XXXI-15 | $-C_2H_5$ | $-Cl$ | 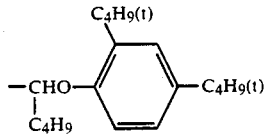 |
| XXXI-16 | $-C_4H_9(t)$ | $-O(CH_2)_2-SO_2CH_3$ | 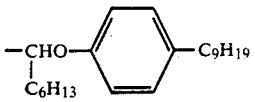 |
| XXXI-17 | $-C_2H_5$ | $-Cl$ | 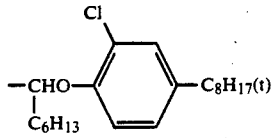 |
| XXXI-18 | $-C_2H_5$ | $-Cl$ | 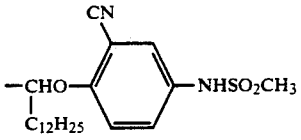 |
| XXXI-19 | $-C_2H_5$ | $-Cl$ | 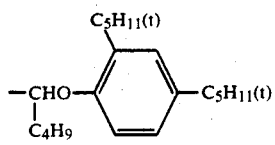 |

-continued

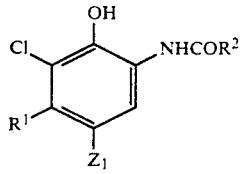

| Coupler No. | $R^1$ | $Z_1$ | $R^2$ |
|---|---|---|---|
| XXXI-20 | $-C_2H_5$ | $-Cl$ | $-C_{15}H_{31}$ |

The typical examples of the cyan couplers applicable to the invention, including those given above, are detailed in, for example, Japanese Patent Examined Publication No. 49-11572/1974, and Japanese Patent O.P.I. Publication Nos. 61-3142/1986, 61-9652/1986, 61-9653/1986, 61-39045/1986, 61-50136/1986, 61-99141/1986 and 61-105545/1986.

The cyan couplers of the invention represented by the foregoing Formula XXXI may be used in an amount within the range of, normally, $1\times10^{-3}$ mols to 1 mol and, preferably, $1\times10^{-2}$ mols to $8\times10^{-1}$ mols, each per mol of silver halide used.

The cyan couplers of the invention may be used with any other cyan couplers than those of the invention in combination. When making such a combination use, a 2,5-diacylaminophenol type coupler represented by the following formula XXXIII should particularly be preferred.

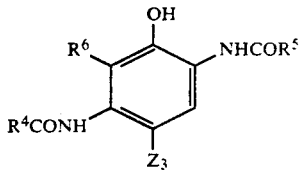

Formula XXXIII wherein $R^4$ represents an alkyl or aryl group; $R^5$ represents an alkyl, cycloalkyl, aryl or heterocyclic group; $R^6$ represents a hydrogen atom, a halogen atom, an alkyl group or an alkoxy group; provided, $R^6$ and $R^4$ may form a ring in association with each other; and $Z_3$ represents a hydrogen atom or a group capable of being split off upon reaction with the oxidized products of an aromatic primary amine type color developing agent.

In the invention, it is preferable to make a combination use of the foregoing cyan coupler and the magenta coupler represented by Formula XXXII given below:

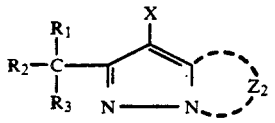

Formula XXXII wherein $R_1$, $R_2$ and $R_3$ represent each substituents other than hydrogen atom, and they may be the same with or the different from each other; $Z_2$ represents the group consisting of non-metal atoms necessary to form a heterocyclic ring; provided, the heterocyclic ring may have a substituent; and X represents a hydrogen atom or a group capable of being split off upon reaction with the oxidized products of a color developing agent.

The magenta couplers represented by Formula XXXII may further be represented by Formulas XXXIIa through XXXIIf each given below:

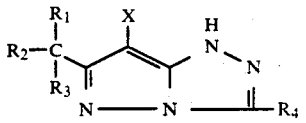

Formula XXXIIa

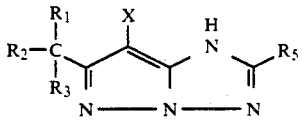

Formula XXXIIb

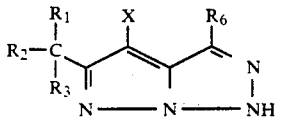

Formula XXXIIc

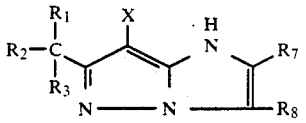

Formula XXXIId

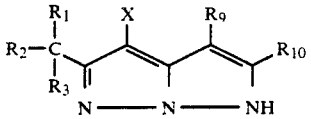

Formula XXXIIe

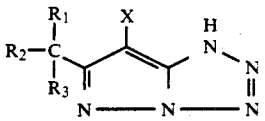

Formula XXXIIf

In the above formulas, $R_1$, $R_2$, $R_3$ and X are each synonymous with $R_1$, $R_2$, $R_3$ and X each denoted in the foregoing Formula XXXII; and $R_4$, $R_5$, $R_6$, $R_7$, $R_8$, $R_9$ and $R_{10}$ represent each a substituent.

Among the magenta couplers represented by the above formulas, the preferable are the compounds represented by Formulas XXXIIa and XXXIIb and, among them, the more preferable are the compounds represented by Formula XXXIIa.

The substituents given by Formulas XXXII and XXXIIa through XXXIIf will be detailed below.

$R_1\sim R_3$ may be the same with or the different from each other, and each of them represents any one of the following atoms and the groups; namely, a hydrogen atom; halogen atoms such as a chlorine atom, a bromine atom and a fluorine atom; alkyl groups including those straight-chained or branched and substitutable alkyl groups each having $1\sim32$ carbon atoms, such as a methyl group, a propyl group, a t-butyl group, a hexadecyl group, a 3-(3-pentadecylphenoxy)propyl group, a 3-(2,4-di-t-amylphenoxy)propyl group, a 3-(2,4-di-t-amylphenoxy)ethyl group, a 3-(4-di-t-amylphenoxy)-propyl group, and a 2-[α-(3-t-butyl-4-hydroxyphenoxy) tetradecaneamidoethyl] group; cycloalkyl groups such as a cyclohexyl group; alkenyl groups such as a propenyl group; cycloalkenyl groups; alkinyl groups; aryl groups such as a phenyl group; α- or β-naphthyl groups; 4-methylphenyl groups; 2,4,6-trichlorophenyl groups; 4-[α-(3-t-butyl-4-hydroxyphenoxy) tetradecaneamido]-2,6-dichlorophenyl groups; heterocyclic groups such as a pyridyl group, thienyl group and a quinolyl group; acyl groups such as an acetyl group and a benzoyl group; sulfonyl groups; sulfinyl groups; phosphonyl groups such as a butyloctyl phosphonyl group; carbamoyl groups; sulfamoyl groups; cyano groups; spiro-compound residual groups such as a spiro(3,3)heptane-1-yl group; cross-linking hydrocarbon compound residual groups such as a bicyclo(2,2,1)heptane-1-yl group; alkoxy groups such as a methoxy group, an ethoxy group, a propoxy group, an isopropoxy group and an n-butyl group; aryloxy groups such as a phenoxy group; heterocyclic oxy groups such as a 1-phenyltetrazolyloxy group; siloxy groups such as a trimethylsiloxy group; acyloxy groups such as an acetyloxy group; carbamoyloxy groups; amino groups; acylamino groups such as an acetylamino group; benzamido groups; 3-(2,4-di-tamylphenoxy)butylamido groups; sulfonamido groups such as a methanesulfonamido group; imido groups such as a succinimido group; ureido groups; sulfamoylamino groups; alkoxycarbonylamino groups such as a methoxycarbonylamino group and tetradecyloxycarbonylamino groups; aryloxycarbonylamino groups such as a phenoxycarbonylamino group; alkoxycarbonyl groups such as a methoxycarbonyl group; aryloxycarbonyl groups such as a phenoxycarbonyl group; alkylthio groups such as a hexylthio group and a dodecylthio group; arylthio groups such as a phenylthio group; or heterocyclic thio groups such as a 3-pyridylthio group.

$R_4$ through $R_{10}$ represent each a hydrogen atom; alkyl groups, that is, straight-chained or branched substitutable alkyl groups each having 1 to 32 carbon atoms, including typically the same groups as given for the foregoing $R_1$ through $R_3$; aryl groups such as those given for $R_1$ through $R_3$; heterocyclic groups such as those given for $R_1$ through $R_3$; acylamino groups such as an acetylamino group; a benzamido group; a 3-(2,4-di-t-amylphenoxy)butylamido group; a 3-(3pentadecylphenoxy)butylamido group; alkylamino groups such as a methylamino group, a diethylamino group and a dodecylamino group; anilino groups such as a phenylamino group, a 2-chloro -5-tetradecaneamidophenylamino group and a 4-[α-(3-t-butyl-4hydroxyphenoxy)tetradecaneamido]anilino group; alkoxycarbonyl groups such as a methoxycarbonyl group and a tetradecyloxycarbonyl group; alkylthio groups such as a hexylthio group and a dodecylthio group.

The typical examples of the preferable magenta couplers will be given below.

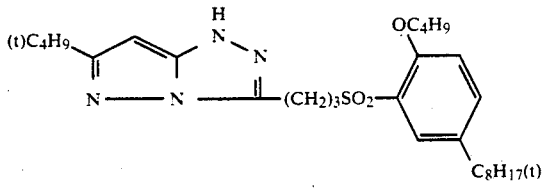

I-21

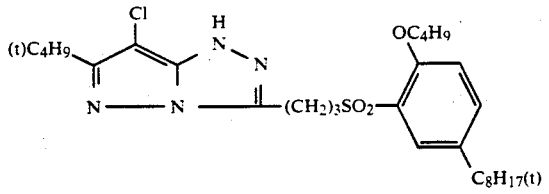

I-22

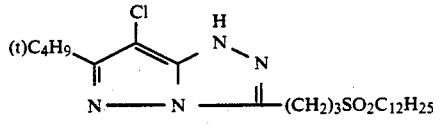

I-23

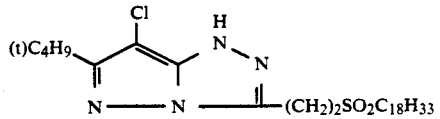

I-24

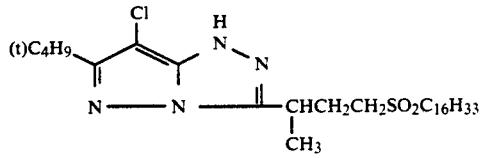

I-25

-continued
I-26
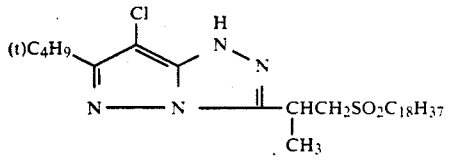
I-27
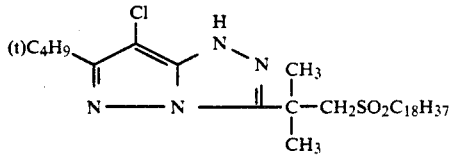
I-28
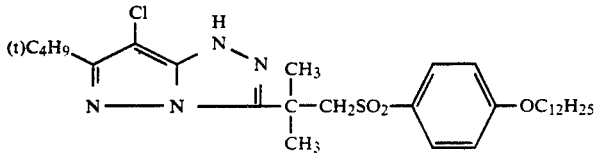
I-29
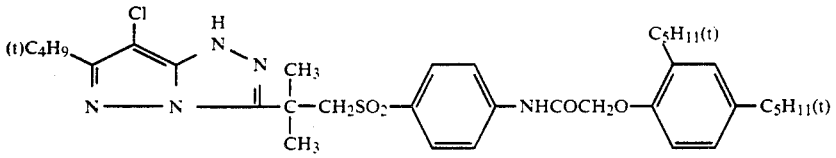
I-32
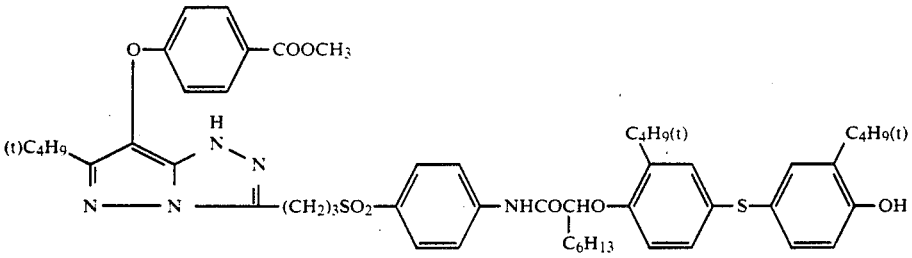
I-63
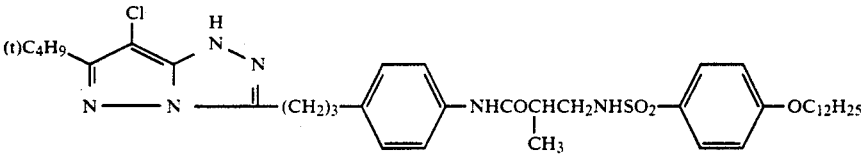
I-64
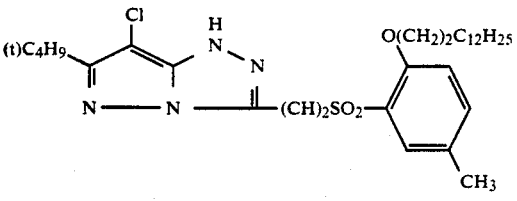
I-65
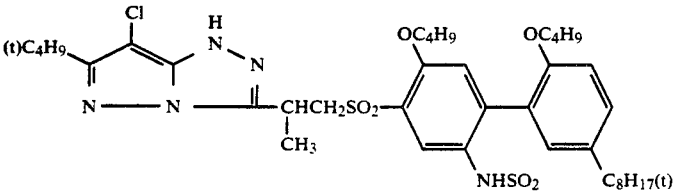

-continued
I-66
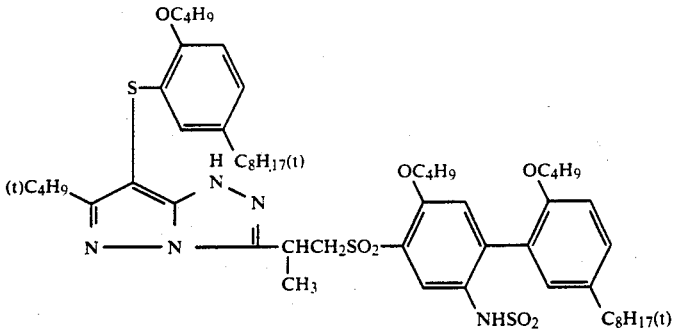
I-43
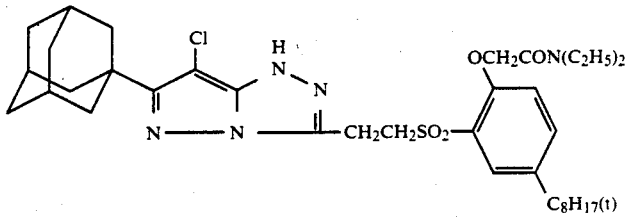
I-59
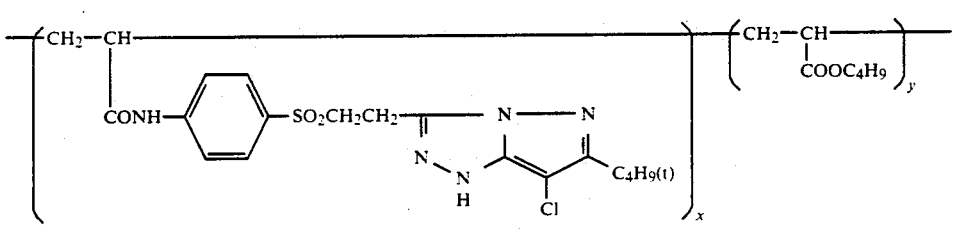
x:y = 50:50
I-67
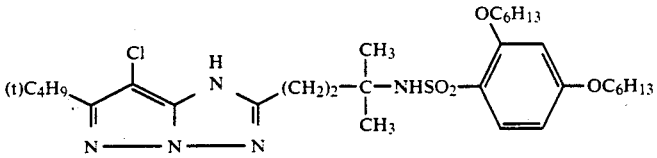
I-68
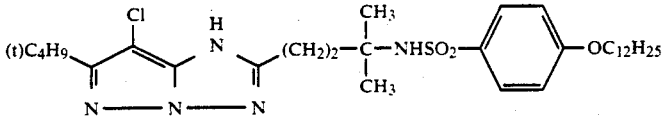
I-54
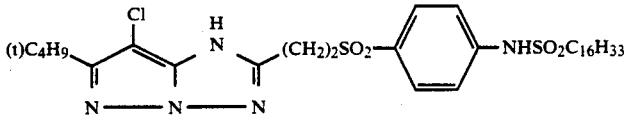
I-69
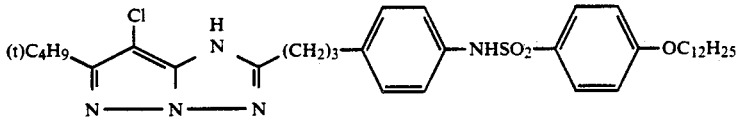
I-70
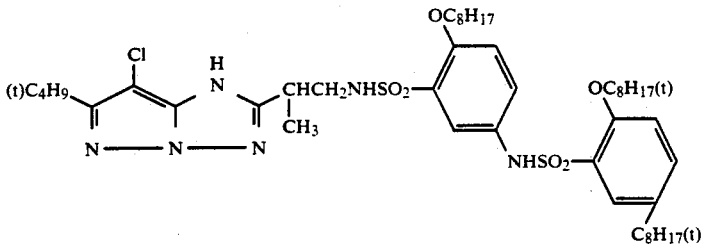

-continued

I-71

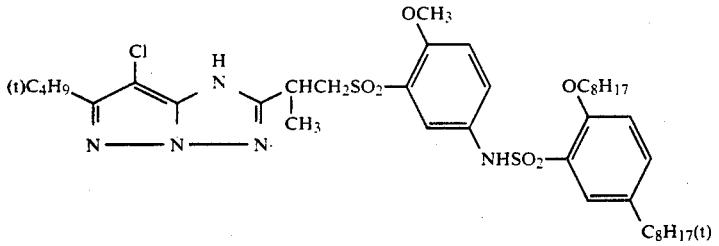

I-72

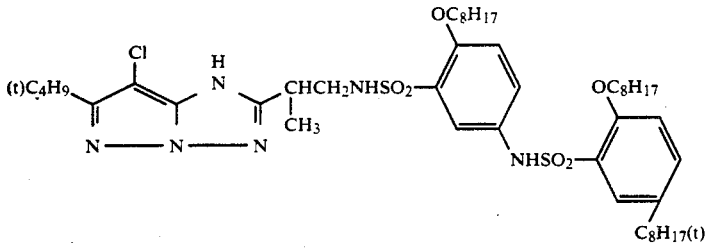

I-73

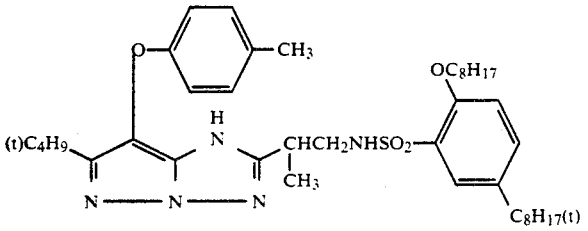

I-74

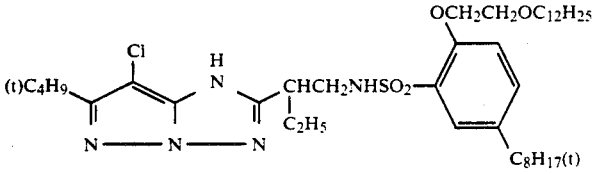

I-75

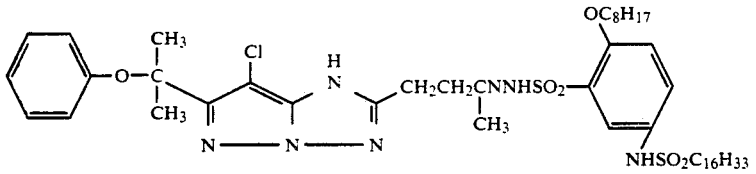

The above-given couplers can be synthesized with reference to Journal of the Chemical Society, Perkin I, 1977, pp. 2047-2052, U.S. Pat. No. 3,725,067, and Japanese Patent O.P.I. Publication Nos.59-99437/1984, 58-42045/1983, 59-162548/1984, 59-171956/1984, 60-33552/1985, 60-43659/1085, 60-172982/1985 and 60-190779/1985.

In the case of making the combination use of the cyan coupler and magenta coupler, the amount of gelatin to be contained in a red light-sensitive silver halide emulsion layer of the invention is, preferably, less than 1.4 g and, more preferably, within the range of 1.0 to 1.3 g per sq. meter of the light-sensitive material used.

The amount of gelatin to be contained in a green light-sensitive silver halide emulsion layer of the invention is, preferably, not more than 1.4 g and, more preferably, within the range of 1.1 to 1.4 g per sq. meter of the light-sensitive material used.

The dye-forming couplers applicable to the invention are allowed to contain a compound capable of discharging photographically useful fragments upon coupling reaction with the oxidized products of a developing agent, such as a development accelerator, a bleach accelerator, a developing agent, a silver halide solvent, a toner, a hardener, a foggant, an antifoggant, a chemical sensitizier, a spectral sensitizer and a desensitizer. The above-mentioned dye-forming couplers may be used with a colored coupler and/or a DIR coupler in combination, and such a DIR coupler may be replaced by a DIR compound to be used therein.

The DIR couplers and DIR compounds applicable thereto include those containing an inhibitor directly coupled to the coupling position, a timing DIR coupler, and a timing DIR compound. As for the inhibitors, those having splitting-off and diffusion properties and those having not so much diffusion property may be used, independently or in combination, to meet the applications. Further, a colorless coupler may also be used with the dye-forming couplers in combination.

In the invention, it is preferable to contain a hydroquinone type compound into a coupler-containing emulsion layer relating to the invention and/or into the adjacent layers thereto. The hydroquinone type compound may be added in any amount thereinto, however, it is added in an amount within the range of, preferably, $1\times10^{-6}$ to $1\times10^{-2}$ mols/m$^2$ and, more preferably, $5\times10^{-6}$ to $5\times10^{-3}$ mols/m$^2$.

To the silver halide photographic light-sensitive materials containing the silver halide emulsions of the invention, a variety of photographic additives besides the above-given compounds may also be added.

Such additives include, for example, a UV absorbent, a development accelerator, a surfactant, a water-soluble antiirradiation dye, a physical surface property improver, a color-contamination inhibitor, a dye-image stabilizer, a water-soluble or oil-soluble fluorescent whitening agent, and a background-color controller.

Among the dye-forming couplers, colored couplers, DIR couplers, DIR compounds, image stabilizers, anti-color-foggants, UV absorbents and fluorescent whitening agents, each of which is other than the cyan couplers relating to the invention and is not necessary to adsorb to the surfaces of silver halide crystals, the hydrophobic compounds may be treated in a variety of dispersing methods such as a solid-dispersing method, a latex-dispersing method, and an oil drops-in-water type emulsifying-dispersing method. The above-given methods may suitably be selected to meet the chemical structures of such hydrophobic compounds such as the above-mentioned couplers. Various types of the oil drops-in-water type emulsifying-dispersing methods may be used for dispersing the hydrophobic compounds such as the couplers, wherein, a hydrophobic compound is normally dissolved in a high boiling organic solvent having a boiling point of about 150° C. and, if required, in making a combination use of a low boiling organic solvent and/or a water-soluble organic solvents; the resulting solution is so dispersed as to be emulsified with a surfactant in a hydrophilic binder such as a gelatin solution by making use of a dispersing means such as a stirrer, a homogenizer, a colloid mill, a flow-jet mixer or a supersonic apparatus; and, after the dispersion-emulsification is completed, the resulting emulsion is added into an objective hydrophilic colloidal layer. It is permitted that the above-mentioned process may supplement with a processing step of removing the low boiling organic solvent after or at the same time of the dispersion.

In the invention, the color developing agents applicable to color developers include those having been well-known and widely used in various photographic processes. These developing magnets include, typically, an aminophenol type derivative and a p-phenylenediamine type derivative. These compounds are generally used in the form of salts such as a hydrochloride or a sulfate. These compounds are used in a concentration within the range of, normally, about 0.1 g to about 30 g and, preferably, about 1 g to about 15 g, each per liter of a color developer used.

The aminophenol type developing agents include, for example, o-aminophenol, p-aminophenol, 5-amino-2-hydroxytoluene, 2-amino-3-hydroxytoluene and 2-hydroxy-3-amino-1,4-dimethylbenzene.

The particularly useful primary aromatic amine type color developing agents include, for example, an N,N-dialkyl-p -phenylenediamine type compound, and the alkyl and phenyl groups thereof may be substituted with any substituent. The particularly useful compounds among them include, for example, an N,N-diethyl-p-phenylenediamine hydrochloride, an N-methyl -p-phenylenediamine hydrochloride, an N,N-dimethyl-p-phenylenediamine hydrochloride, a 2-amino-5-(N-ethyl-N-dodecylamino)toluene, an N-ethyl-N-$\beta$-methanesulfonamidoethyl-3-methyl-4-aminoaniline sulfate, an N-ethyl-N-$\beta$-hydroxyethylaminoaniline, a 4-amino-3-methyl-N,N-diethylaniline, and a 4-amino-N-(2-methoxyethyl)-N-ethyl-3-methylaniline-p-toluene sulfonate.

The color developers applicable to process the silver halide photographic light-sensitive materials of the invention may be added with the compounds having been known as the components of the conventional developers, as well as the above-mentioned primary aromatic amine type color developing agents. For example, it is also allowed to add any one of alkalizers such as sodium hydroxide, sodium carbonate and potassium carbonate, an alkali metal thiocyanate, an alkali metal bisulfite, an alkali metal thiocyanate, an alkali metal halide, benzyl alcohol, a water softener and a thickener.

The photographic light-sensitive materials of the invention are preferably processed with a color developer either not containing any water-soluble bromide at all or containing a very few water-soluble bromides. When containing an excess water-soluble bromides, there may be some instances where the developing speed of a photographic light sensitive material may rapidly be lowered. In a color developer, the bromide ion concentration in terms of potassium bromide is about not more than 0.1 g and, preferably, not more than 0.05 g, each per liter of the color developer used.

When using a water-soluble chloride as a development controller in the above-mentioned color developer, the effects of the invention can particularly become remarkable. The water-soluble chlorides may be used in an amount within the range of 0.5 to 5 g and, preferably, 1 g to 3 g, in terms of the potassium chloride content, each per liter of the color developer used.

The pH values of the color developers are, normally, not less than 7 and, most generally, within the range of about 10 to about 13.

The color developing temperatures are, normally, not lower than 15° C. and, generally, within the range of 20° C. to 50° C. For a rapid processing, it is preferable to carry out the process at a temperature of not lower than 30° C. The color development is preferably be carried out for a period of time within the range of 20 seconds to 60 seconds and, more preferably, 30 seconds to 50 seconds.

The silver halide photographic light-sensitive materials relating to the invention can also be processed in an alkaline activation bath, when the hydrophilic colloidal layers thereof contain the above-mentioned color developing agents capable of functioning either as their own or as the precursors thereof. The color developing agent precursors are the compounds capable of producing color developing agents under the alkaline conditions. They include, for example, a Schiff's base type precursor produced with an aromatic aldehyde derivative, a polyvalent metal ion complex precursor, a phthalimide derivative precursor, a phosphoric acid amide derivative precursor, a sugar-amine reactant precursor, and a urethane precursor. These precursors of the aromatic primary amine color developing agents are detailed in, for example, U.S. Pat. Nos. 3,342,599, 2,507,114, 2,695,234 and 3,719,492; British Patent No. 803,783; Japanese Patent O.P.I Publication Nos. 53-185628/1978 and 54-79035/1979; and Research Disclosure, Nos. 15159, 12146 and 13924. The above-mentioned aromatic primary amine color developing agents or the precursors thereof should be added in an amount so sufficient as to develop a satisfactory color when an activation process is carried out. The amounts thereof to be added are considerably varied according to the kinds of light-sensitive materials to be processed. However, they are added in an amount within the range of, generally, 0.1 mols to 5 mols and, preferably, 0.5 mols to 3 mols, each per mol of silver halides used. The color developing agents or the precursors thereof may be used independently or in combination. In order to incorporate them into a light-sensitive material, they may be added thereinto after dissolving them in a suitable solvent such as water, methanol, ethanol or acetone. The may also be added thereinto in the form of an emulsified dispersion thereof prepared with a high boiling organic solvent such as dibutyl phthalate, dioctyl phthalate or tricresyl phosphate. Further, they may be added thereinto after impregnating them into a latex polymer, as described in Research Disclosure, No. 14850.

After the silver halide photographic light-sensitive materials of the invention are color developed, they are processed in a bleaching step and a fixing step, successively. The bleaching and fixing steps may be carried out at the same time. As for the bleachers, a variety of compounds may be used. Among them, polyvalent metal compounds such as those of iron (III), cobalt (III) and copper (II) and, particularly, the complex salts of these polyvalent metal cations and organic acids may suitably be used independently or in combination, They include, for example, aminopolycarboxylic acids such as ethylenediaminetetraacetic acid, nitrilotriacetic acid and N-hydroxyethyl ethylenediaminediacetic acid, metal complex salts of malonic acid, tartaric acid, malic acid, diglycolic acid and dithioglycolic acid, or ferricyanic acid salts and dichromates, which may be used independently or in combination.

As for the fixers, soluble complexing agents for making a silver halide soluble to be a complex salt may be used. They include, for example, sodium thiosulfate, ammonium thiosulfate, potassium thiocyanate, thiourea and thioether.

After completing a fixing step, a washing step is usually carried out.

The washing step may be replaced by a stabilizing step, or these two steps may be carried out in combination. The stabilizers used in the stabilizing step may contain a pH buffer, a chelating agent and an antimold. The typical requirements for them may be referred to Japanese Patent O.P.I. Publication No. 58-134636/1983.

EXAMPLES

The invention will be detailed with reference to the following examples. It is, however, to be understood that the embodiments of the invention shall not be limited thereto.

Example 1

A solution was prepared by adding 60 g of magenta coupler M-1, 40 g of dye-image stabilizer ST-3, 15 g of ST-4 and 1.7 g of antistaining agent HQ-1 into a mixture of 40 ml of high boiling organic solvent DBP and 100 ml of ethyl acetate. The resulting solution was added into an aqueous 5% gelatin solution containing 5 g of sodium dodecylbenzenesulfonate, and the mixture was dispersed by a supersonic homogenizer. The resulting dispersion was finished to make 1500 ml. The dispersion was added into 1000 ml of an aqueous 3% gelatin solution for coating use and, further, 400 g of a green-sensitive silver chlorobromide emulsion was added thereinto, so that a green-sensitive emulsion layer coating solution was prepared and was then coated on a polyethylene-laminated paper support in order from the support so that the layer arrangements could be as shown in Table-1.

TABLE 1

| Layer | Composition | Amount added g/m$^2$ |
|---|---|---|
| Layer 7 Protective layer | Gelatin | 1.0 |
| Layer 6 UV absorbing layer | Gelatin | 0.6 |
| | UV absorbent UV-1 | 0.2 |
| | UV absorbent UV-2 | 0.2 |
| | Antistaining agent HQ-1 | 0.01 |
| | DBP | 0.2 |
| | PVP | 0.03 |
| | Antiirradiation dye AI-2 | 0.02 |
| Layer 5 Red-sensitive layer | Gelatin | 1.40 |
| | Red-sensitive silver chlorobromide emulsion, in terms of silver content | 0.24 |
| | Cyan coupler C-1 | 0.17 |
| | Cyan coupler C-2 | 0.25 |
| | Dye-image stabilizer ST-1 | 0.2 |
| | High boiling organic solvent HB-1 | 0.10 |
| | Antistaining agent HQ-1 | 0.01 |
| | DBP | 0.30 |
| Layer 4 UV absorbing layer | Gelatin | 1.30 |
| | UV absorbent UV-1 | 0.40 |
| | UV absorbent UV-2 | 0.40 |
| | Antistaining agent HQ-1 | 0.03 |
| | DBP | 0.40 |
| Layer 3 Green-sensitive layer | Gelatin | 1.40 |
| | Green-sensitive silver chlorobromide emulsion, in terms of silver content | 0.27 |
| | Magenta coupler M-1 | 0.35 |
| | Dye-image stabilizer ST-3 | 0.23 |
| | Dye-image stabilizer ST-4 | 0.09 |
| | Antistaining agent HQ-1 | 0.01 |
| | DBP | 0.30 |
| | Antiirradiation dye AI-1 | 0.01 |
| Layer 2 Interlayer | Gelatin | 1.20 |
| | Antistaining agent HQ-1 | 0.12 |
| | DBP | 0.15 |
| Layer 1 Blue-sensitive layer | Gelatin | 1.30 |
| | Blue-sensitive silver chlorobromide emulsion, in terms of silver content | 0.30 |
| | Yellow coupler Y-1 | 0.80 |
| | Dye-image stabilizer ST-1 | 0.30 |
| | Dye-image stabilizer ST-2 | 0.20 |
| | Antistaining agent HQ-1 | 0.02 |
| | DBP | 0.20 |
| Support | Polyethylene-laminated paper | |

Y-1

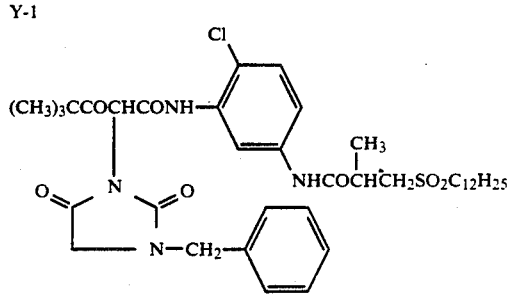

M-1

TABLE 1-continued

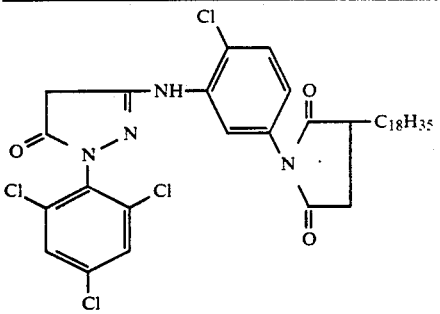

C-1

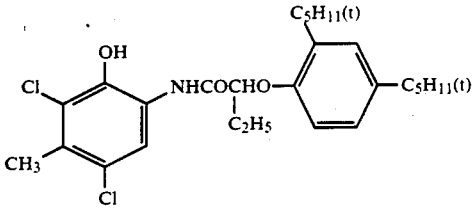

C-2

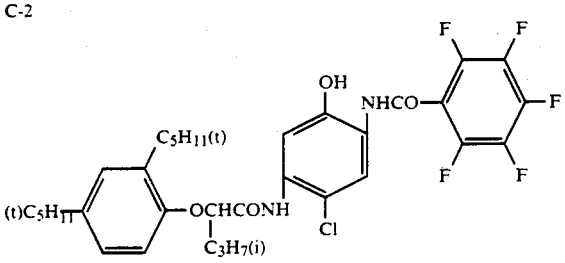

ST-1

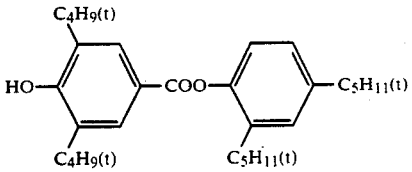

ST-2

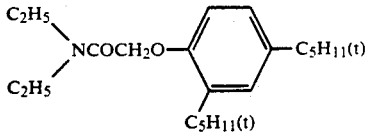

PVP, polyvinyl pyrrolidone
DBP, dibutyl phthalate

UV-1

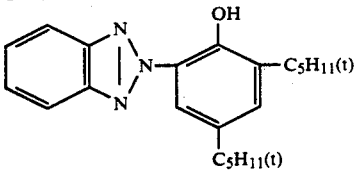

UV-2

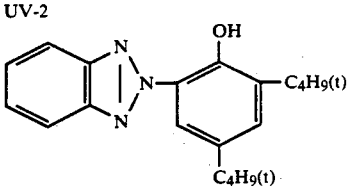

TABLE 1-continued

HQ-1

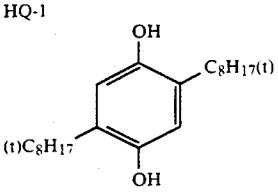

ST-3

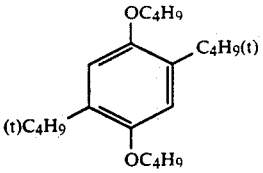

ST-4

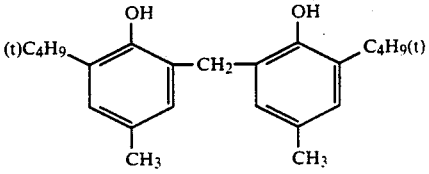

AI-1

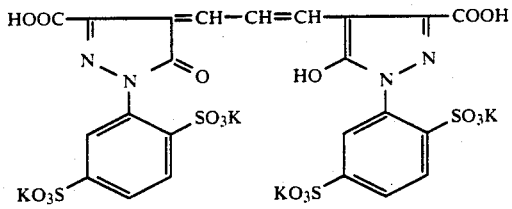

AI-2

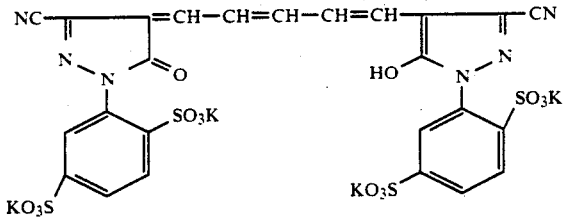

HB-1

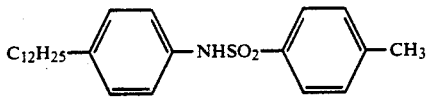

The following H-1 was also used as a hardener.

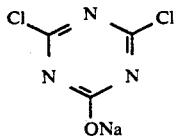

H-1

The resulting coated sample was named Sample 1. Then, Samples 2 through 13 were prepared in the same manner as in Sample 1, except that magenta coupler M-1 of Layer 3, the UV absorbents of Layers 4 and 6, the whole amount of gelatin added, and the combinations of the silver halide emulsions and the processing steps of Sample 1 were each changed as shown in Table 2.

The Samples 1 through 13 were each exposed to light and were then processed in the following processing steps:

| Processing Step A | Temperature | Time |
|---|---|---|
| Color developing | 32.8° C. | 3 min. 30 sec. |
| Bleach-fixing | 32.8° C. | 1 min. 30 sec. |
| Washing | 32.8° C. | 3 min. 30 sec. |

| Color developer | |
|---|---|
| N-ethyl-N-β-methanesulfonamidoethyl-3-methyl-4-aminoaniline sulfate | 4.0 g |
| Hydroxylamine sulfate | 2.0 g |
| Potassium carbonate | 25.0 g |
| Sodium chloride | 0.1 g |
| Sodium bromide | 0.2 g |
| Sodium sulfite anhydride | 2.0 g |
| Benzyl alcohol | 10.0 ml |
| Polyethylene glycol, with an average polymerization degree: 400 | 3.0 ml |
| Add water to make in total of | 1 liter |
| Adjust pH with sodium hydroxide to be | pH 10.0 |
| **Bleach-fixer** | |
| Iron(III) sodium ethylenediaminetetraacetate | 60.0 g |
| Sodium thiosulfate | 100.0 g |
| Sodium bisulfite | 20.0 g |
| Sodium metabisulfite | 5.0 g |
| Add water to make | 1 liter |
| Adjust pH to be | pH 7.0 |

| Processing step B | Temperature | Time |
|---|---|---|
| Color developing | 35.0 ± 0.3° C. | 45 sec. |
| Bleach-fixing | 35.0 ± 0.5° C. | 45 sec. |
| Stabilizing | 30 to 34° C. | 90 sec. |
| Drying | 60 to 80° C. | 60 sec. |

| Color developer | |
|---|---|
| Pure water | 800 ml |
| Triethanolamine | 10 g |
| N,N-diethylhydroxylamine | 5 g |
| Potassium bromide | 0.02 g |
| Potassium chloride | 2 g |
| Potassium sulfite | 0.3 g |
| 1-hydroxyethylidene-1,1-diphosphoric acid | 1.0 g |
| Ethylenediaminetetraacetic acid | 1.0 g |
| Disodium catechol-3,5-disulfonate | 1.0 g |
| N-ethyl-N-β-methanesulfonamidoethyl-3-methyl-4-aminoaniline sulfate | 4.5 g |
| Fluorescent whitening agent, 4,4'-diaminostilbenedisulfonic acid derivative | 1.0 g |
| Potassium carbonate | 27 g |
| Add water to make in total of | 1 liter |
| Adjust pH to be | pH = 10.10 |
| **Bleach-fixer** | |
| Ferric ammonium ethylenediamine-tetraacetate, dihydrate | 60 g |
| Ethylenediaminetetraacetic acid | 3 g |
| Ammonium thiosulfate, in an aqueous 70% solution | 100 ml |
| Ammonium sulfite, in an aqueous 40% solution | 27.5 ml |
| Add water to make in total of | 1 liter |
| Adjust pH with potassium carbonate or glacial acetic acid to be | pH = 5.7 |
| **Stabilizer** | |
| 5-chloro-2-methyl-4-isothiazoline-3-one | 1.0 g |
| Ethylene glycol | 1.0 g |
| 1-hydroxyethylidene-1,1-diphosphoric acid | 2.0 g |
| Ethylenediaminetetraacetic acid | 1.0 g |
| Ammonium hydroxide, in an aqueous 20% solution | 3.0 g |
| Ammonium sulfite | 3.0 g |
| Fluorescent whitening agent, 4,4'-diaminostilbenedisulfonic acid derivative | 1.5 g |
| Add water to make in total of | 1 liter |
| Adjust pH with sulfuric acid or potassium hydroxide to be | pH = 7.0 |

After the samples were processed, the following evaluations were carried out. The results thereof are shown in Table-2.

Sweating phenomena

After the processed samples were stored for four weeks under the conditions of 80° C. and 60% RH, the amounts of oily matters produced on the surfaces of the samples were taken and measured. The visual judgements were also tried.

○ . . . No sweat was found at all.

Δ . . . Slight sweats were found.

X . . . Serious sweats found and the surfaces were found to be sticky.

White background

After the samples were processed, they were stored for one week under the conditions of 80° C. and 60% RH, the difference of the blue color densities, ΔDa, was measured between the unexposed portions thereof before and after the storage.

Pressure resistance

Before exposing the samples to light, the emulsion surfaces of the samples were scratched by a Heidon scratch hardness tester, Model 18, manufactured by Shintoh Science Company, while applying the surfaces of the samples with the loads of 5, 10, 20, 30 and 50 g, respectively. After the samples were exposed to light and processed in the same manner as in the aforementioned manner, the sensitization and desensitization produced thereby were evaluated in terms of the following five grades:

◎ . . . Excellent, ○ . . . Good, Δ . . . Slightly produced, X . . . Produced, and X . . . Seriously produced

Tone

A color chart manufactured by Macbeth Company was photographed on a 'Konica Color GX-II 100' color negative film manufactured by Konica Corporation, and was then processed. Using the resulting negative film and adjusting the tones in the grey scale portions, each of the samples was exposed to light through the negative film and was then processed. The resulting prints were evaluated on the color reproducibilities of the hues produced thereon.

◎ . . . Both of the chroma and color reproduction fidelity were found to be high, ○ . . . The color reproduction fidelity was found to be high, and Δ . . . A chromatic aberration was found in hues.

TABLE 2

| Sample No. | Magenta coupler | UV absorbent | Total amount of gelatin added, g/m² | AgX. Br mol % | Processing step | White background | Sweat mg/cm² | Sweat Visual evaluation | Pressure resistance | Color reproduction Red | Color reproduction Purple | Color reproduction Blue |
|---|---|---|---|---|---|---|---|---|---|---|---|---|
| 1, Comp. | M-1 | UV-1/-2 | 8.2 | 80 | A | 0.42 | 0.05 | Δ | ○ | Δ | Δ | Δ |
| 2, Comp. | M-1 | UV-18L | 7.6 | 80 | A | 0.40 | 0.08 | X | Δ | Δ | Δ | Δ |
| 3, Comp. | 10, Exemp. | UV-1/-2 | 8.2 | 80 | A | 0.23 | 0.06 | X | Δ | Δ | ○ | ○ |
| 4, Comp. | 10, Exemp. | UV-18L | 8.2 | 80 | A | 0.22 | 0.05 | Δ | Δ | Δ | ○ | ○ |
| 5, Comp. | 10, Exemp. | UV-1/-2 | 7.6 | 80 | A | 0.22 | 0.07 | X | X | Δ | ○ | ○ |
| 6, Inv. | 10, Exemp. | UV-18L | 7.6 | 80 | A | 0.18 | 0.03 | ○ | ○ | ○ | ○ | ○ |
| 7, Inv. | 14, Exemp. | UV-18L | 7.6 | 80 | A | 0.19 | 0.03 | ○ | ○ | ○ | ○ | ○ |
| 8, Inv. | 23, Exemp. | UV-18L | 7.6 | 80 | A | 0.16 | 0.02 | ○ | ○ | ○ | ○ | ○ |
| 9, Inv. | 23, Exemp. | UV-6L | 7.6 | 80 | A | 0.16 | 0.02 | ○ | ○ | ○ | ○ | ○ |
| 10, Inv. | 23, Exemp. | UV-13L | 7.6 | 80 | A | 0.17 | 0.02 | ○ | ○ | ○ | ○ | ○ |
| 11, Comp. | 10, Exemp. | UV-1/-2 | 8.2 | 0.5 | B | 0.24 | 0.06 | X | XX | Δ | ○ | ○ |
| 12, Inv. | 10, Exemp. | UV-18L | 7.6 | 0.5 | B | 0.17 | 0.02 | ○ | ○ | ○ | ○ | ○ |
| 13, Inv. | 23, Exemp. | UV-18L | 7.6 | 0.5 | B | 0.16 | 0.01 | ○ | ○ | ○ | ○ | ○ |

Comp.: Comparative
Inv.: Inventive
Exemp.: Exemplified

As can be understood from Table-2, in Samples 1 and 2 applied with the comparative couplers thereinto, the tones thereof were deteriorated and any improvement of the white background thereof could not be found at all and, besides, there were also serious deteriorations in sweating phenomena.

On the other hand, in Sample 3 applied with the combination of the couplers of the invention and the conventional UV absorbents thereinto, the improvements of the tones thereof were found, however, the tones were found to be slightly contaminated through the visual observations, and the pressure resistance was seriously deteriorated. In the Samples 4 and 5, an improvement could hardly be found out. However, in Sample 6 of the invention, there were not any deteriorations in sweating phenomena, but the improvement effects on the white background and pressure resistance and, in addition, there were the remarkable effects on the color reproducibility. The above-mentioned effects could not ever foresee at all from the conventional knowledge.

From the coupler, Exemplified Compound 23 used in Sample 8, the more excellent results were obtained.

In addition to the above, in Samples 11 through 13 each using a high silver chloride-containing emulsion in the above-mentioned system, they were proved to be useful, because the effects of the invention could further be emphasized.

Example 2

When the magenta coupler, Exemplified Compound 10, of Samples 6 and 12 in Example 1 was replaced by Exemplified-compounds 9, 22, 24, 26, 41, 46 and 50, respectively, the same effects of the invention could also be obtained.

When the UV absorbents were replaced by UV-8L, Uv-11L, UV-15L, a mixture of UV-18L/UV-1 in a proportion of 1:1, and another mixture of UV-18L/UV-2 in a proportion of 1:1, the same effects of the invention could also be obtained, respectively.

Example 3

Sample 14 was prepared in the same manner as in Example except that, in Layer 4 of Sample 13 prepared in Example 1, the amount of the antistaining agent added therein was replaced by 0.11 g/m². The resulting Sample 14 was processed and evaluated in the same manner as in Example 1. The results thereof are shown in Table-3.

TABLE 3

| Sample No. | White background | Sweat mg/cm² | Sweat Visual test | Pressure resistance | Color reproduction Red | Color reproduction Purple | Color reproduction Blue |
|---|---|---|---|---|---|---|---|
| 11 comp. | 0.24 | 0.06 | X | XX | Δ | ○ | ○ |
| 13 Inv. | 0.16 | 0.01 | ○ | ○ | ○ | ○ | ○ |
| 14 Inv. | 0.15 | 0.01 | ○ | ⊙ | ⊙ | ○ | ○ |

As is obvious from Table-3, Sample 14 could display the effects of the invention more than others.

Sample 4

Onto a paper support laminated with polyethylene on one side thereof and titanium oxide-containing polyethylene on the other side thereof, each of the layers having the compositions shown in Table-4 was coated respectively, thereby preparing a multilayered silver halide color photographic light-sensitive material. In the table, the amounts of the compositions added are shown in terms of g/m² and the amounts of the silver halide emulsions are shown in terms of the silver contents.

TABLE 4

| Layer | Composition | Amount added g/m² |
|---|---|---|
| Layer 7 | Gelatin | 1.00 |
| Protective layer | $SiO_2$ having an average particle-size of 3 μm | 0.003 |
| Layer 6 | Gelatin | See Table-5 |
| UV absorbing layer | UV absorbent, See Table-5 | See Table-5 |
| | Color mixing inhibitant HQ-2 | 0.001 |
| | High boiling solvent DNP | See Table-5 |
| | PVP | 0.03 |
| Layer 5 | Red-sensitive silver chlorobromide | 0.24 |

TABLE 4-continued

| Layer | Composition | Amount added g/m² |
|---|---|---|
| Red-sensitive layer | emulsion spectrally sensitized with sensitizing dye D-1, containing silver bromide of 80 mol % | |
| | Gelatin | 1.20 |
| | Cyan coupler C-2 | 0.40 |
| | Dye-image stabilizer ST-1 | 0.22 |
| | High boiling solvent DOP | 0.22 |
| Layer 4 UV absorbing layer | Gelatin | See Table-5 |
| | UV absorbent, See Table-5 | See Table-5 |
| | Color mixing inhibitant HQ-2 | 0.03 |
| | High boiling solvent DNP | See Table-5 |
| Layer 3 Green-sensitive layer | Green-sensitive silver chloro-bromide emulsion spectrally sensitized with sensitizing dye D-2, having a silver bromide content of 80 mol % | 0.20 |
| | Gelatin | 1.40 |
| | Magenta coupler M-2 | 0.38 |
| | Dye-image stabilizer ST-5 | 0.10 |
| | Dye-image stabilizer ST-6 | 0.10 |
| | Dye-image stabilizer ST-7 | 0.10 |

TABLE 4-continued

| Layer | Composition | Amount added g/m² |
|---|---|---|
| | High boiling solvent DOP | 0.25 |
| Layer 2 Interlayer | Gelatin | 1.20 |
| | Color mixing inhibitant HQ-3 | 0.04 |
| | High boiling solvent DIDP | 0.10 |
| Layer 1 Blue-sensitive layer | Blue-sensitive silver chloro-bromide emulsion spectrally sensitized with sensitizing dye D-3, having a silver bromide content of 80 mol % | 0.30 |
| | Gelatin | 1.20 |
| | Yellow coupler, See Table-5 | 0.80 |
| | Dye-image stabilizer ST-1 | 0.30 |
| | Dye-image stabilizer ST-2 | 0.15 |
| | High boiling solvent DNP | 0.30 |
| Support | Polyethylene-laminated paper | |

As for the coating assistants, surfactant S-1 and hardener H-1 were used.

Besides the above, antiirradiation dyes AI-1, AI-3 and AI-4 were also used.

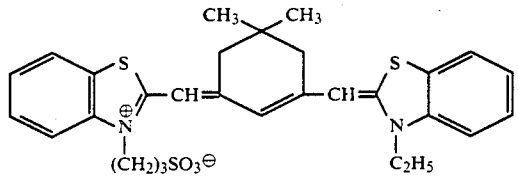

D-1

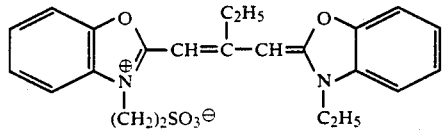

D-2

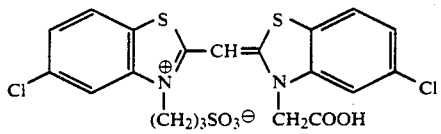

D-3

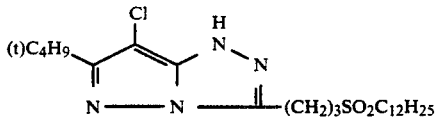

M-2

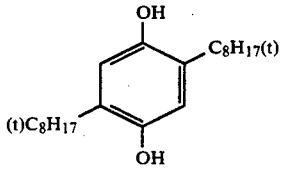

HQ-2

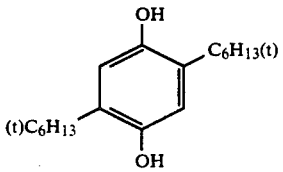

HQ-3

-continued

ST-5

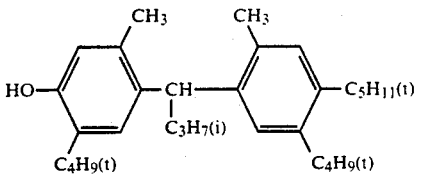

ST-6

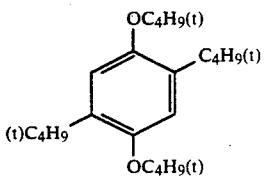

ST-7

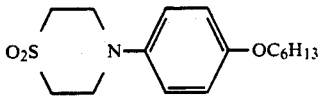

DOP: Dioctyl phthalate

DNP: Dinonyl phthalate

DIDP: Diisodecyl phthalate

S-1

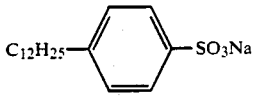

AI-3

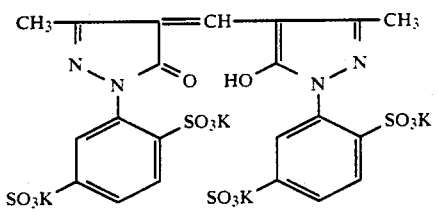

AI-4

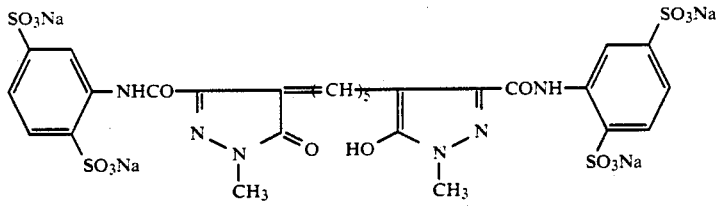

TABLE 5

| Sample No. | Layer 1 Yellow coupler | Layer 4 UV absorbent | Layer 4 Amount of DNP | Layer 4 Amount of gelatin | Layer 6 UV absorbent | Layer 6 Amount of DNP | Layer 6 Amount of gelatin | Total amount of gelatin |
|---|---|---|---|---|---|---|---|---|
| 1 Comp. | Y-1 | UV-4S 0.60 | 0.40 | 1.1 | UV-4S 0.40 | 0.25 | 0.6 | 7.7 |
| 2 Comp. | XI-3 | UV-4S 0.60 | 0.40 | 1.1 | UV-4S 0.40 | 0.25 | 0.6 | 7.7 |
| 3 Comp. | Y-1 | UV-4S 0.60 | 0.40 | 0.9 | UV-4S 0.40 | 0.25 | 0.5 | 7.4 |
| 4 Comp. | XI-3 | UV-4S 0.60 | 0.40 | 1.6 | UV-4S 0.40 | 0.25 | 1.0 | 8.6 |
| 5 Comp. | Y-1 | UV-18L 0.60 | 0 | 1.1 | UV-18L 0.40 | 0 | 0.6 | 7.7 |
| 6 Comp. | XI-3 | UV-4S 0.60 | 0.40 | 0.9 | UV-4S 0.40 | 0.25 | 0.5 | 7.4 |
| 7 Comp. | Y-1 | UV-18L 0.60 | 0 | 0.9 | UV-18L 0.40 | 0 | 0.5 | 7.4 |
| 8 Comp. | XI-3 | UV-18L 0.60 | 0 | 1.1 | UV-18L 0.40 | 0 | 0.6 | 7.7 |
| 9 Inv. | XI-3 | UV-18L 0.60 | 0 | 0.9 | UV-18L 0.40 | 0 | 0.5 | 7.4 |
| 10 Inv. | XI-3 | UV-18L | 0 | 0.9 | UV-18L | 0 | 0.5 | 7.4 |

TABLE 5-continued

| Sample No. | Layer 1 Yellow coupler | Layer 4 UV absorbent | Layer 4 Amount of DNP | Layer 4 Amount of gelatin | Layer 6 UV absorbent | Layer 6 Amount of DNP | Layer 6 Amount of gelatin | Total amount of gelatin |
|---|---|---|---|---|---|---|---|---|
| | | 0.40 UV-4S 0.20 | | | 0.30 UV-4S 0.10 | | | |
| 11 Inv. | XI-3 | UV-18L 0.60 | 0 | 0.6 | UV-18L 0.40 | 0 | 0.3 | 6.9 |
| 12 Inv. | XI-18 | UV-14L 0.60 | 0 | 0.9 | UV-14L 0.40 | 0 | 0.5 | 7.4 |
| 13 Inv. | XI-3 | UV-10L 0.40 UV-7S 0.20 | 0.20 | 0.9 | UV-10L 0.30 UV-7S 0.10 | 0.10 | 0.5 | 7.4 |

Comparative coupler Y-1

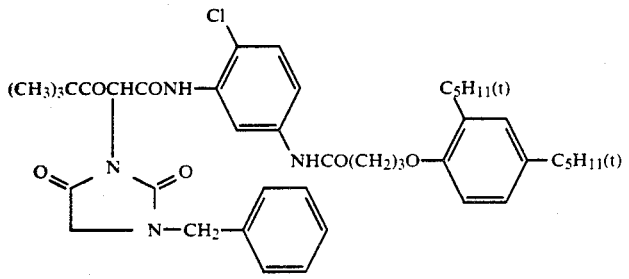

The resulting sample was exposed to light in an ordinary method and was then processed in the following processing steps.

| Processing step A | Temperature | Time |
|---|---|---|
| Color developing | 33° C. | 3 min. 30 sec. |
| Bleach-fixing | 33° C. | 1 min. 30 sec. |
| Washing | 33° C. | 3 min. |
| Drying | 70° C. | 1 min. |

| Color developer | |
|---|---|
| N-ethyl-N-β-methanesulfonamidoethyl-3-methyl-4-aminoaniline sulfate | 4.9 g |
| Hydroxylamine sulfate | 2.0 g |
| Potassium carbonate | 25.0 g |
| Sodium bromide | 0.6 g |
| Sodium sulfite anhydride | 2.0 g |
| Benzyl alcohol | 13 ml |
| Polyethylene glycol, having an average polymerization degree of 400 | 3.0 ml |
| Add water to make | 1 liter |
| Adjust pH with sodium hydroxide to be | pH = 10.0 |
| **Bleach-fixer** | |
| Ferric sodium ethylenediaminetetraacetate | 60 g |
| Ammonium thiosulfate | 100 g |
| Sodium bisulfite | 10 g |
| Sodium metabisulfite | 3 g |
| Add water to make | 1 liter |
| Adjust pH with aqueous ammonia to be | pH = 7.0 |

The processed samples were subjected to the evaluation tests in the following manner. The results thereof are shown in Table-6.

Color reproducibility

A color chart was photographed on a 'Konica Color GX-II 100' color negative film manufactured by Konica Corporation, and was then processed. Using the processed film, the prints of the color chart were made on each of the samples and the color reproducibility thereof were evaluated.

Sweating property

After the samples were stored in a test chamber under the conditions of 85° C. and 60% RH for 21 days, the degrees of sweats produced on the surfaces of the samples were evaluated.

Curling property

After the samples were stored in a test chamber under the conditions of 23° C. and 20% RH for 24 hours, the degrees of curlings produced on the samples were evaluated.

TABLE 6

| Sample No. | Color* reproducibility Yellow | Magenta | Cyan | Total | ** Sweating property | *** Curling property |
|---|---|---|---|---|---|---|
| 1 Comp. | 2 | 4 | 4 | 2 | ○ | X |
| 2 Comp. | 4 | 4 | 4 | 4 | Δ | X |
| 3 Comp. | 2 | 4 | 4 | 2 | Δ | ○ |
| 4 Comp. | 4 | 3 | 3 | 3 | ○ | XX |
| 5 Comp. | 2 | 4 | 4 | 2 | ○ | X |
| 6 Comp. | 4 | 4 | 4 | 4 | X | ○ |
| 7 Comp. | 2 | 4 | 4 | 2 | Δ | ○ |
| 8 Comp. | 4 | 4 | 4 | 4 | ○ | X |
| 9 Comp. | 5 | 4 | 4 | 5 | ○ | ○ |
| 10 Inv. | 5 | 4 | 4 | 5 | ○ | ○ |
| 11 Inv. | 5 | 4 | 4 | 5 | ○ | ⊙ |
| 12 Inv. | 5 | 5 | 5 | 5 | ○ | ○ |

TABLE 6-continued

| Sample No. | Color* reproducibility Yellow | Magenta | Cyan | Total | ** Sweating property | *** Curling property |
|---|---|---|---|---|---|---|
| 13 Inv. | 5 | 4 | 4 | 5 | ○ | ○ |

*Color reproducibility:
5 = Excellent
4 = Good
3 = Acceptable
2 = Poor
1 = Very Poor
**Sweating property:
○ = No sweat produced
Δ = Some sweats produced
X = Sweats seriously produced
***Curling property:
◎ = Excellent
○ = Good
X = Poor
XX = Very poor As is obvious from Table-6, when making the combination use of the yellow coupler of the invention and a liquid UV absorbent, the sweating property improvements could be synergistically achieved. Further, the improvements of the color reproducibility and curling property could also be achieved. As an advantage of reducing the amounts of gelatin used, not only the curling property improvements but also the color reproducibility improvements could also be achieved in the whole.

Example 5

A sample was prepared in the same manner as in Example 4, except that the silver halide emulsion used in Example 4 was replaced by a silver chlorobromide emulsion having a silver chloride content of 99.5 mol %. The resulting sample was evaluated upon exposing it to light and then processing it as in Example 4.

The sample was processed in the following processing steps.

| Processing step B | Temperature | Time |
|---|---|---|
| Color developing | 35° C. | 45 sec. |
| Bleach-fixing | 35° C. | 45 sec. |
| Stabilizing | 33° C. | 90 sec. |
| Drying | 70° C. | 60 sec. |

| Color developer | |
|---|---|
| Pure water | 800 ml |
| Triethanolamine | 10 g |
| N,N-diethylhydroxylamine | 5 g |
| Potassium bromide | 0.02 g |
| Potassium chloride | 2 g |
| Potassium sulfite | 0.3 g |
| 1-hydroxyethylidene-1,1-diphosphoric acid | 1.0 g |
| Ethylenediaminetetraacetic acid | 1.0 g |
| Disodium catechol-3,5-disulfonate | 1.0 g |
| N-ethyl-N-β-methanesulfonamidoethyl-3-methyl-4-aminoaniline sulfate | 4.5 g |
| Fluorescent whitening agent, 4,4'-diaminostilbenedisulfonic acid derivative | 1.0 g |
| Potassium carbonate | 27 g |
| Add water to make in total of | 1 liter |
| Adjust pH with potassium hydroxide or sulfuric acid to be | pH = 10.10 |
| **Bleach-fixer** | |
| Ferric ammonium ethylenediamine-tetraacetate dihydrate | 60 g |
| Ethylenediaminetetraacetic acid | 3 g |
| Ammonium thiosulfate, in an aqueous 70% solution | 100 ml |
| Ammonium sulfite, in an aqueous 40% solution | 27.5 ml |
| Add water to make | 1 liter |
| Adjust pH with potassium carbonate or glacial acetic acid to be | pH = 6.2 |
| **Stabilizer** | |
| 5-chloro-2-methyl-4-isothiazoline-3-one | 1.0 g |
| Ethylene glycol | 1.0 g |
| 1-hydroxyethylidene-1,1-diphosphonic acid | 2.0 g |
| Ethylenediaminetetraacetic acid | 1.0 g |
| Ammonium hydroxide, in an aqueous 20% solution | 3.0 g |
| Ammonium sulfite | 3.0 g |
| Fluorescent whitening agent, 4,4'-diaminostilbenedisulfonic acid derivative | 1.5 g |
| Add water to make | 1 liter |
| Adjust pH with sulfuric acid or potassium hydroxide to be | pH = 7.0 |

The results of the evaluations were the same as in Example 4.

In the combination of processing step B not containing any benzyl alcohol and the invention, the color reproducibility was further improved.

Example 6

On a paper support laminated with polyethylene on one side thereof and with polyethylene containing titanium oxide on the other side thereof which is on the side of Layer 1, each of the layers having the compositions shown in Table-7 was coated, so that a multilayered silver halide color photographic light-sensitive material was prepared. The coating solutions therefor were prepared in the following manners.

Layer 1 coating solution

Ethyl acetate was added in an amount of 60 ml into a mixture of 26.7 g of yellow coupler Y-1, 0.67 g of antistaining agent HQ-1, 10 g of dye-image stabilizer ST-2 and 8.5 g of high boiling organic solvent DBP, and dissolved together. The resulting solution was dispersed emulsion-wise into 300 ml of an aqueous 10% gelatin solution containing 15 ml of an aqueous 10% sodium alkylnaphthalenesulfonate solution by making use of a homogenizer, thereby preparing a yellow coupler dispersion.

The resulting dispersion was mixed up with a blue-sensitive silver chlorobromide emulsion containing silver chloride of 10 mol % and silver bromide of 90 mol % and a gelatin coating solution, thereby preparing Layer 1 coating solution.

Layer 3 coating solution

High boiling organic solvent DBP was added in an amount of 24 g into a mixture of 30 g of magenta coupler M-1, 20 g of dye-image stabilizer ST-4, 7.5 g of dye-image stabilizer ST-3 and 0.85 g of antistaining agent HQ-4, and 50 ml of ethyl acetate was further added thereinto to be dissolved together. The resulting solution was dispersed emulsionwise into 400 ml of an aqueous 5% gelatin solution containing 25 ml of an aqueous 10% sodium dodecylbenzenesulfonate solution by making use of a homogenizer, thereby preparing a magenta coupler dispersed solution.

The resulting solution was mixed up with a blue-sensitive silver chlorobromide emulsion containing silver chloride of 20 mol % and silver bromide of 80 mol % and a gelatin coating solution, thereby preparing Layer 3 coating solution.

Layer 5 coating solution

To a mixture of 7 g of cyan coupler C-1, 10 g of cyan coupler C-2, 8 g of dye-image stabilizer ST-1, 0.4 g of antistaining agent HQ-4 and 8 g of high boiling organic solvent HB-2, 40 ml of ethyl acetate was added. The resulting solution was dispersed emulsionwise in an aqueous 10% gelatin solution containing 10 ml of a 10% sodium alkylnaphthalenesulfonate solution by making use of a homogenizer, thereby preparing a cyan coupler dispersing solution.

The resulting dispersed solution was mixed up with a red-sensitive silver chlorobromide emulsion containing silver chloride of 30 mol % and silver bromide of 70 mol % and a gelatin solution for coating use, thereby preparing Layer 5 coating solution.

The coating solutions each for Layers 2, 4, 6 and 7 were also prepared in the same manner as in the above-described Layer 1 coating solution, as shown in Table-7. As for the gelatin hardener, the following compound H-1 was also added to each of the solutions.

TABLE 7

| Layer | Composition | Amount added g/m² |
|---|---|---|
| Layer 7 Protective layer | Gelatin | 0.9 |
| Layer 6 UV absorbing layer | Gelatin | 0.5 |
| | UV absorbent UV-1 | 0.2 |
| | UV absorbent UV-2 | 0.2 |
| | Antistaining agent HQ-4 | 0.01 |
| | DBP | 0.2 |
| | PVP | 0.03 |
| | Antiirradiation dye AI-5 | 0.02 |
| Layer 5 Red-sensitive layer | Gelatin | 1.30 |
| | Red-sensitive silver chlorobromide emulsion, containing Cl 30%, Br 70%, in terms of silver content: | 0.24 |
| | Cyan coupler C-1 | 0.18 |
| | Cyan coupler C-2 | 0.25 |
| | Dye-image stabilizer ST-1 | 0.20 |
| | High boiling organic solvent HB-2 | 0.20 |
| | Antistaining agent HQ-4 | 0.01 |
| Layer 4 UV absorbing layer | Gelatin | 1.10 |
| | UV absorbent UV-1 | 0.40 |
| | UV absorbent UV-2 | 0.40 |
| | Antistaining agent HQ-4 | 0.03 |
| | DBP | 0.40 |
| Layer 3 Green-sensitive layer | Gelatin | 1.40 |
| | Green-sensitive silver chlorobromide emulsion containing Cl 20%, Br 80%, in terms of silver content: | 0.27 |
| | Magenta coupler M-1 | 0.35 |
| | Dye-image stabilizer ST-4 | 0.23 |
| | Dye-image stabilizer ST-3 | 0.09 |
| | High boiling organic solvent DBP | 0.28 |
| | Antiirradiation dye AI-1 | 0.01 |
| Layer 2 Interlayer | Gelatin | 1.20 |
| | Antistaining agent HQ-4 | 0.12 |
| | DBP | 0.15 |
| Layer 1 Blue-sensitive layer | Gelatin | 1.20 |
| | Blue-sensitive silver chlorobromide emulsion, containing Cl 10%, Br 90%, in terms of silver content: | 0.30 |
| | Yellow coupler Y-1 | 0.80 |
| | Dye-image stabilizer ST-2 | 0.30 |
| | Antistaining agent HQ-4 | 0.02 |
| | DBP | 0.25 |
| Support | Polyethylene-laminated paper | |

HQ-4

TABLE 7-continued

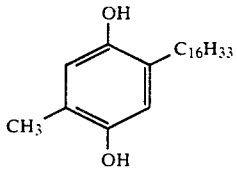

HB-2

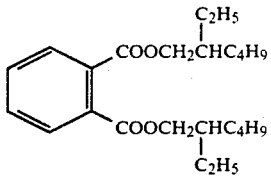

AI-5

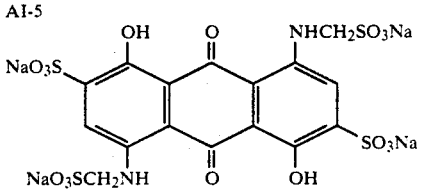

M-3

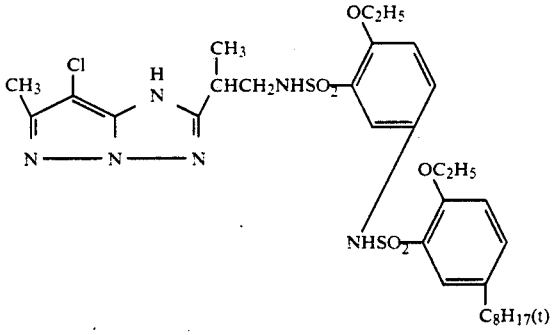

M-4

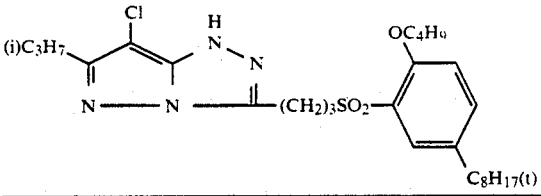

The resulting coated sample was names Sample 1. Next, Samples 2 through 12 were prepared in the same manner as in Sample 1, except that, in Sample 1, magenta coupler M-1 and the amount of gelatin added, each of Layer 3, and cyan couplers C-1, C-2 and the amount of gelatin added, each of Layer 5, were replaced by those shown in Table-8.

TABLE 8

| | Layer 3 | | Layer 5 | |
|---|---|---|---|---|
| Sample No. | Magenta coupler | Gelatin added | Cyan coupler | Gelatin added |
| 1 Comparative | M-1 | 1.40 | C-1/C-2 | 1.30 |
| 2 Inventive | M-3 | 1.40 | C-1/C-2 | 1.30 |
| 3 Inventive | M-4 | 1.40 | C-1/C-2 | 1.30 |
| 4 Inventive | I-66 | 1.40 | C-1/C-2 | 1.30 |
| 5 Inventive | I-66 | 1.40 | XXXI-15 | 1.30 |
| 6 Inventive | I-66 | 1.35 | XXXI-18 | 1.30 |
| 7 Comparative | M-1 | 1.50 | C-1 | 1 40 |
| 8 Inventive | M-3 | 1.35 | C-2 | 1.30 |
| 9 Inventive | M-4 | 1.35 | C-2 | 1.30 |

TABLE 8-continued

| Sample No. | Layer 3 Magenta coupler | Layer 3 Gelatin added | Layer 5 Cyan coupler | Layer 5 Gelatin added |
|---|---|---|---|---|
| 10 Inventive | I-24 | 1.35 | C-2 | 1.30 |
| 11 Inventive | I-24 | 1.35 | XXXI-4 | 1.30 |
| 12 Inventive | I-24 | 1.35 | XXXI-4/C-2 | 1.30 |

Gelatin amounts are shown in terms of $g/m^2$.

The resulting samples were exposed wedgewise to light by making use of a sensitometer, Model KS-7, manufactured by Konica Corporation, and were then processed in the following color developing steps. The evaluations thereof were made as follows.

| Processing step | Time | Temperature |
|---|---|---|
| Color developing | 3 min. 30 sec. | 33° C. |
| Bleach-fixing | 1 min. 30 sec. | 33° C. |
| Washing | 3 min. | 33° C. |

| Color developer formula | |
|---|---|
| N-ethyl-N-β-methanesulfonamidoethyl-3-methyl-4-aminoaniline sulfate | 4.9 g |
| Hydroxylamine sulfate | 2.0 g |
| Potassium carbonate | 25.0 g |
| Sodium bromide | 0.6 g |
| Sodium sulfite anhydride | 2.0 g |
| Benzyl alcohol | 13 ml |
| Diethylenetriaminepentaacetic acid | 3.0 g |
| Triethanolamine | 10.0 g |
| Diethylene glycol | 10.0 g |
| Add water to make | 1 liter |
| Adjust pH with sodium hydroxide to be | pH = 10.0 |
| **Bleach-fixer formula** | |
| Iron III sodium ethylenediaminetetraacetate | 6.0 g |
| Ammonium thiosulfate | 100 g |
| Sodium bisulfite | 10 g |
| Sodium metabisulfite | 3 g |
| Add water to make | 1 liter |
| Adjust pH with aqueous ammonia to be | pH = 7.0 |

Photoptic color fading property

The resulting samples were stored outdoors by exposing them to sun rays on an exposure table for one month, and the photoptic color fading properties thereof were evaluated.

Dark color fading property

The resulting samples were stored under the conditions of 85° C. and 60% RH for 20 days, and the dark color fading properties thereof were evaluated by obtaining the dye-image residual percentages at the initial density of 1.0.

Color tone

A color chart, manufactured by Macbeth Company, was photographed on a 'Konica Color GX II 100' color negative film manufactured by Konica Corporation, and the photographed film was then processed. Using the processed negative film and adjusting the tones in the grey scale portions of the film, each sample was exposed to light through the film and processed. The color reproducibility of each sample was visually evaluated on each of the hues of the resulting prints.

○ . . . Color reproduction had no color stain, close to the original.

⅓ . . . Color reproduction has a slight color stains.

X . . . Color reproduction had color stains.

The results of the evaluations are shown in Table-9.

TABLE 9

| Sample No. | Photoptic color fading, % Yellow | Magenta | Cyan | Dark color fading, % Yellow | Magenta | Cyan | Color tone B | G | R |
|---|---|---|---|---|---|---|---|---|---|
| 1 Comp. | 80 | 80 | 81 | 85 | 81 | 72 | X | Δ | X |
| 2 Inv. | 80 | 47 | 81 | 85 | 89 | 72 | ○ | Δ | ○ |
| 3 Inv. | 80 | 62 | 81 | 85 | 87 | 72 | ○ | Δ | ○ |
| 4 Inv. | 80 | 78 | 81 | 85 | 88 | 72 | ○ | Δ | ○ |
| 5 Inv. | 80 | 78 | 82 | 85 | 86 | 84 | ○ | ○ | ○ |
| 6 Inv. | 80 | 78 | 81 | 85 | 85 | 83 | ○ | ○ | ○ |
| 7 Comp. | 80 | 82 | 85 | 85 | 81 | 43 | X | ○ | X |
| 8 Inv. | 80 | 44 | 79 | 85 | 87 | 94 | ○ | Δ | ○ |
| 9 Inv. | 80 | 57 | 79 | 85 | 85 | 94 | ○ | Δ | ○ |
| 10 Inv. | 80 | 80 | 79 | 85 | 86 | 94 | ○ | Δ | ○ |
| 11 Inv. | 80 | 80 | 82 | 85 | 86 | 84 | ○ | ○ | ○ |
| 12 Inv. | 80 | 80 | 81 | 85 | 86 | 89 | ○ | ○ | ○ |

As is obvious from Table-9, in the combination of the couplers in Samples 1 and 7, the color tone was inferior to the others. In Samples 2 through 6 and 8 through 12, such color tones could be improved by using magenta couplers of the invention.

In both of the photoptic and dark color fading properties of Samples 5, 6, 11 and 12, their yellow, magenta and cyan color fading ratios were almost equivalent to each other, and their three-color fading balance were kept excellent.

Example-7

A multilayered color light-sensitive material was prepared in the same manner as in Example-6 by coating each of the layers having the compositions shown in Table-10 onto a polyethylene-laminated paper support which was the same as that of Example-6. The coating solutions were prepared in the following manner.

Layer 1 coating solution

A mixture of 27.2 g of yellow coupler Y-2, 0.67 g of antistaining agent HQ-4, 5 g of dye-image stabilizer ST-2, 10 g of dye-image stabilizer ST-1, and 8.5 g of high boiling organic solvent DBP was dissolved in 60 ml of ethyl acetate. The solution resulted was then dispersed emulsionwise, by making use of a homogenizer, in 300 ml of an aqueous 10% gelatin solution containing 15 ml of an aqueous 10% sodium alkylnaphthalenesulfonate solution, so that a yellow coupler dispersed solution was prepared.

The resulting dispersed solution was mixed up with a blue-sensitive silver chlorobromide emulsion containing silver chloride of 99.5 mol % and silver bromide of 0.5 mol %, and a gelatin coating solution, so that Layer 1 coating solution was prepared.

Layer 3 coating solution

A mixture of 30 g of magenta coupler M-1, 20 g of dye-image stabilizer ST-4, 6 g of dye-image stabilizer ST-5, 0.85 g of antistaining agent HQ-4, and 24 g of high boiling organic solvent DBP was dissolved in 50 ml of ethyl acetate. The solution resulted was dispersed emulsionwise, by making use of a homogenizer, in 400 ml of an aqueous 5% gelatin solution containing 25 ml of an aqueous 10% sodium dodecylbenzenesulfonate, so that a magenta coupler dispersed solution was prepared.

The dispersed solution was mixed up with a blue-sensitive silver chlorobromide emulsion containing silver chloride of 99.5% and silver bromide of 0.5%, and a gelating coating solution, so that Layer 3 coating solution was prepared.

Layer 5 coating solution

A mixture of 7 g of cyan coupler C-1, 10 g of cyan coupler C-2, 8 g of dye-image stabilizer ST-1, 0.4 g of antistaining agent HQ-4, 8 g of high boiling organic solvent HB-2 and 4 g of high boiling organic solvent HB-3 was dissolved in 40 ml of ethyl acetate. The solution resulted was dispersed emulsionwise in 300 ml of an aqueous 10% gelatin solution containing 10 ml of an aqueous 10% sodium alkylnaphthalenesulfonate solution, by making use of a homogenizer, so that a cyan coupler dispersed solution was prepared.

The resulting dispersed solution was mixed up with a red-sensitive silver chlorobromide emulsion containing silver chloride of 99.8 mol % and silver bromide of 0.2 mol % and a gelatin coating solution, so that Layer 5 coating solution was prepared.

The layer coating solutions for Layers 2, 4, 6, and 7 layers were each prepared in the same manner as in the above-mentioned Layer 1 coating solution, as shown in Table-10. As for the gelatin hardeners for the solutions, hardener H-1 was added into each of the coating solutions as in Example-6.

TABLE 10

| Layer | Composition | Amount added g/m² |
|---|---|---|
| Layer 7 Protective layer | Gelatin | 0.9 |
| Layer 6 UV absorbing layer | Gelatin | 0.5 |
| | UV absorbent UV-1 | 0.2 |
| | UV absorbent UV-2 | 0.2 |
| | Antistaining agent HQ-4 | 0.01 |
| | DBP | 0.2 |
| | PVP | 0.03 |
| | Antiirradiation dye AI-4 | 0.02 |
| Layer 5 Red-sensitive layer | Gelatin | 1.30 |
| | Red-sensitive silver chlorobromide emulsion, containing Cl of 99.8% and Br of 0.2%, in terms of silver content | 0.24 |
| | Cyan coupler C-1 | 0.18 |
| | Cyan coupler C-2 | 0.25 |
| | Dye-image stabilizer ST-1 | 0.20 |
| | Antistaining agent HQ-4 | 0.01 |
| | High boiling organic solvent HB-2 | 0.20 |
| | High boiling organic solvent HB-3 | 0.10 |
| Layer 4 UV absorbing layer | Gelatin | 1.10 |
| | UV absorbent UV-1 | 0.40 |
| | UV absorbent UV-2 | 0.40 |
| | Antistaining agent HQ-4 | 0.03 |
| | DBP | 0.40 |
| Layer 3 Green-sensitive layer | Gelatin | 1.40 |
| | Green-sensitive silver chlorobromide emulsion, containing Cl of 99.5% and Br of 0.5%, interms of silver content | 0.27 |
| | Magenta coupler M-1 | 0.35 |
| | Dye-image stabilizer ST-4 | 0.23 |
| | Dye-image stabilizer ST-5 | 0.07 |
| | High boiling organic solvent DBP | 0.28 |
| | Antiirradiation dye AI-1 | 0.01 |
| Layer 2 Interlayer | Gelatin | 1.20 |
| | Antistaining agent HQ-4 | 0.12 |
| | DBP | 0.15 |
| Layer 1 Blue-sensitive layer | Gelatin | 1.20 |
| | Blue-sensitive silver chlorobromide emulsion, containing Cl of 99.5% and Br of 0.5%, in terms of silver content | 0.30 |
| | Yellow coupler Y-2 | 0.82 |
| | Dye-image stabilizer ST-2 | 0.15 |
| | Dye-image stabilizer ST-1 | 0.30 |
| | Antistaining agent HQ-4 | 0.02 |
| | DBP | 0.25 |
| Support | Polyethylene-laminated paper | |

Y-2

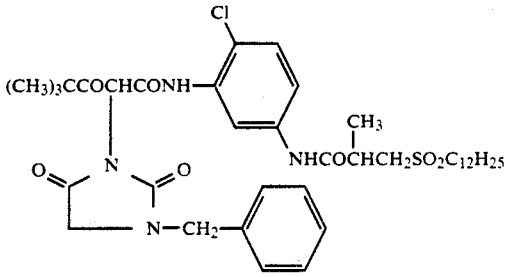

ST-5

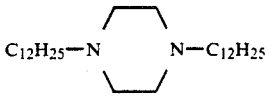

HB-3

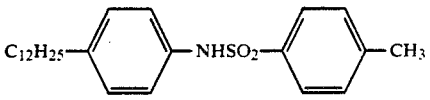

The resulting sample was named Sample 2-1. Next, Samples 2-2 through 2-19 were prepared in the same manner as in Sample 2-1, except that magenta coupler M-1 and the amount of gelatin each of Layer 3 and cyan couplers C-1 and C-2 and the amount of gelatin each of Layer 5 were replaced by those shown in Table-11.

TABLE 11

| | Layer 3 | | Layer 5 | |
|---|---|---|---|---|
| Sample No. | Magenta coupler | Gelatin amount | Cyan coupler | Gelatin amount |
| 2-1 Comp. | M-1 | 1.40 | C-1/C-2 | 1.30 |
| 2-4 Inv. | M-4 | 1.40 | C-1/C-2 | 1.30 |
| 2-5 Inv. | M-4 | 1.40 | XXXI-15 | 1.30 |
| 2-7 Inv. | M-3 | 1.40 | C-1/C-2 | 1.30 |
| 2-9 Inv. | M-3 | 1.40 | XXXI-18 | 1.30 |
| 2-10 Inv. | M-3 | 1.40 | XXXI-4/C-2 | 1.30 |
| 2-14 Inv. | M-3 | 1.40 | XXXI-4 | 1.30 |
| 2-15 Inv. | M-3 | 1.40 | XXXI-4 | 1.30 |
| 2-16 Inv. | M-3 | 1.35 | XXXI-4 | 1.30 |
| 2-18 Inv. | M-3 | 1.35 | XXXI-4/C-2 | 1.25 |
| 2-19 Inv. | M-3 | 1.35 | XXXI-4/C-3 | 1.30 |

In the table, the gelatin amounts are shown in terms of g/m²

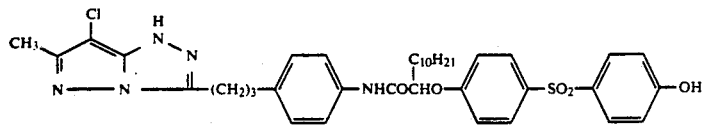

M-4

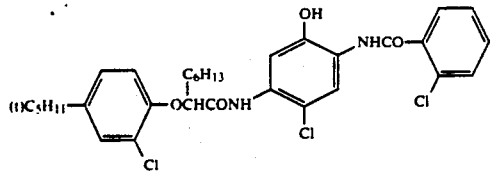

C-3

The resulting samples were each exposed to light through an wedge in the same manner as in Example-6 and processed in the following processing steps. Then, the same evaluations as made in Example-6 and the color developability evaluation were also made.

| Processing step | Temperature | Time |
|---|---|---|
| Color developing | 35.0 ± 0.3° C. | 45 sec. |
| Bleach-fixing | 35.0 ± 0.5° C. | 45 sec. |
| Stabilizing | 30 to 34° C. | 90 sec. |
| Drying | 60 to 80° C. | 60 sec. |

| Developer | |
|---|---|
| Pure water | 800 ml |
| Triethanolamine | 10 g |
| N,N-diethylhydroxylamine | 5 g |
| Potassium bromide | 0.02 g |
| Potassium chloride | 2 g |
| Potassium sulfite | 0.3 g |
| 1-hydroxyethylidene-1-1-diphosphoric acid | 1.0 g |
| Ethylenediaminetetraacetic acid | 1.0 g |
| Disodium catechol-3,5-disulfonic acid | 1.0 g |
| N-ethyl-N-β-methanesulfonamidoethyl-3-methyl-4-aminoaniline sulfonate | 4.5 g |
| Fluorescent whitening agent, 4,4'-diaminostilbenedisulfonic acid derivative | 1.0 g |
| Potassium carbonate | 27 g |
| Add water to make in total of | 1 liter |
| Adjust pH to be | pH = 10.10 |
| **Bleach-fixer** | |
| Ferric ammonium ethylenediamine-tetraacetate dihydrate | 60 g |
| Ethylenediaminetetraacetic acid | 3 g |
| Ammonium thiosulfate, in an aqueous 70% solution | 100 ml |
| Ammonium sulfite, in an aqueous 40% solution | 27.5 ml |
| Add water to make in total of | 1 liter |
| Adjust pH with potassium carbonate or glacial acetic acid to be | pH = 5.7 |
| **Stabilizer** | |
| 5-chloro-2-methyl-4-isothiazoline-3-one | 1.0 g |
| Ethylene glycol | 1.0 g |
| 1-hydroxyethylidene-1,1-diphosphoric acid | 2.0 g |
| Ethylenediaminetetraacetic acid | 1.0 g |
| Ammonium hydroxide, in an aqueous 20% solution | 3.0 g |
| Ammonium sulfite | 3.0 g |
| Fluorescent whitening agent, 4,4'-diaminostilbenedisulfonic acid derivative | 1.5 g |
| Add water to make in total of | 1 liter |
| Adjust pH with sulfuric acid or potassium hydroxide to be | pH = 7.0 |

Color developability

The maximum density, Dmax, of each sample resulted was measured with a densitometer, Model PDA-65 manufactured by Konica Corporation.

The results thereof are shown in Table-12.

TABLE 12

| Sample No. | Color developability, Dmax | | | Photoptic color fading property, % | | | Dark color fading property, % | | | Color reproduction |
|---|---|---|---|---|---|---|---|---|---|---|
| | Magenta | Cyan | Yellow | Magenta | Cyan | Yellow | Magenta | Cyan | | Synthetic evaluation of B, G, R |
| 2- 1 Comp. | 2.36 | 2.55 | 80 | 80 | 82 | 87 | 80 | 73 | | × |
| 2- 4 Inv. | 2.40 | 2.56 | 80 | 48 | 82 | 87 | 88 | 71 | | △ |
| 2- 5 Inv. | 2.40 | 2.51 | 80 | 48 | 83 | 87 | 88 | 85 | | ○ |
| 2- 7 Inv. | 2.35 | 2.56 | 80 | 56 | 81 | 87 | 87 | 73 | | △ |
| 2- 9 Inv. | 2.35 | 2.53 | 80 | 56 | 81 | 87 | 87 | 84 | | ○ |
| 2-10 Inv. | 2.35 | 2.46 | 80 | 56 | 81 | 87 | 87 | 90 | | ○ |
| 2-14 Inv. | 2.33 | 2.47 | 80 | 80 | 83 | 87 | 88 | 86 | | ○ |
| 2-15 Inv. | 2.33 | 2.53 | 80 | 80 | 82 | 87 | 88 | 86 | | ○ |
| 2-16 Inv. | 2.36 | 2.56 | 80 | 79 | 82 | 87 | 88 | 86 | | ○ |
| 2-18 Inv. | 2.36 | 2.54 | 80 | 79 | 80 | 87 | 88 | 89 | | ○ |
| 2-19 Inv. | 2.36 | 2.52 | 80 | 79 | 80 | 87 | 88 | 90 | | ○ |

From the results shown in Table-12, it was proved that the combination of the couplers in Sample 2-1 was deteriorated in tones, and that the tones obtained from Samples 2-4 and 2-7 were found to be considerably improved by changing the couplers.

In the combinations of the couplers in the other samples than the above, they were excellent in color reproducibility and they had almost no color contamination even through the visual observation.

In the combinations of the couplers and gelatin each used in Samples 2-15, 2-16, 2-18 and 2-19, the image preservability and color developability thereof were by no means inferior to others and the excellent characteristics including both of the three-color fading balance and color developability could be obtained. The above-mentioned results were surprising and unexpected.

Example-8

A mixture of 60 g of magenta coupler M-1, 15 g of dye-image stabilizer ST-4, 40 g of dye-image stabilizer ST-8 and 1.7 g of antistaining agent HQ-1 was dissolved in a mixture of 40 ml of high boiling organic solvent DBP and 100 ml of ethyl acetate. The solution resulted was added into an aqueous 5% gelatin solution containing 5 g of sodium dodecylbenzenesulfonate and the mixture thereof was then dispersed together by making use of a homogenizer. The resulting dispersed solution was made to be 1500 ml.

The resulting dispersed solution was added into 1000 ml of an aqueous 3% gelatin coating solution and, further, 400 g of a green-sensitive silver chlorobromide emulsion containing silver chloride of 80 mol % was added thereinto, so that a green-sensitive emulsion coating solution was prepared. In the same manner as in the above, each of the other layer coating solutions was prepared. The resulting layer coating solutions were coated on a polyethylene-laminated paper support, in order from the support, so as to have the layer arrangements shown in Table-13.

TABLE 13

| Layer | Composition | Amount added g/m² |
|---|---|---|
| Layer 7 | Gelatin | 1.0 |
| Protective layer | | |
| Layer 6 | Gelatin | 0.6 |
| UV absorbing | UV absorbent UV-1 | 0.2 |
| layer | UV absorbent UV-2 | 0.2 |
| | Antistaining agent HQ-1 | 0.01 |
| | DBP | 0.2 |
| | PVP | 0.03 |
| | Antiirradiation dye AI-2 | 0.02 |
| Layer 5 | Gelatin | 1.40 |
| Red-sensitive | Red-sensitive silver chloro- | 0.24 |
| layer | bromide emulsion, in terms of silver content | |
| | Cyan coupler C-1 | 0.17 |
| | Cyan coupler C-2 | 0.25 |
| | Dye-image stabilizer ST-1 | 0.20 |
| | Antistaining agent HQ-1 | 0.01 |
| | DBP | 0.30 |
| Layer 4 | Gelatin | 1.30 |
| UV absorbing | UV absorbent UV-1 | 0.40 |
| layer | UV absorbent UV-2 | 0.40 |
| | Antistaining agent HQ-1 | 0.03 |
| | DBP | 0.40 |
| Layer 3 | Gelatin | 1.40 |
| Green-sensitive | Green-sensitive silver chloro- | 0.27 |
| layer | bromide emulsion, in terms of silver content | |
| | Magenta coupler M-1 | 0.35 |
| | Dye-image stabilizer ST-4 | 0.10 |
| | Dye-image stabilizer ST-8 | 0.20 |
| | DBP | 0.30 |
| | Antiirradiation dye AI-1 | 0.01 |
| Layer 2 | Gelatin | 1.20 |
| Interlayer | Antistaining agent HQ-1 | 0.12 |
| | DBP | 0.15 |
| Layer 1 | Gelatin | 1.30 |
| Blue-sensitive | Blue-sensitive silver chloro- | 0.30 |
| layer | bromide emulsion in terms of silver content | |
| | Yellow coupler Y-1 | 0.80 |
| | Dye-image stabilizer ST-1 | 0.30 |
| | Dye-image stabilizer ST-2 | 0.20 |
| | Antistaining agent HQ-1 | 0.02 |
| | DBP | 0.20 |
| Support | Polyethylene-laminated paper | |

ST-8

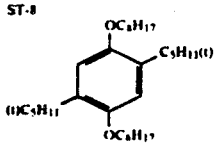

As for the hardener, the foregoing H-1 was used.

The resulting sample was named Sample 1. Next, Samples 2 through 12 were prepared in the same manner as in Sample 1, except that the yellow, cyan and magenta couplers and the total amount of gelatin added, each of Samples 1, were changed as shown in Table 14.

In addition, when changing the magenta coupler into the couplers of the invention, the following compounds were used together as the dye 7-image stabilizers.

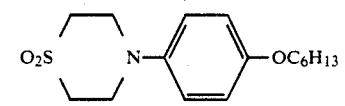

0.15 g/m²

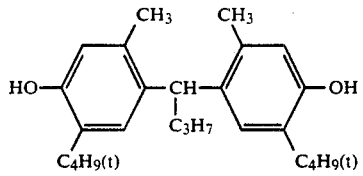

0.15 g/m²

The resulting samples were exposed to light in an ordinary method and were then processed in the following processing steps.

| Processing step | Temperature | Time |
|---|---|---|
| Color developing | 33° C. | 3 min. 30 sec. |
| Bleach-fixing | 33° C. | 1 min. 30 sec. |
| Washing | 33° C. | 3 min. |
| Color developer | | |
| N-ethyl-N-β-methanesulfonamidoethyl-3-methyl-4-aminoaniline sulfate | | 4.9 g |
| Hydroxylamine sulfate | | 2.0 g |
| Potassium carbonate | | 25.0 g |
| Sodium bromide | | 0.6 g |
| Sodium sulfite anhydride | | 2.0 g |
| Benzyl alcohol | | 13.0 ml |
| Polyethylene glycol, having an average polymerization degree of 400 | | 3.0 ml |
| Add water to make | | 1 liter |
| Adjust pH with sodium hydroxide to be | | pH = 10.0 |
| Bleach-fixer | | |
| Ferric sodium ethylenediaminetetraacetate | | 60.0 g |
| Sodium thiosulfate | | 100.0 g |
| Sodium bisulfite | | 10.0 g |
| Sodium metabisulfite | | 3.0 g |
| Add water to make | | 1 liter |
| Adjust pH with aqueous ammonia to be | | pH = 7.0 |

The color reproducibility of each sample resulted was evaluated in the following manner.

Color reproducibility

The color reproducibility evaluation was made according to the expression method of the L☆u☆v-☆ color specification system specified in JIS Z-8729-1980, in the following manner. A u'v' chromaticity diagram was made out in terms of L =50, and the synthetic color reproduction areas formed by the yellow, magenta and cyan color forming dyes were evaluated in terms of the area relative to that of Sample 1 which was regarded as a value of 100. In addition to the above evaluations, each of the color evaluations was visually made.

The results thereof are shown in Table-14.

TABLE 14

| Sample No. | Yellow coupler in Layer 1 | Magenta coupler in Layer 3 | Cyan coupler in Layer 5 | Total amount of gelatin added, g/m² | Color reproduciblity Relative area | Color reproduciblity Visual evaluation* |
|---|---|---|---|---|---|---|
| 1 Comp. | Y-1 | M-1 | C-1/C-2 | 8.2 | 100 | C |
| 2 Comp. | Y-1 | M-1 | C-1/C-2 | 7.6 | 100 | C |
| 3 Comp. | XI-3 | I-22 | XXXI-4 | 8.2 | 119 | B |
| 4 Inv. | XI-3 | I-22 | XXXI-4 | 7.6 | 124 | A |
| 5 Inv. | XI-3 | M-1 | XXXI-4 | 7.6 | 125 | A |
| 6 Inv. | XI-3 | I-10 | XXXI-4 | 7.6 | 124 | A |
| 7 Inv. | XI-3 | I-23 | XXXI-4 | 7.6 | 127 | A |

TABLE 14-continued

| Sample No. | Yellow coupler in Layer 1 | Magenta coupler in Layer 3 | Cyan coupler in Layer 5 | Total amount of gelatin added. g/m² | Color reproduciblity Relative area | Visual evaluation* |
|---|---|---|---|---|---|---|
| 8 Inv. | XI-3 | I-62 | XXXI-4 | 7.6 | 125 | A |
| 9 Inv. | XI-10 | I-23 | XXXI-4 | 7.6 | 126 | A |
| 10 Inv. | XI-18 | I-23 | XXXI-4 | 7.6 | 125 | A |
| 11 Inv. | XI-3 | I-23 | XXXI-8 | 7.6 | 126 | A |
| 12 Inv. | XI-3 | I-23 | XXXI-15 | 7.6 | 124 | A |

*Evaluation levels
A: Hue and chroma were excellent
B: Hue was practically good. but chroma was seemed to be deteriorated with stains.
C: Hue and Chroma were deteriorated.

As can be understood from Table-14, in Samples 1 and 2 applied thereinto with the comparative couplers, their color reproduction were seriously deteriorated and almost no improvement effect was found out of the samples. Among the combinations of the couplers of the invention, in Samples 3 applied thereinto with gelatin in a total amount out of the range of the invention, each of the colors was still not clearly produced, because the chroma was deteriorated, though the hues were almost good; and in Samples 4 through 12, both of the hues and chroma were excellent and each of the colors was found to be clear even in the visual judgements.

Example 9

A sample was prepared by coating each of the layers each having the same compositions as in Sample 1 of Example 8; provided, the silver halide emulsions used therein were prepared in the following manner. The resulting sample was named Sample 14.

Preparation of blue-sensitive silver halide emulsion

Into 1000 ml of an aqueous 2% gelatin solution being kept at 40° C., the following solutions A and B were simultaneously added with keeping their pAg values to be 6.5 and pH values to be 3.0 by taking 30 minutes and, thereinto the following solutions C and D were further simultaneously added with keeping their pAg values to be 7.3 and pH values to be 5.5 by taking 180 minutes.

In this instance, each of the pAg control was made in accordance with the method described in Japanese Patent O.P.I. Publication No. 59-45437/1984, and each of the pH control was made with an aqueous solution of sulfuric acid or sodium hydroxide.

| | |
|---|---|
| Solution A | |
| Sodium chloride | 3.42 g |
| Potassium bromide | 0.03 g |
| Add water to make | 200 ml |
| Solution B | |
| Silver nitrate | 10 g |
| Add water to make | 200 ml |
| Solution C | |
| Sodium chloride | 102.7 g |
| Potassium bromide | 1.0 g |
| Add water to make | 600 ml |
| Solution D | |
| Silver nitrate | 300 g |
| Add water to make | 600 ml |

After completing the addition of the above-given solutions, the desalting treatment was made with an aqueous solution of 5% Demol N, manufactured by Kao Corporation, and an aqueous solution of 2.0% magnesium sulfate. After then, the resulting desalted solution was mixed with an aqueous gelatin solution, so that monodisperse type cubic emulsion EMP-1 was obtained. The average grain-size, variation coefficient and silver content thereof were 0.85 μm, 0.07 and 99.5 mol %, respectively.

The resulting emulsion EMP-1 was chemically ripened at 50° C. for 90 minutes, with the following compounds, so that blue-sensitive silver halide emulsion EmA was obtained.

| | |
|---|---|
| Sodium thiosulfate | 0.8 mg/mol AgX |
| Chloroauric acid | 0.5 mg/mol AgX |
| Stabilizer SB-5 | $6 \times 10^{-4}$ mols/mol AgX |
| Sensitizing dye D-3 | $5 \times 10^{-4}$ mols/mol AgX |

Preparation of green-sensitive silver halide emulsion

Monodisperse type cubic emulsion EMP-2 was obtained in the same manner as in EMP-1, except that the adding time of Solutions A and B and the adding time of Solutions C and D were changed. The average grain-size, variation coefficient and silver chloride content thereof were 0.43 μm, 0.08 and 99.5 mol %, respectively.

EMP-2 was chemically ripened at 55° C. for 120 minutes with the following compounds, so that green-sensitive silver halide emulsion EmB was obtained.

| | |
|---|---|
| Sodium thiosulfate | 1.5 mg/mol AgX |
| Chloroauric acid | 1.0 mg/mol AgX |
| Stabilizer SB-5 | $6 \times 10^{-4}$ mols/mol AgX |
| Sensitizing dye D-4 | $4.0 \times 10^{-4}$ mols/mol AgX |

Preparation of red-sensitive silver halide emulsion

Monodisperse type cubic emulsion EMP-3 was obtained in the same manner as in EMP-1, except that the adding time of Solutions A and B and the adding time of Solution C an D were changed. The average grain-size, variation coefficient and silver chloride content thereof were 0.50 μm, 0.08 and 99.5 mol %, respectively.

EMP-3 was chemically ripened at 60° C. for 90 minutes with the following compounds, so that red-sensitive silver halide emulsion EmC was obtained.

| | |
|---|---|
| Sodium thiosulfate | 1.8 mg/mol AgX |
| Chloroauric acid | 2.0 mg/mol AgX |
| Stabilizer SB-5 | $6 \times 10^{-4}$ mols/mol AgX |
| Sensitizing dye D-1 | $8.0 \times 10^{-4}$ mols/mol AgX |

D-4

-continued

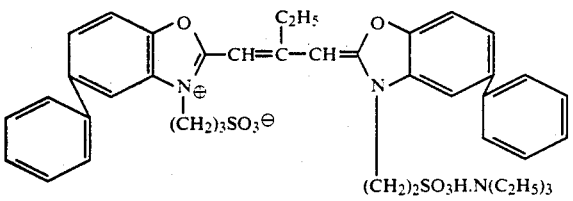

SB-5

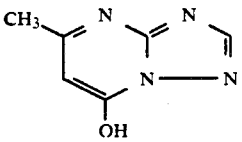

Samples 15 through 24 were each prepared in the same manner as in Sample 14, except that the yellow, magenta and cyan couplers and the total amount of gelatin added were replaced by those shown in Table-15.

Samples 14 through 24 were each exposed to light in an ordinary method and were then processed in the following processing steps.

| Processing step | Temperature | Time |
|---|---|---|
| Color developing | 35.0 ± 0.3° C. | 45 sec. |
| Bleach-fixing | 35.0 ± 0.5° C. | 45 sec. |
| Stabilizing | 30 to 34° C. | 90 sec. |
| Drying | 60 to 80° C. | 60 sec. |

| Color developer | |
|---|---|
| Pure water | 800 ml |
| Triethanolamine | 10 g |
| N,N-diethylhydroxylamine | 5 g |
| Potassium bromide | 0.02 g |
| Potassium chloride | 2 g |
| Potassium sulfite | 0.3 g |
| 1-hydroxyethylidene-1,1-diphosphoric acid | 1.0 g |
| Ethylenediaminetetraacetic acid | 1.0 g |
| Disodium catechol-3,5-disulfonate | 1.0 g |
| N-ethyl-N-b-methanesulfonamidoethyl-3-methyl-4-aminoaniline sulfate | 4.5 g |
| Fluorescent whitening agent, 4,4'-diaminostilbenedisulfonic acid derivative | 1.0 g |
| Potassium carbonate | 27 g |
| Add water to make in total of | 1 liter |
| Adjust pH to be | pH = 10.10 |
| **Bleach-fixer** | |
| Ferric ammonium ethylenediamine-tetraacetate dihydrate | 60 g |
| Ethylenediaminetetraacetic acid | 3 g |
| Ammonium thiosulfate, in an aqueous 70% solution | 100 ml |
| Ammonium sulfite, in an aqueous 40% solution | 27.5 ml |
| Add water to make in total of | 1 liter |
| Adjust pH with potassium carbonate or glacial acetic acid to be | pH = 5.7 |

-continued

| Stabilizer | |
|---|---|
| 5-chloro-2-methyl-4-isothiazoline-3-one | 1.0 g |
| Ethylene glycol | 1.0 g |
| 1-hydroxyethylidene-1,1-diphosphoric acid | 2.0 g |
| Ethylenediaminetetraacetic acid | 1.0 g |
| Ammonium hydroxide, in an aqueous 20% solution | 3.0 g |
| Fluorescent whitening agent, 4,4'-diaminostilbenedisulfonic acid derivative | 1.5 g |
| Add water to make in total of | 1 liter |
| Adjust pH with sulfuric acid or potassium hydroxide to be | pH = 7.0 |

The color reproducibility of the processed samples were each evaluated in the same manner as in Example 8.

The processing time variation resistance of each samples were also evaluated in the following manner.

Processing time variation resistance

The color developing time was changed from 45 seconds to 30 seconds. The ratios of the tone produced in the green-sensitive layer to each of the tones produced in the blue-sensitive and red-sensitive layers were obtained for both of the above-mentioned processing time and, then, the values of the ratios of the tones obtained by processing the samples in the 30-second process were so expressed as to be relative to the value, set at a value of 100, of the ratio of the tones obtained by processing the samples in the 45-second process.

In the manner, the tones were expressed by a value of the inclination 7 of the straight line between the densities, 0.80 and 1.80, obtained on the characteristic curve.

$$\gamma B/\gamma G = \frac{(\gamma B30/\gamma G30)}{(\gamma B45/\gamma G45)} \times 100$$

$$\gamma R/\gamma G = \frac{(\gamma R30/\gamma G30)}{(\gamma R45/\gamma G45)} \times 100$$

$\gamma B30$: Tone of the blue-sensitive layer processed in the 30-second process $\gamma G30$: Tone of the green-sensitive layer processed in the 30-second process $\gamma R30$: Tone of the red-sensitive layer processed in the 30-second process $\gamma B45$: Tone of the blue-sensitive layer processed in the 45-second process $\gamma G45$: Tone of the green-sensitive layer processed in the 45-second process $\gamma G45$: Tone of the red-sensitive layer processed in the 45-second process The results thereof are shown in Table-15.

TABLE 15

| Sample No. | Yellow coupler of Layer 1 | Magenta coupler of Layer 3 | Cyan coupler of Layer 5 | Total amount of gelatin added, g/m² | Color reproducibility: Relative area | Color reproducibility: Visual judgement* | Processing time variation resistance: γ B/γ G | Processing time variation resistance: γ R/γ G |
|---|---|---|---|---|---|---|---|---|
| 14 Comp. | Y-1 | M-1 | C-1/C-2 | 8.2 | 100 | C | 63 | 82 |
| 15 Comp. | Y-1 | M-1 | C-1/C-2 | 7.6 | 100 | C | 64 | 81 |
| 16 Comp. | XI-3 | I-22 | XXXI-4 | 8.2 | 118 | B | 72 | 70 |
| 17 Inv. | XI-3 | I-22 | XXXI-4 | 7.6 | 126 | A | 88 | 89 |
| 18 Inv. | XI-3 | M-1 | XXXI-4 | 7.6 | 127 | A | 88 | 89 |
| 19 Inv. | XI-3 | I-10 | XXXI-4 | 7.6 | 127 | A | 89 | 91 |
| 20 Inv. | XI-3 | I-23 | XXXI-4 | 7.6 | 128 | A | 92 | 92 |

TABLE 15-continued

| Sample No. | Yellow coupler of Layer 1 | Magenta coupler of Layer 3 | Cyan coupler of Layer 5 | Total amount of gelatin added, g/m² | Color reproducibility Relative area | Color reproducibility Visual judgement* | Processing time variation resistance γ B/γ G | Processing time variation resistance γ R/γ G |
|---|---|---|---|---|---|---|---|---|
| 21 Inv. | XI-3 | I-62 | XXXI-4 | 7.6 | 126 | A | 90 | 90 |
| 22 Inv. | XI-10 | I-23 | XXXI-4 | 7.6 | 125 | A | 88 | 91 |
| 23 Inv. | XI-3 | I-23 | XXXI-8 | 7.6 | 126 | A | 90 | 90 |
| 24 Inv. | XI-3 | I-23 | XXXI-15 | 7.6 | 126 | A | 90 | 89 |

*Evaluation level
A: Hue and chroma were excellent.
B: Hue was nearly in fidelity, but chroma was deteriorated.
C: Hue and chroma were both deteriorated.

As can be understood from Table-15, In Samples 14 and 15, the processing time variation resistance thereof were deteriorated as much as that the resistance were out of the permitted limit and any improvement effect could not be found out in the color reproducibility.

In Sample 16, the color reproducibility was improved by the combination of the couplers of the invention, however, the improvement thereof was still not satisfactory and, in addition, the processing time variation resistance was seriously deteriorated.

On the other hand, in Samples 17 through 24 in which the total amounts of gelatin added therein were reduced to be not more than the amount specified in the invention, the color reproducibility and processing time variation resistance were both improved and the effects of the invention could be remarkably displayed in the rapid processing system using the high silver chloride-containing emulsion.

Further, when applying a super-rapid process comprising a 20-second color developing step, a 20-second bleach-fixing step and a 20-second stabilizing step to Samples 17 through 24 each of the invention, the effects of the invention could be obtained.

What is claimed is:

1. A silver halide photographic light-sensitive material comprising a support having thereon a photographic silver halide emulsion layer containing a magenta coupler, a photographic silver halide emulsion layer containing a yellow coupler, a photographic silver halide emulsion layer containing a cyan coupler and a non-light-sensitive layer containing a binder and a UV absorbent, wherein said silver halide photographic light-sensitive material has not more than 7.6 g/m² of gelatin, said UV absorbent is a compound represented by Formula a and has a melting point of from −100° to 15° C., and said magenta coupler is a compound represented by Formula I; with Formula a

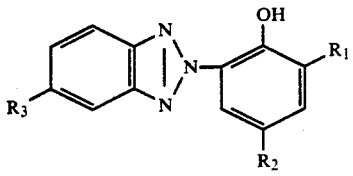

wherein $R_1$, $R_2$, and $R_3$ each represent a hydrogen atom, an alkyl group or an alkoxy group, and Formula I

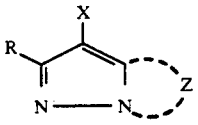

wherein Z represents a non-metallic group necessary to form a nitrogen-containing heterocyclic ring, X represents a hydrogen atom or a group capable of being split upon reaction with an oxidation product of a color developing agent, and R represents a hydrogen atom or substituent.

2. The material of claim 1, wherein said magenta coupler is selected from the group consisting of compounds represented by the following Formulae II, III, IV, V, VI, and VII;

Formula II

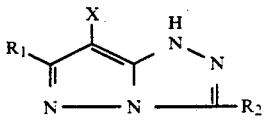

Formula III

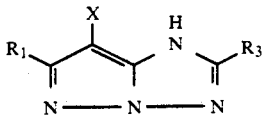

Formula IV

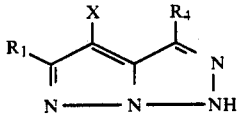

Formula V

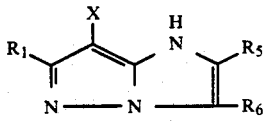

Formula VI

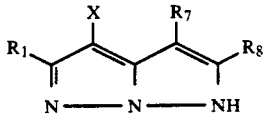

Fórmula VII

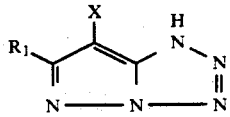

wherein X represents a hydrogen atom or a group capable of being split upon reaction with an oxidation product of a color developing agent, and $R_1$, $R_2$, $R_3$, $R_4$, $R_5$, $R_6$, $R_7$, and $R_8$ each represent a hydrogen atom or a substituent.

3. The material of claim 1, wherein said magenta coupler is a compound represented by the following Formula VII;

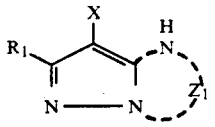

Formula VIII wherein $Z_1$ represents a non-metallic group necessary to form a nitrogen-containing heterocyclic ring, X represents a hydrogen atom or a group capable of being split upon reaction with an oxidation product of a color developing agent, and $R_1$ represents a hydrogen atom or a substituent.

4. The material of claim 1, wherein R in said Formula I is represented by the following Formula IX;

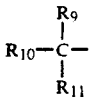

Formula IX wherein $R_9$, $R_{10}$ and $R_{11}$ each represent a hydrogen atom or a substituent, at least two of $R_9$, $R_{10}$ and $R_{11}$ are combined to form a saturated or unsaturated ring, or all of $R_9$, $R_{10}$ and $R_{11}$ are combined to form a cross-linking hydrocarbon compound.

5. The material of claim 1, wherein a substituent at Z in said Formula I is represented by the following Formula X;

$$-R^1-SO_2-R^2$$

Formula X wherein $R^1$represents an alkylene group and $R^2$ represents an alkyl group, a cycloalkyl group or an aryl group.

6. The material of claim 2, wherein $R_2$through $R_8$ in said Formulae II through VI is represented by the following Formula X;

$$-R^1-SO_2-R^2$$

Formula X wherein $R^1$ represents an alkylene group and $R^2$ represents an alkyl group, a cycloalkyl group or an aryl group.

7. The material of claim 3, wherein a substituent of $Z_1$ in said Formula VII is represented by the following Formula X;

$$-R^1-SO_2-R^2$$

Formula X wherein $R^1$ represents an alkylene group and $R^2$ represents an alkyl group, a cycloalkyl group or an aryl group.

8. The material of claim 1, wherein said magenta coupler is contained in an amount of $1\times10^{-3}$ to 1 mol per mol of silver halide.

9. The material of claim 1, wherein said magenta coupler is contained in an amount of $1\times10^{-2}$ to $8\times10^{-1}$ mol per mol of silver halide.

10. The material of claim 1, wherein said non-light-sensitive photographic layer further contains a UV absorbent which is a compound represented b the following Formula a and solid at an ordinary temperature,

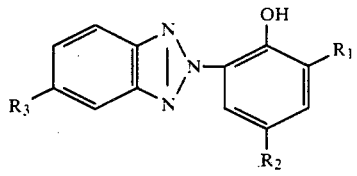

Formula a wherein $R_1$, $R_2$ and $R_3$ each represent a hydrogen atom, a halogen atom, an alkyl group, an aryl group, an alkoxy group, an aryloxy group, an alkenyl group, a nitro group or a hydroxy group.

11. The material of claim 1, wherein said UV absorbent is contained in a proportion within the range of 0.1 to 300 % by weight based on the binder of the layer containing the UV absorbent.

12. The material of claim 1, wherein said UV absorbent is contained in a proportion within the range of 1 to 200 % by weight based on the binder of the layer containing the UV absorbent.

13. The material of claim 1, wherein said UV absorbent is contained in a proportion within the range of 5 to 100 % by weight based on the binder of the layer containing the UV absorbent.

14. The material of claim 1, wherein said silver halide photographic light-sensitive material has 5.0 to 7.6 $g/m^2$ of gelatin.

15. The material of claim 1, wherein the material comprises silver halide grains having not less than 90 mol % of silver chloride, not more than 10 mol % of silver bromide, and not more than 0.5 mol % of silver iodide in the silver halide emulsion layer.

16. The material of claim 15, wherein the amount of the silver halide grains comprising not less than 90 mol % of silver chloride is not less than 60 % by weight based on the total amount of silver halide grains in the silver halide emulsion layer containing the silver halide grains comprising not less than 90 mol % of silver chloride.

17. The material of claim 15, wherein the amount of the silver halide grains comprising not less than 90 mol % of silver chloride is not less than 80 % by weight based on the total amount of silver halide 9rains in the silver halide emulsion layer containing the silver halide grains comprising not less than 90 mol % of silver chloride.

18. The material of claim 1, wherein said yellow coupler is a compound represented by the following Formula XI;

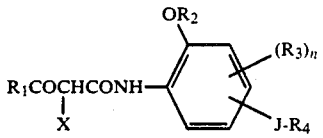

Formula XI wherein $R_1$ represents an alkyl group, a cycloalkyl group or an aryl group, $R_2$ represents an alkyl group, a cycloalkyl group, an acyl group or an aryl group, $R_3$ represents a substituent, n is 0 or 1, $R_4$ represents a group having a carbonyl group or a sulfonyl group, J represents —N($R_5$)CO— (wherein $R_5$ represents a hydrogen atom, an alkyl group, an aryl group or a heterocyclic ring), and X represents a group capable of being split upon reaction with an oxidation product of a color developing agent.

19. The material of claim 1, wherein said cyan coupler is a compound represented by the following Formula XXXI;

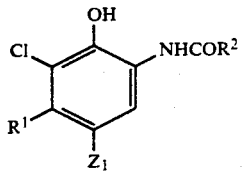

Formula XXXI wherein $R^1$ represents an alkyl group having 2 to 6 of a carbon number, $R^2$ represents a ballast group, and $Z_1$ represents a hydrogen atom or a group capable of being split upon reaction with an oxidation product of a color developing agent.

20. The material of claim 1, wherein said cyan coupler is a compound represented by the following Formula XXXI;

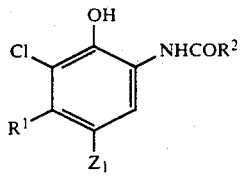

Formula XXXI wherein $R^1$ represents an alkyl group having 2 to 6 of a carbon number, $R^2$ represents a ballast group, and $Z_1$ represents a hydrogen atom or a group capable of being split upon reaction with an oxidation product of a color developing agent., and said magenta coupler is a compound represented by the following Formula XXXII;

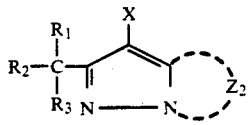

Formula XXXII wherein $R_1$-$R_2$ and $R_3$ each represent a substituent, provided that they are the same as or different from each other, $Z_2$ represents an atomic group necessary to form a heterocyclic ring, and X represents a hydrogen atom or a group capable of being split upon reaction with an oxidation product of a color developing agent.

* * * * *

UNITED STATES PATENT AND TRADEMARK OFFICE

CERTIFICATE OF CORRECTION

PATENT NO. : 5,112,728

DATED : May 12, 1992

INVENTOR(S) : Masaki Tanji et al.

It is certified that error appears in the above-indentified patent and that said Letters Patent is hereby corrected as shown below:

Title Page:

Item [30]: Priority Data, change "1-211738" to --1-261738--.

Item [30]: Priority Data, insert as additional Priority Data
-- Oct. 14, 1989 [JP] Japan.....1-267189-- and
-- Oct. 17, 1989 [JP] Japan.....1-269840--.

Claim 3, column 103, line 5, change "VII" to --VIII--.

Claim 7, column 103, line 51, after "substituent" change "of" to --at--.

Claim 7, column 103, line 52, change "VII" to --VIII--.

Claim 10, column 103, line 68, change "b" to --by--.

UNITED STATES PATENT AND TRADEMARK OFFICE

CERTIFICATE OF CORRECTION

PATENT NO. : 5,112,728

DATED : May 12, 1992

INVENTOR(S) : Masaki Tanji et al.

It is certified that error appears in the above-indentified patent and that said Letters Patent is hereby corrected as shown below:

Calim 17, column 104, line 46, change "9rains" to --grains--.

Signed and Sealed this

Twentieth Day of September, 1994

*Attest:*

*Attesting Officer*

Bruce Lehman

BRUCE LEHMAN

*Commissioner of Patents and Trademarks*